US008613325B2

(12) United States Patent
Guse

(10) Patent No.: US 8,613,325 B2
(45) Date of Patent: Dec. 24, 2013

(54) COMPRESSED GAS FOAM SYSTEM

(76) Inventor: James D. Guse, Edina, MN (US)

( * ) Notice: Subject to any disclaimer, the term of this patent is extended or adjusted under 35 U.S.C. 154(b) by 343 days.

(21) Appl. No.: 12/952,608

(22) Filed: Nov. 23, 2010

(65) Prior Publication Data

US 2011/0127051 A1 Jun. 2, 2011

Related U.S. Application Data

(60) Provisional application No. 61/264,776, filed on Nov. 29, 2009, provisional application No. 61/310,951, filed on Mar. 5, 2010.

(51) Int. Cl.
*A62C 3/00* (2006.01)

(52) U.S. Cl.
USPC ..... 169/44; 169/13; 169/14; 239/9; 239/413; 239/417.5; 239/428; 239/569; 137/88

(58) Field of Classification Search
USPC ..... 169/9, 13, 14, 44; 239/8, 9, 413, 417.5, 239/428, 569; 137/88, 3, 487.5, 285, 265
See application file for complete search history.

(56) References Cited

U.S. PATENT DOCUMENTS

| | | | | |
|---|---|---|---|---|
| 4,612,595 | A | 9/1986 | Gill et al. | |
| 4,725,370 | A | 2/1988 | Greene | |
| 5,167,285 | A | 12/1992 | Williams et al. | |
| 5,232,052 | A * | 8/1993 | Arvidson et al. | 169/14 |
| 5,312,041 | A | 5/1994 | Williams et al. | |
| 5,411,100 | A * | 5/1995 | Laskaris et al. | 169/14 |
| 5,494,112 | A * | 2/1996 | Arvidson et al. | 169/13 |
| RE35,362 | E * | 10/1996 | Arvidson et al. | 169/13 |
| 5,837,168 | A | 11/1998 | Rowe | |
| RE36,196 | E * | 4/1999 | Eberhardt | 169/14 |
| 6,086,052 | A | 7/2000 | Rowe | |
| 6,109,359 | A | 8/2000 | Ballard | |
| 6,138,994 | A | 10/2000 | Rowe | |
| 6,217,009 | B1 | 4/2001 | Rowe | |
| 6,357,532 | B1 | 3/2002 | Laskaris et al. | |
| 6,684,959 | B1 * | 2/2004 | Juidici et al. | 169/44 |
| 6,725,940 | B1 * | 4/2004 | Klein et al. | 169/15 |
| 6,991,041 | B2 * | 1/2006 | Laskaris et al. | 169/14 |
| 7,048,068 | B2 | 5/2006 | Pualkovich | |
| 7,104,336 | B2 | 9/2006 | Ozment | |
| 7,334,644 | B1 | 2/2008 | Ozment | |
| 7,464,992 | B1 | 12/2008 | Ozment | |
| 7,588,612 | B2 | 9/2009 | Marwitz et al. | |
| 7,712,542 | B2 * | 5/2010 | Munroe | 169/14 |
| 2005/0224239 | A1 | 10/2005 | Ozment | |
| 2006/0278359 | A1 | 12/2006 | Wheaton et al. | |
| 2008/0099213 | A1 | 5/2008 | Morrow et al. | |
| 2008/0217026 | A1 | 9/2008 | Hursey | |

* cited by examiner

*Primary Examiner* — Christopher Kim
(74) *Attorney, Agent, or Firm* — Mitchell A. Rossman; Terra Nova Patent Law, PLLC

(57) ABSTRACT

A compressed gas foam system is provided. The compressed gas foam system includes one or more optional fluid pumps, one or more mixing devices, one or more optional foam systems; one or more optional gas compressors, and a system controller. A method of using the compressed gas foam system is also provided.

20 Claims, 20 Drawing Sheets

COMPRESSED GAS FOAM SYSTEM

RELATED APPLICATIONS

This application claims priority to U.S. Provisional Patent Application Ser. No. 61/264,776, filed Nov. 29, 2009, and to U.S. Provisional Patent Application Ser. No. 61/310,951, filed Mar. 5, 2010, all of which are hereby incorporated by reference in their entirety for all purposes, including all of the documents cited therein.

BACKGROUND OF THE INVENTION

The addition of foaming agents to firefighting water streams can be particularly useful for fighting fires, for example, fires in office buildings, industrial factories, chemical plants, petrochemical plants and petroleum refineries. The use of compressed air firefighting foam requires that air and a foam concentrate be mixed and added at constant proportions to the water stream. When the foam extinguisher solution is delivered, the foam effectively extinguishes the flames of chemical and petroleum fires, which would not be effectively extinguished by the application of water alone.

Compressed air foam technology improves the firefighting capacity of water and foam chemicals by producing a higher energy stream that penetrates the fire and by producing a higher quality foam bubble structure than is obtainable by other methods. The size of the compressed air foam bubble can be varied by controlling the ratio of compressed air to foam solution. Further, compressed air foam lines are lighter than water lines and place less stress on the firefighters and allow a greater degree of mobility. This facilitates reduced water damage, quicker fire knockdown, and a "safer" environment for both the firefighters and potential victims. Moreover, the compressed air foam will reduce the associated smoke damage by absorbing smoke from the air.

However, current compressed air foam systems are limited in their applications by the amount of compressed air foam pressure that they can produce.

What is needed is a compressed gas foam system that is applicable to large office buildings, skyscrapers, large ships (e.g., cruise ships, aircraft carriers, container ships), mountainous terrain with high elevations, long hose lays with high frictional losses, and conduits, hoses, or stand pipes with high frictional and/or pressure losses.

SUMMARY OF THE INVENTION

The compressed gas foam systems, as described herein, are applicable to large office buildings, skyscrapers, coal mines, large ships (e.g., cruise ships, aircraft carriers, container ships), mountainous terrain with high elevations, long hose lays with high frictional losses, and conduits, hoses, or stand pipes with high frictional and/or pressure losses.

The compressed gas foam system, as described herein, operates at much higher pressures than existing compressed air foam systems. The higher operating pressures provide many advantages including, for example, the ability to extend the compressed gas foam systems to very high structures, very high elevations, very long hose lays that are beyond the range of the current compressed air foam systems, and the ability to reduce the size and cost of the compressed gas foam system plumbing by requiring smaller diameter plumbing.

The present invention provides a compressed gas foam system. The compressed gas foam system includes: one or more optional fluid pumps each having an inlet and an outlet, wherein each inlet is placed in fluid communication with a fluid source; a first mixing device having a first inlet, a second inlet, and an outlet, wherein the first inlet of the first mixing device is placed in fluid communication with the outlet of each of the one or more optional fluid pumps, wherein the second inlet of the first mixing device is placed in fluid communication with one or more optional foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more optional gas compressors each having an inlet and an outlet, wherein each inlet of the one or more optional gas compressors is placed in fluid communication with the gas source, and wherein each outlet of the one or more optional gas compressors is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more optional gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input, provided that when the one or more optional fluid pumps are not present, then the fluid source includes one or more fluids in one or more pressurized fluid containers, provided that when the one or more optional gas compressors are not present, then the gas source includes one or more gases in one or more pressurized gas containers, provided that when the one or more optional foam systems are not present, then the fluid source includes one or more foam chemicals.

In one embodiment, the system controller includes a programmable microprocessor, a microcontroller, an application specific integrated circuit, a programmable logic array, or a combination thereof. In another embodiment, the compressed gas foam is discharged from the outlet of the second mixing device at a pressure from about 25 pounds per square inch to about 20,000 pounds per square inch, or from about 25 pounds per square inch to about 500 pounds per square inch. In one embodiment, the compressed gas foam system further includes an outlet regulator having an inlet, a low pressure outlet, and a high pressure outlet, wherein the inlet is placed in fluid communication with the outlet of the second mixing device. In yet another embodiment, the compressed gas foam system further includes one or more delivery conduits each having an inlet and an outlet, wherein the inlet of each of the one or more delivery conduits is placed in fluid communication with the low pressure outlet of the outlet regulator, the high pressure outlet of the outlet regulator, or a combination thereof, wherein a compressed gas foam is communicated through each of the one or more delivery conduits and allowed to discharge from the outlet of each of the one or more delivery conduits.

In one embodiment, the compressed gas foam is discharged from the outlet of each of the one or more delivery conduits is placed in fluid communication with the low pressure outlet of the outlet regulator at a pressure from about 25 pounds per square inch to about 125 pounds per square inch. In another embodiment, the compressed gas foam is discharged from the outlet of each of the one or more delivery conduits is placed in fluid communication with the high pressure outlet of the outlet regulator at a pressure from about 125 pounds per square inch to about 225 pounds per square inch. In one embodiment, each of the one or more optional fluid pumps is a single stage fluid pump, a multistage fluid pump, or a combination thereof. In another embodiment, each of the one or more optional fluid pumps is a single stage fluid pump. In one embodiment, each of the one or more optional fluid pumps is a multistage fluid pump.

In one embodiment, if two or more optional fluid pumps are present, at least one of the fluid pumps is a single stage fluid pump and at least one of the fluid pumps is a multistage fluid pump. In one embodiment, if two or more optional fluid pumps are present, the outlet of the first fluid pump is configured to pump fluid at a first fluid pressure and is coupled to the inlet of the second fluid pump and the outlet of the second fluid pump is configured to pump fluid at a second fluid pressure, wherein the second fluid pressure is greater than the first fluid pressure.

In one embodiment, if two or more optional fluid pumps are present, the two or more optional fluid pumps are coupled in parallel. In one embodiment, the first mixing device includes a t-joint, a motionless mixer, or a combination thereof. In another embodiment, the second mixing device includes a t-joint, a motionless mixer, or a combination thereof. In one embodiment, each of the one or more optional gas compressors is a single stage gas compressor, a multistage gas compressor, or a combination thereof. In another embodiment, each of the one or more optional gas compressors is a single stage gas compressor. In one embodiment, each of the one or more optional gas compressors is a multistage gas compressor.

In one embodiment, if two or more optional gas compressors are present, at least one of the gas compressors is a single stage gas compressor and at least one of the gas compressors is a multistage gas compressor. In one embodiment, if two or more optional gas compressors are present, the outlet of the first gas compressor is configured to pump gas at a first gas pressure and is coupled to the inlet of the second gas compressor and the outlet of the second gas compressor is configured to pump gas at a second gas pressure, wherein the second gas pressure is greater than the first gas pressure. In one embodiment, if two or more optional gas compressors are present, the two or more optional gas compressors are coupled in parallel.

In one embodiment, if two or more optional foam systems are present, the outlet of the first foam system is configured to pump a foam solution at a first foam solution pressure and is coupled to the inlet of the second foam system and the outlet of the second foam system is configured to pump a foam solution at a second foam solution pressure, wherein the second foam solution pressure is greater than the first foam solution pressure.

In one embodiment, if two or more optional foam systems are present, the two or more optional foam systems are coupled in parallel. In one embodiment, each of the one or more optional fluid pumps, the one or more optional gas compressors, and the one or more optional foam systems is independently coupled with one or more power sources. In one embodiment, the fluid is water. In another embodiment, the gas is air. In one embodiment, the gas is nitrogen, carbon dioxide, helium, neon, argon, or a combination thereof.

In another embodiment, the one or more optional fluid pumps are not present and the fluid source includes one or more fluids in one or more pressurized fluid containers. In yet another embodiment, the one or more optional gas compressors are not present and the gas source includes one or more gases in one or more pressurized gas containers. In one embodiment, if the one or more optional foam systems are not present, then the fluid source includes one or more foam chemicals. In one embodiment, the one or more optional fluid pumps are not present and the fluid source includes one or more fluids in one or more pressurized fluid containers, wherein the one or more optional gas compressors are not present and the gas source includes one or more gases in one or more pressurized gas containers, and wherein the one or more optional foam systems are not present and the fluid source includes one or more foam chemicals. In one embodiment, the one or more optional fluid pumps are not present and the fluid source includes one or more fluids in one or more pressurized fluid containers, and wherein the one or more optional gas compressors are not present and the gas source includes one or more gases in one or more pressurized gas containers. In another embodiment, the one or more optional fluid pumps are not present and the fluid source includes one or more fluids in one or more pressurized fluid containers, and wherein the one or more optional foam systems are not present and the fluid source includes one or more foam chemicals. In yet another embodiment, the one or more optional gas compressors are not present and the gas source includes one or more gases in one or more pressurized gas containers, and wherein the one or more optional foam systems are not present and the fluid source includes one or more foam chemicals.

The present invention provides a compressed air foam system. The compressed air foam system includes: one or more water pumps each having an inlet and an outlet, wherein each inlet is placed in fluid communication with a water source;

a first mixing device having a first inlet, a second inlet, and an outlet, wherein the first inlet of the first mixing device is placed in fluid communication with the outlet of each of the one or more water pumps, wherein the second inlet of the first mixing device is placed in fluid communication with one or more foam systems, wherein the outlet of the first mixing system is placed in fluid communication with a water control system including a water flow sensor having an inlet and an outlet, a water pressure sensor having an inlet and an outlet, and a water valve having an inlet and an outlet, wherein the inlet of the water flow sensor is placed in fluid communication with the outlet of the first mixing device, wherein the outlet of the water flow sensor is placed in fluid communication with the inlet of the water pressure sensor, wherein the outlet of the water pressure sensor is placed in water communication with the inlet of the water valve;

a second mixing device having a first inlet, a second inlet, and an outlet, wherein the first inlet of the second mixing device is placed in fluid communication with the outlet of the water valve;

one or more air compressors each having an inlet and an outlet, wherein each inlet of the one or more air compressors is placed in fluid communication with the air source, and wherein each outlet of the one or more air compressors is placed in fluid communication with an air control system including an air flow sensor having an inlet and an outlet, an air pressure sensor having an inlet and an outlet, and an air valve having an inlet and an outlet, wherein the inlet of the air flow sensor is placed in fluid communication with each outlet of the one or more air compressors, wherein the outlet of the air flow sensor is placed in fluid communication with the inlet of the air pressure sensor, wherein the outlet of the air pressure sensor is placed in fluid communication with the inlet of the air valve, wherein the outlet of the air valve is placed in fluid communication with the second inlet of the second mixing device; and a system controller operatively coupled to the air control system and to the water control system, wherein the system controller includes a programmable input, wherein the system controller is configured: to receive a sensed water flow rate from the water flow sensor, to receive a sensed water pressure from the water pressure sensor; to receive a sensed air flow rate from the air flow sensor, to receive a sensed air pressure from the air pressure sensor, to output a first control signal to the water valve for regulating a water flow, to output a second control signal to the air valve for regulating an air flow relative to the sensed water flow, wherein the system controller automatically adjusts the first control signal and the second control signal to maintain a ratio of water flow to air flow based upon the programmable input, wherein each of the one or more water pumps, the one or more air compressors, and the one or more foam systems is independently coupled with one or more power sources.

In one embodiment, the system controller includes a programmable microprocessor, a microcontroller, an application specific integrated circuit, a programmable logic array, or a combination thereof. In another embodiment, the compressed air foam is discharged from the outlet of the second mixing device at a pressure from about 25 pounds per square inch to about 500 pounds per square inch.

In yet another embodiment, the compressed air foam system further includes one or more delivery conduits each having an inlet and an outlet, wherein the inlet of each of the one or more delivery conduits is placed in fluid communication with the low pressure outlet of the outlet regulator, the high pressure outlet of the outlet regulator, or a combination thereof, wherein a compressed air foam is communicated through each of the one or more delivery conduits and allowed to discharge from the outlet of each of the one or more delivery conduits.

In one embodiment, the compressed air foam is discharged from the outlet of each of the one or more delivery conduits is placed in fluid communication with the low pressure outlet of the outlet regulator at a pressure from about 25 pounds per square inch to about 125 pounds per square inch.

In another embodiment, the compressed air foam is discharged from the outlet of each of the one or more delivery conduits is placed in fluid communication with the high pressure outlet of the outlet regulator at a pressure from about 125 pounds per square inch to about 225 pounds per square inch. In yet another embodiment, the first mixing device includes a t-joint, a motionless mixer, or a combination thereof. In one embodiment, the second mixing device includes a t-joint, a motionless mixer, or a combination thereof.

In one embodiment, each of the one or more water pumps is a single stage water pump, a multistage water pump, or a combination thereof. In one embodiment, if two or more water pumps are present, the outlet of the first water pump is configured to pump water at a first water pressure and is coupled to the inlet of the second water pump and the outlet of the second water pump is configured to pump water at a second water pressure, wherein the second water pressure is greater than the first water pressure. In one embodiment, if two or more water pumps are present, the two or more water pumps are coupled in parallel. In one embodiment, each of the one or more air compressors is a single stage air compressor, a multistage air compressor, or a combination thereof. In one embodiment, if two or more air compressors are present, the outlet of the first air compressor is configured to pump air at a first air pressure and is coupled to the inlet of the second air compressor and the outlet of the second air compressor is configured to pump air at a second air pressure, wherein the second air pressure is greater than the first air pressure.

In one embodiment, if two or more air compressors are present, the two or more air compressors are coupled in parallel. In one embodiment, if two or more foam systems are present, the outlet of the first foam system is configured to pump a foam solution at a first foam solution pressure and is coupled to the inlet of the second foam system and the outlet of the second foam system is configured to pump a foam solution at a second foam solution pressure, wherein the second foam solution pressure is greater than the first foam solution pressure. In one embodiment, if two or more foam systems are present, the two or more foam systems are coupled in parallel.

The present invention provides a compressed air foam system. The compressed air foam system includes: one or more water pumps each having an inlet and an outlet, wherein each inlet is placed in fluid communication with a water source;

a first mixing device having a first inlet, a second inlet, and an outlet, wherein the first inlet of the first mixing device is placed in fluid communication with the outlet of each of the one or more water pumps, wherein the second inlet of the first mixing device is placed in fluid communication with one or more foam systems, wherein the outlet of the first mixing system is placed in fluid communication with a water control system including a water flow sensor having an inlet and an outlet, a water pressure sensor having an inlet and an outlet, and a water valve having an inlet and an outlet, wherein the inlet of the water flow sensor is placed in fluid communication with the outlet of the first mixing device, wherein the outlet of the water flow sensor is placed in fluid communication with the inlet of the water pressure sensor, wherein the outlet of the water pressure sensor is placed in fluid communication with the inlet of the water valve;

a second mixing device having a first inlet, a second inlet, and an outlet, wherein the first inlet of the second mixing device is placed in fluid communication with the outlet of the water valve;

one or more air compressors each having an inlet and an outlet, wherein each inlet of the one or more air compressors is placed in fluid communication with the air source, and wherein each outlet of the one or more air compressors is placed in fluid communication with an air control system including an air flow sensor having an inlet and an outlet, an air pressure sensor having an inlet and an outlet, and an air valve having an inlet and an outlet, wherein the inlet of the air flow sensor is placed in fluid communication with each outlet of the one or more air compressors, wherein the outlet of the air flow sensor is placed in fluid communication with the inlet of the air pressure sensor, wherein the outlet of the air pressure sensor is placed in fluid communication with the inlet of the air valve, wherein the outlet of the air valve is placed in fluid communication with the second inlet of the second mixing device; and a system controller operatively coupled to the air control system and to the water control system, wherein the system controller includes a programmable input, wherein the system controller is configured: to receive a sensed water flow rate from the water flow sensor, to receive a sensed water pressure from the water pressure sensor; to receive a sensed air flow rate from the air flow sensor, to receive a sensed air pressure from the air pressure sensor, to output a first control signal to the water valve for regulating a water flow, to output a second control signal to the air valve for regulating an air flow relative to the sensed water flow, wherein the system controller automatically adjusts the first control signal and the second control signal to maintain a ratio of water flow to air flow based upon the programmable input;

an outlet regulator having an inlet, a low pressure outlet, and a high pressure outlet, wherein the inlet is placed in fluid communication with the outlet of the second mixing device; and one or more delivery conduits each having an inlet and an outlet, wherein the inlet of each of the one or more delivery conduits is placed in fluid communication with the low pressure outlet of the outlet regulator, the high pressure outlet of the outlet regulator, or a combination thereof, wherein a compressed air foam is communicated through each of the one or more delivery conduits and allowed to discharge from the outlet of each of the one or more delivery conduits, wherein each of the one or more multistage water pumps, the one or more multistage air compressors, and the one or more foam systems is independently coupled with one or more power sources.

In one embodiment, the system controller includes a programmable microprocessor, a microcontroller, an application specific integrated circuit, a programmable logic array, or a combination thereof.

In another embodiment, the compressed air foam is discharged from the outlet of the second mixing device at a pressure from about 25 pounds per square inch to about 500 pounds per square inch. In yet another embodiment, the first mixing device includes a t-joint, a motionless mixer, or a combination thereof. In one embodiment, the second mixing device includes a t-joint, a motionless mixer, or a combination thereof. In one embodiment, if two or more multistage water pumps are present, the two or more multistage water pumps are coupled in parallel. In one embodiment, if two or more multistage air compressors are present, the outlet of the first multistage air compressor is configured to pump air at a first air pressure and is coupled to the inlet of the second multistage air compressor and the outlet of the second multistage air compressor is configured to pump air at a second air pressure, wherein the second air pressure is greater than the first air pressure. In one embodiment, if two or more multistage air compressors are present, the two or more air compressors are coupled in parallel. In one embodiment, if two or more foam systems are present, the outlet of the first foam system is configured to pump a foam solution at a first foam solution pressure and is coupled to the inlet of the second foam system and the outlet of the second foam system is configured to pump a foam solution at a second foam solution pressure, wherein the second foam solution pressure is greater than the first foam solution pressure. In one embodiment, if two or more foam systems are present, the two or more foam systems are coupled in parallel.

The present invention also provides a method of suppressing or preventing a fire. The method includes: providing a compressed gas foam system including:

one or more optional fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more optional fluid pumps, wherein the second inlet of the first mixing device is placed in fluid communication with one or more optional foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more optional gas compressors each having an inlet and an outlet, wherein each inlet of the one or more optional gas compressors is placed in fluid communication with the gas source, and wherein each outlet of the one or more optional gas compressors is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more optional gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input, provided that when the one or more optional fluid pumps are not present, then the fluid source includes one or more fluids in one or more pressurized fluid containers, provided that when the one or more optional gas compressors are not present, then the gas source includes one or more gases in one or more pressurized gas containers, provided that when the one or more optional foam systems are not present, then the fluid source includes one or more foam chemicals, flowing a fluid through a flow path through the compressed gas foam system;

mixing the fluid from one of the one or more optional fluid pumps and a foam chemical in the first mixing device to produce a fluid and foam chemical mixture;

mixing gas from one or more optional gas compressors into the fluid and foam chemical mixture in the second mixing device to generate a compressed gas foam; and directing the compressed gas foam from the outlet of one or more delivery conduits to the fire.

The present invention provides a compressed gas foam system. The compressed gas foam system includes:

a first fluid pump having an inlet and an outlet, wherein the inlet is placed in fluid communication with a fluid source, wherein the outlet of the first fluid pump is placed in fluid communication with an inlet of a first fluid regulator having an inlet, a first outlet, and a second outlet;

a second fluid pump having an inlet and an outlet, wherein the inlet of the second fluid pump is placed in fluid communication with the first outlet of the first fluid regulator;

a first mixing device having a first inlet, a second inlet, and an outlet, wherein the first inlet of the first mixing device is placed in fluid communication with the outlet of the second fluid pump;

a second mixing device having a first inlet, a second inlet, and an outlet, wherein the first inlet is placed in fluid communication with the first outlet of the first fluid regulator;

a first foam system placed in fluid communication with the second inlet of the first mixing device;

a second foam system placed in fluid communication with the second inlet of the second mixing device;

a first gas compressor having an inlet and an outlet, wherein the inlet is placed in fluid communication with the gas source, wherein the outlet is placed in fluid communication with an inlet of a second fluid regulator having an inlet, a first outlet, and a second outlet;

a second gas compressor having an inlet and an outlet, wherein the inlet of the second gas compressor is placed in fluid communication with the first outlet of the second fluid regulator;

wherein the outlet of the second gas compressor is placed in fluid communication with an inlet of a first gas control system including a first gas flow sensor having an inlet and an outlet, a first gas pressure sensor having an inlet and an outlet, and a first gas valve having an inlet and an outlet, wherein the inlet of the first gas flow sensor is placed in fluid communication with the outlet of the second gas compressor, wherein the outlet of the first gas flow sensor is placed in fluid communication with the inlet of the first gas pressure sensor, wherein the outlet of the first gas pressure sensor is placed in fluid communication with the inlet of the first gas valve, wherein the outlet of the first gas valve is placed in fluid communication with a first inlet of a third mixing device having a first inlet, a second inlet, and an outlet, a first fluid control system including a first fluid flow sensor having an inlet and an outlet, a first fluid pressure sensor having an inlet and an outlet, and a fluid valve having an inlet and an outlet, wherein the inlet of the first fluid flow sensor is placed in fluid communication with the outlet of the first mixing device, wherein the outlet of the first fluid flow sensor is placed in fluid communication with the inlet of the first fluid pressure sensor, wherein the outlet of the first fluid pressure sensor is placed in fluid communication with the inlet of the first fluid valve;

wherein the outlet of the first fluid valve is placed in fluid communication with the second inlet of the third mixing device;

a second gas control system including a second gas flow sensor having an inlet and an outlet, a second gas pressure sensor having an inlet and an outlet, and a second gas valve having an inlet and an outlet, wherein the inlet of the second gas flow sensor is placed in fluid communication with the second outlet of the second fluid regulator, wherein the outlet of the second gas flow sensor is placed in fluid communication with the inlet of the second gas pressure sensor, wherein the outlet of the second gas pressure sensor is placed in fluid communication with the inlet of the second gas valve, wherein the outlet of the second gas valve is placed in fluid communication with a first inlet of the fourth mixing device having a first inlet, a second inlet, and an outlet, a second fluid control system including a second fluid flow sensor having an inlet and an outlet, a second fluid pressure sensor having an inlet and an outlet, and a second fluid valve having an inlet and an outlet, wherein the inlet of the second fluid flow sensor is placed in fluid communication with the outlet of the second mixing device, wherein the outlet of the second fluid flow sensor is placed in fluid communication with the inlet of the second fluid pressure sensor, wherein the outlet of the second fluid pressure sensor is placed in fluid communication with the inlet of the second fluid valve;

wherein the outlet of the second fluid valve is placed in fluid communication with the second inlet of the fourth mixing device;

a system controller operatively independently coupled to each of the first gas control system, the second gas control system, the first fluid control system, and the second fluid control system, wherein the system controller includes a first programmable input and a second programmable input, wherein the system controller is configured: to receive a sensed first fluid flow rate from the first fluid flow sensor, to receive a sensed first fluid pressure from the first fluid pressure sensor; to receive a sensed first gas flow rate from the first gas flow sensor, to receive a sensed first gas pressure from the first gas pressure sensor, to output a first control signal to the first fluid valve for regulating a first fluid flow, to output a second control signal to the first gas valve for regulating a first gas flow relative to the sensed first fluid flow, wherein the system controller automatically adjusts the first control signal and the second control signal to maintain a ratio of first fluid flow to first gas flow based upon the first programmable input, and wherein the system controller is configured: to receive a sensed second fluid flow rate from the second fluid flow sensor, to receive a sensed second fluid pressure from the second fluid pressure sensor; to receive a sensed second gas flow rate from the second gas flow sensor, to receive a sensed second gas pressure from the second gas pressure sensor, to output a third control signal to the second fluid valve for regulating a second fluid flow, to output a fourth control signal to the second gas valve for regulating a second gas flow relative to the sensed second fluid flow, wherein the system controller automatically adjusts the third control signal and the fourth control signal to maintain a ratio of second fluid flow to second gas flow based upon the second programmable input.

The present invention also provides a method of suppressing or preventing a fire. The method includes: providing a compressed gas foam system including:

a first fluid pump having an inlet and an outlet, wherein the inlet is placed in fluid communication with a fluid source, wherein the outlet of the first fluid pump is placed in fluid communication with an inlet of a first fluid regulator having an inlet, a first outlet, and a second outlet;

a second fluid pump having an inlet and an outlet, wherein the inlet of the second fluid pump is placed in fluid communication with the first outlet of the first fluid regulator;

a first mixing device having a first inlet, a second inlet, and an outlet, wherein the first inlet of the first mixing device is placed in fluid communication with the outlet of the second fluid pump;

a second mixing device having a first inlet, a second inlet, and an outlet, wherein the first inlet is placed in fluid communication with the first outlet of the first fluid regulator;

a first foam system placed in fluid communication with the second inlet of the first mixing device;

a second foam system placed in fluid communication with the second inlet of the second mixing device;

a first gas compressor having an inlet and an outlet, wherein the inlet is placed in fluid communication with the gas source, wherein the outlet is placed in fluid communication with an inlet of a second fluid regulator having an inlet, a first outlet, and a second outlet;

a second gas compressor having an inlet and an outlet, wherein the inlet of the second gas compressor is placed in fluid communication with the first outlet of the second fluid regulator;

wherein the outlet of the second gas compressor is placed in fluid communication with an inlet of a first gas control system including a first gas flow sensor having an inlet and an outlet, a first gas pressure sensor having an inlet and an outlet, and a first gas valve having an inlet and an outlet, wherein the inlet of the first gas flow sensor is placed in fluid communication with the outlet of the second gas compressor, wherein the outlet of the first gas flow sensor is placed in fluid communication with the inlet of the first gas pressure sensor, wherein the outlet of the first gas pressure sensor is placed in fluid communication with the inlet of the first gas valve, wherein the outlet of the first gas valve is placed in fluid communication with a first inlet of a third mixing device having a first inlet, a second inlet, and an outlet, a first fluid control system including a first fluid flow sensor having an inlet and an outlet, a first fluid pressure sensor having an inlet and an outlet, and a fluid valve having an inlet and an outlet, wherein the inlet of the first fluid flow sensor is placed in fluid communication with the outlet of the first mixing device, wherein the outlet of the first fluid flow sensor is placed in fluid communication with the inlet of the first fluid pressure sensor, wherein the outlet of the first fluid pressure sensor is placed in fluid communication with the inlet of the first fluid valve;

wherein the outlet of the first fluid valve is placed in fluid communication with the second inlet of the third mixing device;

a second gas control system including a second gas flow sensor having an inlet and an outlet, a second gas pressure sensor having an inlet and an outlet, and a second gas valve having an inlet and an outlet, wherein the inlet of the second gas flow sensor is placed in fluid communication with the second outlet of the second fluid regulator, wherein the outlet of the second gas flow sensor is placed in fluid communication with the inlet of the second gas pressure sensor, wherein the outlet of the second gas pressure sensor is placed in fluid communication with the inlet of the second gas valve, wherein the outlet of the second gas valve is placed in fluid communication with a first inlet of the fourth mixing device having a first inlet, a second inlet, and an outlet, a second fluid control system including a second fluid flow sensor having an inlet and an outlet, a second fluid pressure sensor having an inlet and an outlet, and a second fluid valve having an inlet and an outlet, wherein the inlet of the second fluid flow sensor is placed in fluid communication with the outlet of the second mixing device, wherein the outlet of the second fluid flow sensor is placed in fluid communication with the inlet of the second fluid pressure sensor, wherein the outlet of the second fluid pressure sensor is placed in fluid communication with the inlet of the second fluid valve;

wherein the outlet of the second fluid valve is placed in fluid communication with the second inlet of the fourth mixing device;

a system controller operatively independently coupled to each of the first gas control system, the second gas control system, the first fluid control system, and the second fluid control system, wherein the system controller includes a first programmable input and a second programmable input, wherein the system controller is configured: to receive a sensed first fluid flow rate from the first fluid flow sensor, to receive a sensed first fluid pressure from the first fluid pressure sensor; to receive a sensed first gas flow rate from the first gas flow sensor, to receive a sensed first gas pressure from the first gas pressure sensor, to output a first control signal to the first fluid valve for regulating a first fluid flow, to output a second control signal to the first gas valve for regulating a first gas flow relative to the sensed first fluid flow, wherein the system controller automatically adjusts the first control signal and the second control signal to maintain a ratio of first fluid flow to first gas flow based upon the first programmable input, and wherein the system controller is configured: to receive a sensed second fluid flow rate from the second fluid flow sensor, to receive a sensed second fluid pressure from the second fluid pressure sensor; to receive a sensed second gas flow rate from the second gas flow sensor, to receive a sensed second gas pressure from the second gas pressure sensor, to output a third control signal to the second fluid valve for regulating a second fluid flow, to output a fourth control signal to the second gas valve for regulating a second gas flow relative to the sensed second fluid flow, wherein the system controller automatically adjusts the third control signal and the fourth control signal to maintain a ratio of second fluid flow to second gas flow based upon the second programmable input;

flowing a fluid through a flow path through the compressed gas foam system;

mixing the fluid from the first fluid pump and the second fluid pump and a foam chemical in the first mixing device to produce a fluid and foam chemical mixture or mixing the fluid from the first fluid pump and a foam chemical in the second mixing device to produce a fluid and foam chemical mixture;

mixing gas from the first gas compressor and the second gas compressor into the fluid and foam chemical mixture in the third mixing device to generate a compressed gas foam or mixing gas from the first gas compressor into the fluid and foam chemical mixture in the fourth mixing device to generate a compressed gas foam; and directing the compressed gas foam from the outlet of a first delivery conduit, a second delivery conduit, or both the first delivery conduit and the second delivery conduit to the fire.

The present invention provides a compressed air foam system. The compressed air foam system includes: a fluid pump having an inlet and an outlet, wherein the inlet is placed in fluid communication with a fluid source, wherein the outlet of the fluid pump is placed in fluid communication with an inlet of a first fluid regulator having an inlet, a first outlet, and a second outlet;

a first mixing device having a first inlet, a first outlet, and a second outlet, wherein the first inlet of the first mixing device is placed in fluid communication with the first outlet of first fluid regulator;

a foam system placed in fluid communication with the second inlet of the first mixing device;

a gas compressor having an inlet and an outlet, wherein the inlet is placed in fluid communication with the gas source, wherein the outlet is placed in fluid communication with an inlet of a second fluid regulator having an inlet, a first outlet, and a second outlet;

wherein the first outlet of the second fluid regulator is placed in fluid communication with an inlet of a first gas control system including a first gas flow sensor having an inlet and an outlet, a first gas pressure sensor having an inlet and an outlet, and a first gas valve having an inlet and an outlet, wherein the inlet of the first gas flow sensor is placed in fluid communication with the outlet of the second fluid regulator, wherein the outlet of the first gas flow sensor is placed in fluid communication with the inlet of the first gas pressure sensor, wherein the outlet of the first gas pressure sensor is placed in fluid communication with the inlet of the first gas valve, wherein the outlet of the first gas valve is placed in fluid communication with a first inlet of a second mixing device having a first inlet, a second inlet, and an outlet, wherein the second inlet of the second mixing device is placed in fluid communication with the first outlet of the first mixing device, wherein the second outlet of the first mixing device is placed in fluid communication with the inlet of a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the second outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

wherein the outlet of the fluid valve is placed in fluid communication with a first inlet of the third mixing device having a first inlet, a second inlet, and an outlet, a second gas control system including a second gas flow sensor having an inlet and an outlet, a second gas pressure sensor having an inlet and an outlet, and a second gas valve having an inlet and an outlet, wherein the inlet of the second gas flow sensor is placed in fluid communication with the second outlet of the second fluid regulator, wherein the outlet of the second gas flow sensor is placed in fluid communication with the inlet of the second gas pressure sensor, wherein the outlet of the second gas pressure sensor is placed in fluid communication with the inlet of the second gas valve, wherein the outlet of the second gas valve is placed in fluid communication with a second inlet of the third mixing device, a system controller operatively coupled to the first gas control system, the second gas control system, and to the fluid control system, wherein the system controller includes a first programmable input and a second programmable input, wherein the system controller is configured: to receive a sensed fluid flow rate from the fluid flow sensor, to receive a sensed fluid pressure from the fluid pressure sensor; to receive a sensed first gas flow rate from the first gas flow sensor, to receive a sensed first gas pressure from the first gas pressure sensor, to receive a sensed second gas flow rate from the second gas flow sensor, to receive a sensed second gas pressure from the second gas pressure sensor, to output a first control signal to the fluid valve for regulating a fluid flow, a fluid pressure, or a combination thereof, to output a second control signal to the second gas valve for regulating a second gas flow relative to the sensed fluid flow, to output a third control signal to the first gas valve for regulating a first gas flow, wherein the system controller automatically adjusts the first control signal and the second control signal to maintain a ratio of fluid flow to second gas flow based upon the programmable input.

The present invention also provides a method of suppressing or preventing a fire. The method includes: providing a compressed gas foam system including:

a fluid pump having an inlet and an outlet, wherein the inlet is placed in fluid communication with a fluid source, wherein the outlet of the fluid pump is placed in fluid communication with an inlet of a first fluid regulator having an inlet, a first outlet, and a second outlet;

a first mixing device having a first inlet, a first outlet, and a second outlet, wherein the first inlet of the first mixing device is placed in fluid communication with the first outlet of first fluid regulator;

a foam system placed in fluid communication with the second inlet of the first mixing device;

a gas compressor having an inlet and an outlet, wherein the inlet is placed in fluid communication with the gas source, wherein the outlet is placed in fluid communication with an inlet of a second fluid regulator having an inlet, a first outlet, and a second outlet;

wherein the first outlet of the second fluid regulator is placed in fluid communication with an inlet of a first gas control system including a first gas flow sensor having an inlet and an outlet, a first gas pressure sensor having an inlet and an outlet, and a first gas valve having an inlet and an outlet, wherein the inlet of the first gas flow sensor is placed in fluid communication with the outlet of the second fluid regulator, wherein the outlet of the first gas flow sensor is placed in fluid communication with the inlet of the first gas pressure sensor, wherein the outlet of the first gas pressure sensor is placed in fluid communication with the inlet of the first gas valve, wherein the outlet of the first gas valve is placed in fluid communication with a first inlet of a second mixing device having a first inlet, a second inlet, and an outlet, wherein the second inlet of the second mixing device is placed in fluid communication with the first outlet of the first mixing device, wherein the second outlet of the first mixing device is placed in fluid communication with the inlet of a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the second outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

wherein the outlet of the fluid valve is placed in fluid communication with a first inlet of the third mixing device having a first inlet, a second inlet, and an outlet, a second gas control system including a second gas flow sensor having an inlet and an outlet, a second gas pressure sensor having an inlet and an outlet, and a second gas valve having an inlet and an outlet, wherein the inlet of the second gas flow sensor is placed in fluid communication with the second outlet of the second fluid regulator, wherein the outlet of the second gas flow sensor is placed in fluid communication with the inlet of the second gas pressure sensor, wherein the outlet of the second gas pressure sensor is placed in fluid communication with the inlet of the second gas valve, wherein the outlet of the second gas valve is placed in fluid communication with a second inlet of the third mixing device, a system controller operatively coupled to the first gas control system, the second gas control system, and to the fluid control system, wherein the system controller includes a first programmable input and a second programmable input, wherein the system controller is configured: to receive a sensed fluid flow rate from the fluid flow sensor, to receive a sensed fluid pressure from the fluid pressure sensor; to receive a sensed first gas flow rate from the first gas flow sensor, to receive a sensed first gas pressure from the first gas pressure sensor, to receive a sensed second gas flow rate from the second gas flow sensor, to receive a sensed second gas pressure from the second gas pressure sensor, to output a first control signal to the fluid valve for regulating a fluid flow, a fluid pressure, or a combination thereof, to output a second control signal to the second gas valve for regulating a second gas flow relative to the sensed fluid flow, to output a third control signal to the first gas valve for regulating a first gas flow, wherein the system controller automatically adjusts the first control signal and the second control signal to maintain a ratio of fluid flow to second gas flow based upon the programmable input, flowing a fluid through a flow path through the compressed gas foam system;

mixing the fluid from the fluid pump and a foam chemical in the first mixing device to produce a fluid and foam chemical mixture;

mixing gas from the gas compressor into the fluid and foam chemical mixture in the second or third mixing device to generate a compressed gas foam and directing the compressed gas foam from the outlet of a first delivery conduit, a second delivery conduit, or both the first delivery conduit and the second delivery conduit to the fire.

The present invention provides a compressed gas foam system. The compressed gas foam system includes: one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more pressurized gas containers each having an outlet, wherein each outlet of the one or more pressurized gas containers is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more pressurized gas containers, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides a compressed gas foam system. The compressed gas foam system includes: one or more fluid pumps each having an inlet and an outlet, wherein each inlet is placed in fluid communication with a fluid source, wherein the fluid source includes one or more foam chemicals;

a first mixing device having an inlet and an outlet, wherein the first inlet of the first mixing device is placed in fluid communication with the outlet of each of the one or more fluid pumps, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides a compressed gas foam system. The compressed gas foam system includes: one or more pressurized fluid containers each having an outlet, wherein each pressurized fluid container includes a pressurized fluid;

a first mixing device having a first inlet, a second inlet, and an outlet, wherein the first inlet of the first mixing device is placed in fluid communication with the outlet of each of the one or more pressurized fluid containers, wherein the second inlet of the first mixing device is placed in fluid communication with one or more foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more pressurized gas containers each having an outlet, wherein each outlet of the one or more pressurized gas containers is placed in fluid communication with a gas control system including; a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more pressurized gas containers, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides a compressed gas foam system. The compressed gas foam system includes: one or more pressurized fluid containers each having an outlet, wherein each pressurized fluid container includes a pressurized fluid including one or more foam chemicals;

a first mixing device having a first inlet, a second inlet, and an outlet, wherein the first inlet of the first mixing device is placed in fluid communication with the outlet of each of the one or more pressurized fluid containers, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides a compressed gas foam system. The compressed gas foam system includes: one or more fluid pumps each having an inlet and an outlet, wherein each inlet is placed in fluid communication with a fluid source, wherein the fluid source includes one or more foam chemicals;

a first mixing device having an inlet and an outlet, wherein the first inlet of the first mixing device is placed in fluid communication with the outlet of each of the one or more fluid pumps, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more pressurized gas containers each having an outlet, wherein each outlet of the one or more pressurized gas containers is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more pressurized gas containers, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides a compressed gas foam system. The compressed gas foam system includes: one or more pressurized fluid containers each having an outlet, wherein each pressurized fluid container includes a pressurized fluid including one or more foam chemicals;

a first mixing device having an inlet and an outlet, wherein the first inlet of the first mixing device is placed in fluid communication with the outlet of each of the one or more pressurized fluid containers, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more pressurized gas containers each having an outlet, wherein each outlet of the one or more pressurized gas containers is placed in fluid communication with a gas control system including a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more pressurized gas containers, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller includes a programmable input, wherein the system controller is configured: to receive a sensed fluid flow rate from the fluid flow sensor, to receive a sensed fluid pressure from the fluid pressure sensor; to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

The present invention provides compressed gas foam systems and methods of suppressing fires using such systems. The compressed gas foam systems, as described herein, provide a stream of a chemical fire suppression agent surrounded by compressed gas foam that can extend over very long distances due to the high pressure of the compressed gas foam systems. The chemical fire suppression agent may be a powder or a second fluid such as an inert liquid or gas. As such, both two dimensional and three dimensional fires can be quickly and safely extinguished from a long distance.

The compressed gas foam systems, as described herein, are applicable to large office buildings, skyscrapers, coal mines, large ships (e.g., cruise ships, aircraft carriers, container ships), mountainous terrain with high elevations, long hose lays with high frictional losses, and conduits, hoses, or stand pipes with high frictional and/or pressure losses.

The compressed gas foam system, as described herein, operates at much higher pressures than existing compressed air foam systems. The higher operating pressures provide many advantages including, for example, the ability to extend the compressed gas foam systems to very high structures, very high elevations, very long hose lays that are beyond the range of the current compressed air foam systems, and the ability to reduce the size and cost of the compressed gas foam system plumbing by requiring smaller diameter plumbing.

The present invention provides a compressed gas foam system. The compressed gas foam system includes:

one or more optional fluid pumps each having an inlet and an outlet, wherein each inlet is placed in fluid communication with a fluid source;

an optional first mixing device having a first inlet, a second inlet, and an outlet, wherein the first inlet of the optional first mixing device is placed in fluid communication with the outlet of each of the one or more optional fluid pumps, wherein the second inlet of the optional first mixing device is placed in fluid communication with one or more optional foam systems, wherein the outlet of the first mixing system is placed in fluid communication with an optional fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the optional first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more optional gas compressors each having an inlet and an outlet, wherein each inlet of the one or more optional gas compressors is placed in fluid communication with the gas source, and wherein each outlet of the one or more optional gas compressors is placed in fluid communication with an optional gas control system including a gas flow sensor having an inlet and an outlet, a gas pressure sensor having an inlet and an outlet, and a first gas valve having an inlet and an outlet, wherein the inlet of the gas flow sensor is placed in fluid communication with each outlet of the one or more optional gas compressors, wherein the outlet of the gas flow sensor is placed in fluid communication with the inlet of the gas pressure sensor, wherein the outlet of the gas pressure sensor is placed in fluid communication with the inlet of the first gas valve, wherein the outlet of the first gas valve is placed in fluid communication with the second inlet of the second mixing device;

a chemical fire suppression agent reservoir having an inlet and an outlet, wherein the inlet of the chemical fire suppression agent reservoir is placed in fluid communication with an outlet of a second gas valve, wherein an inlet of the second gas valve is placed in fluid communication with an outlet of one or more optional gas compressors, wherein the outlet of the chemical fire suppression agent reservoir is placed in fluid communication with an optional chemical fire suppression agent control system including a chemical fire suppression agent flow sensor having an inlet and an outlet, a chemical fire suppression agent pressure sensor having an inlet and an outlet;

a chemical fire suppression agent valve having an inlet and an outlet, wherein the inlet of the chemical fire suppression agent flow sensor is placed in fluid communication with the outlet of the chemical fire suppression agent reservoir, wherein the outlet of the chemical fire suppression agent flow sensor is placed in fluid communication with the inlet of the chemical fire suppression agent pressure sensor, wherein the outlet of the chemical fire suppression agent pressure sensor is placed in fluid communication with the inlet of the chemical fire suppression agent valve, wherein the outlet of the chemical fire suppression agent valve is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device; and an optional system controller operatively coupled to the optional gas control system, the optional fluid control system, the second gas valve, the one or more optional foam systems, and the optional chemical fire suppression agent control system, wherein the optional system controller includes a programmable input, wherein the optional system controller is configured:

to receive a sensed fluid flow rate from the fluid flow sensor, to receive a sensed fluid pressure from the fluid pressure sensor;

to receive a sensed gas flow rate from the first gas flow sensor;

to receive a sensed gas pressure from the gas pressure sensor;

to receive a sensed chemical fire suppression agent flow rate from the chemical fire suppression agent flow sensor;

to receive a sensed chemical fire suppression agent pressure from the chemical fire suppression agent pressure sensor;

to output a first control signal to the fluid valve for regulating a fluid flow, a fluid pressure, or a combination thereof;

to output a second control signal to the first gas valve for regulating a gas flow relative to the sensed fluid flow, the sensed fluid pressure, or a combination thereof;

wherein the optional system controller automatically adjusts the first control signal and the second control signal to maintain a ratio of fluid flow to gas flow based upon the programmable input;

to output a third control signal to the second gas valve for regulating the flow of gas to from one or more optional gas compressors to pressurize the chemical fire suppression agent reservoir;

to output a fourth control signal to the chemical fire suppression agent valve for regulating the flow of a chemical fire suppression agent;

to output a fifth control signal to the one or more optional foam systems to control the output of the one or more optional foam systems;

provided that when the optional fluid control system is not present and the one or more optional foam systems are present, then the outlet of optional first mixing device is placed in fluid communication with the first inlet of the of the second mixing device, provided that when the optional gas control system is not present and the one or more optional gas compressors are present, then the outlet of the one or more optional gas compressors is placed in fluid communication with the second inlet of the second mixing device, provided that when the optional chemical fire suppression agent control system is not present, then the outlet of the chemical fire suppression agent reservoir is placed in fluid communication with the first inlet of the nozzle, provided that when the one or more optional fluid pumps are not present and the one or more optional foam systems are present, then the fluid source includes one or more fluids in one or more pressurized fluid containers that are placed in fluid communication with the first inlet of the optional first mixing device, provided that when the one or more optional gas compressors are not present, then the gas source includes one or more gases in one or more pressurized gas containers that are placed in fluid communication with the optional gas control system and the second valve, provided that when the one or more optional gas compressors are not present and the optional gas control system is also not present, then the gas source includes one or more gases in one or more pressurized gas containers that are placed in fluid communication with the second valve and the second inlet of the second mixing device.

provided that when the one or more optional foam systems are not present and the one or more optional fluid pumps are present, then the fluid source includes one or more foam chemicals, the optional first mixing device is not present, and the outlet of the one or more optional fluid pumps is placed in fluid communication with the first inlet of the second mixing device, provided that when the one or more optional foam systems and the one or more optional fluid pumps are not present, then the fluid source includes one or more foam chemicals in one or more pressurized fluid containers, the optional first mixing device is not present, and the outlet of the one or more pressurized fluid containers is placed in fluid communication with the first inlet of the second mixing device.

In one embodiment, the system controller includes a programmable microprocessor, a microcontroller, an application specific integrated circuit, a programmable logic array, or a combination thereof. In one embodiment, the compressed gas foam, the chemical fire suppression agent, or the combination thereof is discharged from the outlet of the nozzle at a pressure from about 25 pounds per square inch to about 500 pounds per square inch.

In one embodiment, the system further includes an outlet having an inlet and an outlet, wherein the inlet is placed in fluid communication with the outlet of the optional chemical fire suppression agent control system or the outlet of the chemical fire suppression agent reservoir if the optional chemical fire suppression agent control system is not present.

In one embodiment, each of the one or more optional fluid pumps is a single stage fluid pump, a multistage fluid pump, or a combination thereof. In one embodiment, each of the one or more optional fluid pumps is a single stage fluid pump. In one embodiment, each of the one or more optional fluid pumps is a multistage fluid pump. In one embodiment, if two or more optional fluid pumps are present, at least one of the fluid pumps is a single stage fluid pump and at least one of the fluid pumps is a multistage fluid pump.

In one embodiment, if two or more optional fluid pumps are present, the outlet of the first fluid pump is configured to pump fluid at a first fluid pressure and is coupled to the inlet of the second fluid pump and the outlet of the second fluid pump is configured to pump fluid at a second fluid pressure, wherein the second fluid pressure is greater than the first fluid pressure. In one embodiment, if two or more optional fluid pumps are present, the two or more optional fluid pumps are coupled in parallel.

In one embodiment, the first mixing device includes a t-joint, a motionless mixer, or a combination thereof. In one embodiment, the second mixing device includes a t-joint, a motionless mixer, or a combination thereof. In one embodiment, each of the one or more optional gas compressors is a single stage gas compressor, a multistage gas compressor, or a combination thereof.

In one embodiment, each of the one or more optional gas compressors is a single stage gas compressor. In one embodiment, each of the one or more optional gas compressors is a multistage gas compressor. In one embodiment, if two or more optional gas compressors are present, at least one of the gas compressors is a single stage gas compressor and at least one of the gas compressors is a multistage gas compressor.

In one embodiment, if two or more optional gas compressors are present, the outlet of the first gas compressor is configured to pump gas at a first gas pressure and is coupled to the inlet of the second gas compressor and the outlet of the second gas compressor is configured to pump gas at a second gas pressure, wherein the second gas pressure is greater than the first gas pressure. In one embodiment, if two or more optional gas compressors are present, the two or more optional gas compressors are coupled in parallel. In one embodiment, the one or more optional foam systems each independently comprise a bladder-type chemical foam system, or a combination thereof.

In one embodiment, if two or more optional foam systems are present, the outlet of the first foam system is configured to pump a foam solution at a first foam solution pressure and is coupled to the inlet of the second foam system and the outlet of the second foam system is configured to pump a foam solution at a second foam solution pressure, wherein the second foam solution pressure is greater than the first foam solution pressure.

In one embodiment, if two or more optional foam systems are present, the two or more optional foam systems are coupled in parallel. In one embodiment, each of the one or more optional fluid pumps, the one or more optional gas compressors, and the one or more optional foam systems is independently coupled with one or more power sources.

In one embodiment, the fluid is water. In one embodiment, the gas is air. In one embodiment, the gas is nitrogen, carbon dioxide, helium, neon, argon, or a combination thereof.

In one embodiment, the one or more optional fluid pumps are not present and the fluid source includes one or more fluids in one or more pressurized fluid containers. In one embodiment, the one or more optional gas compressors are not present and the gas source includes one or more gases in one or more pressurized gas containers. In one embodiment, if the one or more optional foam systems are not present, then the fluid source includes one or more foam chemicals. In one embodiment, if the one or more optional fluid pumps, the one or more optional gas compressors, and the one or more optional foam systems are not present, then the fluid source includes one or more fluids in one or more pressurized fluid containers, the gas source includes one or more gases in one or more pressurized gas containers, and the fluid source includes one or more foam chemicals.

In one embodiment, if the one or more optional fluid pumps and the one or more optional gas compressors are not present, then the fluid source includes one or more fluids in one or more pressurized fluid containers and the gas source includes one or more gases in one or more pressurized gas containers. In one embodiment, if the one or more optional fluid pumps and the one or more optional foam systems are not present, then the fluid source includes one or more fluids in one or more pressurized fluid containers and the fluid source includes one or more foam chemicals.

In one embodiment, if the one or more optional gas compressors and the one or more optional foam systems are not present, then the gas source includes one or more gases in one or more pressurized gas containers and the fluid source includes one or more foam chemicals. In one embodiment, the system further includes a pressurized gas cylinder placed in fluid communication with the chemical fire suppression agent reservoir. In one embodiment, the nozzle ejects a stream of chemical fire suppression agent surrounded by a stream of a first liquid.

In one embodiment, the flow path of the first liquid stream has the shape of a hollow cone and wherein the flow path of the chemical fire suppression agent stream lies within the hollow cone. In one embodiment, the first liquid includes a compressed gas foam. In one embodiment, the chemical fire suppression agent includes an inert gas at atmospheric conditions. In one embodiment, the inert gas includes carbon dioxide.

In one embodiment, the one or more optional foam systems each independently comprise a Class A foam system, a Class B foam system, or a combination thereof. In one embodiment, the chemical fire suppression agent is a powder. In one embodiment, the powder is sodium bicarbonate, potassium bicarbonate, sodium chloride, silicone powder, or a combination thereof.

The present invention also provides a method of suppressing or preventing a fire. The method includes:

providing a compressed gas foam system including:

one or more optional fluid pumps each having an inlet and an outlet, wherein each inlet is placed in fluid communication with a fluid source;

an optional first mixing device having a first inlet, a second inlet, and an outlet, wherein the first inlet of the optional first mixing device is placed in fluid communication with the outlet of each of the one or more optional fluid pumps, wherein the second inlet of the optional first mixing device is placed in fluid communication with one or more optional foam systems, wherein the outlet of the first mixing system is placed in fluid communication with an optional fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the optional first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more optional gas compressors each having an inlet and an outlet, wherein each inlet of the one or more optional gas compressors is placed in fluid communication with the gas source, and wherein each outlet of the one or more optional gas compressors is placed in fluid communication with an optional gas control system including a gas flow sensor having an inlet and an outlet, a gas pressure sensor having an inlet and an outlet, and a first gas valve having an inlet and an outlet, wherein the inlet of the gas flow sensor is placed in fluid communication with each outlet of the one or more optional gas compressors, wherein the outlet of the gas flow sensor is placed in fluid communication with the inlet of the gas pressure sensor, wherein the outlet of the gas pressure sensor is placed in fluid communication with the inlet of the first gas valve, wherein the outlet of the first gas valve is placed in fluid communication with the second inlet of the second mixing device;

a chemical fire suppression agent reservoir having an inlet and an outlet, wherein the inlet of the chemical fire suppression agent reservoir is placed in fluid communication with an outlet of a second gas valve, wherein an inlet of the second gas valve is placed in fluid communication with an outlet of one or more optional gas compressors, wherein the outlet of the chemical fire suppression agent reservoir is placed in fluid communication with an optional chemical fire suppression agent control system including a chemical fire suppression agent flow sensor having an inlet and an outlet, a chemical fire suppression agent pressure sensor having an inlet and an outlet;

a chemical fire suppression agent valve having an inlet and an outlet, wherein the inlet of the chemical fire suppression agent flow sensor is placed in fluid communication with the outlet of the chemical fire suppression agent reservoir, wherein the outlet of the chemical fire suppression agent flow sensor is placed in fluid communication with the inlet of the chemical fire suppression agent pressure sensor, wherein the outlet of the chemical fire suppression agent pressure sensor is placed in fluid communication with the inlet of the chemical fire suppression agent valve, wherein the outlet of the chemical fire suppression agent valve is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device; and an optional system controller operatively coupled to the optional gas control system, the optional fluid control system, the second gas valve, the one or more optional foam systems, and the optional chemical fire suppression agent control system, wherein the optional system controller includes a programmable input, wherein the optional system controller is configured:

to receive a sensed fluid flow rate from the fluid flow sensor, to receive a sensed fluid pressure from the fluid pressure sensor;

to receive a sensed gas flow rate from the first gas flow sensor;

to receive a sensed gas pressure from the gas pressure sensor;

to receive a sensed chemical fire suppression agent flow rate from the chemical fire suppression agent flow sensor;

to receive a sensed chemical fire suppression agent pressure from the chemical fire suppression agent pressure sensor;

to output a first control signal to the fluid valve for regulating a fluid flow, a fluid pressure, or a combination thereof;

to output a second control signal to the first gas valve for regulating a gas flow relative to the sensed fluid flow, the sensed fluid pressure, or a combination thereof;

wherein the optional system controller automatically adjusts the first control signal and the second control signal to maintain a ratio of fluid flow to gas flow based upon the programmable input;

to output a third control signal to the second gas valve for regulating the flow of gas to from one or more optional gas compressors to pressurize the chemical fire suppression agent reservoir;

to output a fourth control signal to the chemical fire suppression agent valve for regulating the flow of a chemical fire suppression agent;

to output a fifth control signal to the one or more optional foam systems to control the output of the one or more optional foam systems;

provided that when the optional fluid control system is not present and the one or more optional foam systems are present, then the outlet of optional first mixing device is placed in fluid communication with the first inlet of the of the second mixing device, provided that when the optional gas control system is not present and the one or more optional gas compressors are present, then the outlet of the one or more optional gas compressors is placed in fluid communication with the second inlet of the second mixing device, provided that when the optional chemical fire suppression agent control system is not present, then the outlet of the chemical fire suppression agent reservoir is placed in fluid communication with the first inlet of the nozzle, provided that when the one or more optional fluid pumps are not present and the one or more optional foam systems are present, then the fluid source includes one or more fluids in one or more pressurized fluid containers that are placed in fluid communication with the first inlet of the optional first mixing device, provided that when the one or more optional gas compressors are not present, then the gas source includes one or more gases in one or more pressurized gas containers that are placed in fluid communication with the optional gas control system and the second valve, provided that when the one or more optional gas compressors are not present and the optional gas control system is also not present, then the gas source includes one or more gases in one or more pressurized gas containers that are placed in fluid communication with the second valve and the second inlet of the second mixing device.

provided that when the one or more optional foam systems are not present and the one or more optional fluid pumps are present, then the fluid source includes one or more foam chemicals, the optional first mixing device is not present, and the outlet of the one or more optional fluid pumps is placed in fluid communication with the first inlet of the second mixing device, provided that when the one or more optional foam systems and the one or more optional fluid pumps are not present, then the fluid source includes one or more foam chemicals in one or more pressurized fluid containers, the optional first mixing device is not present, and the outlet of the one or more pressurized fluid containers is placed in fluid communication with the first inlet of the second mixing device;

flowing a fluid through a flow path through the compressed gas foam system;

mixing the fluid from one of the one or more optional fluid pumps and a foam chemical in the first mixing device or from one of the pressurized fluid containers to produce a fluid and foam chemical mixture;

mixing gas from one or more optional gas compressors or from one of the pressurized gas containers into the fluid and foam chemical mixture in the second mixing device to generate a compressed gas foam; and directing the compressed gas foam and the chemical fire suppression agent in the nozzle to the fire.

The present invention provides a compressed gas foam system. The compressed gas foam system includes:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system including a gas flow sensor having an inlet and an outlet, a gas pressure sensor having an inlet and an outlet, and a first gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the first gas valve, wherein the outlet of the first gas valve is placed in fluid communication with the second inlet of the second mixing device;

a chemical fire suppression agent reservoir having an inlet and an outlet, wherein the inlet of the chemical fire suppression agent reservoir is placed in fluid communication with an outlet of a second gas valve, wherein an inlet of the second gas valve is placed in fluid communication with an outlet of one or more gas compressors, wherein the outlet of the chemical fire suppression agent reservoir is placed in fluid communication with an chemical fire suppression agent control system including a chemical fire suppression agent flow sensor having an inlet and an outlet, a chemical fire suppression agent pressure sensor having an inlet and an outlet;

a chemical fire suppression agent valve having an inlet and an outlet, wherein the inlet of the chemical fire suppression agent flow sensor is placed in fluid communication with the outlet of the chemical fire suppression agent reservoir, wherein the outlet of the chemical fire suppression agent flow sensor is placed in fluid communication with the inlet of the chemical fire suppression agent pressure sensor, wherein the outlet of the chemical fire suppression agent pressure sensor is placed in fluid communication with the inlet of the chemical fire suppression agent valve, wherein the outlet of the chemical fire suppression agent valve is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device; and an system controller operatively coupled to the gas control system, the fluid control system, the second gas valve, the one or more optional foam systems, and the chemical fire suppression agent control system, wherein the system controller includes a programmable input, wherein the system controller is configured:

to receive a sensed fluid flow rate from the fluid flow sensor, to receive a sensed fluid pressure from the fluid pressure sensor;

to receive a sensed gas flow rate from the first gas flow sensor;

to receive a sensed gas pressure from the gas pressure sensor;

to receive a sensed chemical fire suppression agent flow rate from the chemical fire suppression agent flow sensor;

to receive a sensed chemical fire suppression agent pressure from the chemical fire suppression agent pressure sensor;

to output a first control signal to the fluid valve for regulating a fluid flow, a fluid pressure, or a combination thereof;

to output a second control signal to the first gas valve for regulating a gas flow relative to the sensed fluid flow, the sensed fluid pressure, or a combination thereof;

wherein the system controller automatically adjusts the first control signal and the second control signal to maintain a ratio of fluid flow to gas flow based upon the programmable input;

to output a third control signal to the second gas valve for regulating the flow of gas to from one or more gas compressors to pressurize the chemical fire suppression agent reservoir;

to output a fourth control signal to the chemical fire suppression agent valve for regulating the flow of a chemical fire suppression agent; and to output a fifth control signal to the one or more foam systems to control the output of the one or more foam systems.

The present invention also provides a method of suppressing or preventing a fire. The method includes:

providing a compressed gas foam system including:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a fluid control system including a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system including a gas flow sensor having an inlet and an outlet, a gas pressure sensor having an inlet and an outlet, and a first gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the first gas valve, wherein the outlet of the first gas valve is placed in fluid communication with the second inlet of the second mixing device;

a chemical fire suppression agent reservoir having an inlet and an outlet, wherein the inlet of the chemical fire suppression agent reservoir is placed in fluid communication with an outlet of a second gas valve, wherein an inlet of the second gas valve is placed in fluid communication with an outlet of one or more gas compressors, wherein the outlet of the chemical fire suppression agent reservoir is placed in fluid communication with an chemical fire suppression agent control system including a chemical fire suppression agent flow sensor having an inlet and an outlet, a chemical fire suppression agent pressure sensor having an inlet and an outlet;

a chemical fire suppression agent valve having an inlet and an outlet, wherein the inlet of the chemical fire suppression agent flow sensor is placed in fluid communication with the outlet of the chemical fire suppression agent reservoir, wherein the outlet of the chemical fire suppression agent flow sensor is placed in fluid communication with the inlet of the chemical fire suppression agent pressure sensor, wherein the outlet of the chemical fire suppression agent pressure sensor is placed in fluid communication with the inlet of the chemical fire suppression agent valve, wherein the outlet of the chemical fire suppression agent valve is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device; and an system controller operatively coupled to the gas control system, the fluid control system, the second gas valve, the one or more foam systems, and the chemical fire suppression agent control system, wherein the system controller includes a programmable input, wherein the system controller is configured:

to receive a sensed fluid flow rate from the fluid flow sensor, to receive a sensed fluid pressure from the fluid pressure sensor;

to receive a sensed gas flow rate from the first gas flow sensor;

to receive a sensed gas pressure from the gas pressure sensor;

to receive a sensed chemical fire suppression agent flow rate from the chemical fire suppression agent flow sensor;

to receive a sensed chemical fire suppression agent pressure from the chemical fire suppression agent pressure sensor;

to output a first control signal to the fluid valve for regulating a fluid flow, a fluid pressure, or a combination thereof;

to output a second control signal to the first gas valve for regulating a gas flow relative to the sensed fluid flow, the sensed fluid pressure, or a combination thereof;

wherein the system controller automatically adjusts the first control signal and the second control signal to maintain a ratio of fluid flow to gas flow based upon the programmable input;

to output a third control signal to the second gas valve for regulating the flow of gas to from one or more gas compressors to pressurize the chemical fire suppression agent reservoir;

to output a fourth control signal to the chemical fire suppression agent valve for regulating the flow of a chemical fire suppression agent; and to output a fifth control signal to the one or more foam systems to control the output of the one or more foam systems;

flowing a fluid through a flow path through the compressed gas foam system;

mixing the fluid from one of the one or more fluid pumps and a foam chemical in the first mixing device to produce a fluid and foam chemical mixture;

mixing gas from one or more gas compressors into the fluid and foam chemical mixture in the second mixing device to generate a compressed gas foam; and directing the compressed gas foam and the chemical fire suppression agent in the nozzle to the fire.

The present invention provides a compressed gas foam system. The compressed gas foam system includes:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a first inlet of a second mixing device having a first inlet, a second inlet, and an outlet;

one or more gas compressors each having an inlet and an outlet, wherein each inlet of the one or more gas compressors is placed in fluid communication with a gas source, and wherein each outlet of the one or more gas compressors is placed in fluid communication with the second inlet of the second mixing device and the inlet of a gas valve having an inlet and an outlet;

a chemical fire suppression agent reservoir having an inlet and an outlet, wherein the inlet of the chemical fire suppression agent reservoir is placed in fluid communication with an outlet of a gas valve, wherein the outlet of the chemical fire suppression agent reservoir is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device.

The present invention also provides a method of suppressing or preventing a fire. The method includes:

providing a compressed gas foam system including:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a first inlet of a second mixing device having a first inlet, a second inlet, and an outlet;

one or more gas compressors each having an inlet and an outlet, wherein each inlet of the one or more gas compressors is placed in fluid communication with a gas source, and wherein each outlet of the one or more gas compressors is placed in fluid communication with the second inlet of the second mixing device and the inlet of a gas valve having an inlet and an outlet;

a chemical fire suppression agent reservoir having an inlet and an outlet, wherein the inlet of the chemical fire suppression agent reservoir is placed in fluid communication with an outlet of a gas valve, wherein the outlet of the chemical fire suppression agent reservoir is placed in fluid communication with a first inlet of the nozzle having a first inlet, a second inlet, and an outlet, wherein the nozzle includes a liquid and chemical fire suppression agent nozzle for fire extinction, wherein the second inlet of the nozzle is placed in fluid communication with the outlet of the second mixing device;

flowing a fluid through a flow path through the compressed gas foam system;

mixing the fluid from one of the one or more fluid pumps and a foam chemical in the first mixing device to produce a fluid and foam chemical mixture;

mixing gas from one or more gas compressors into the fluid and foam chemical mixture in the second mixing device to generate a compressed gas foam; and directing the compressed gas foam and the chemical fire suppression agent in the nozzle to the fire.

BRIEF DESCRIPTION OF THE DRAWINGS

Embodiments of the invention may be best understood by referring to the following description and accompanying drawings, which illustrate such embodiments. In the drawings.

Figure 1:
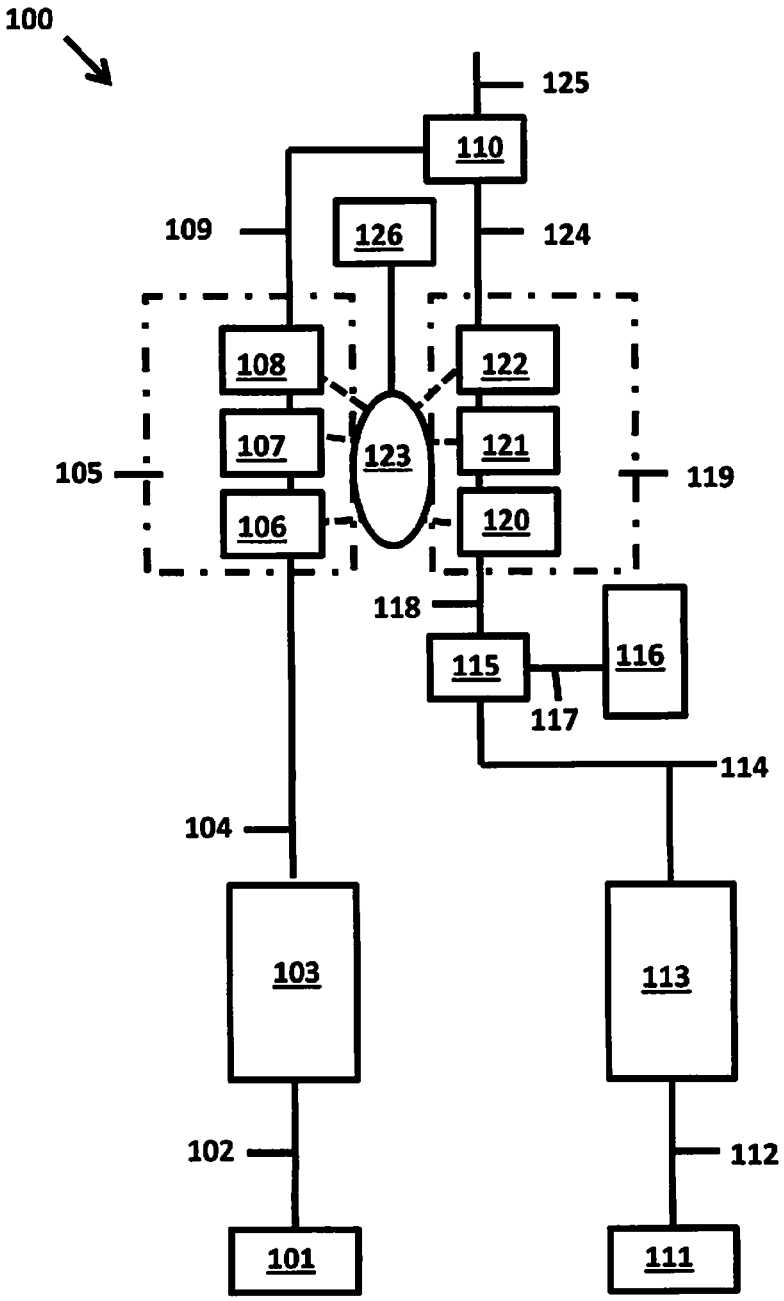
FIG. 1 is a block diagram illustrating an exemplary compressed gas foam system.

The drawings are not necessarily to scale. Like numbers used in the figures refer to like components, steps and the like. However, it will be understood that the use of a number to refer to a component in a given figure is not intended to limit the component in another figure labeled with the same number.

DETAILED DESCRIPTION OF THE INVENTION

The compressed gas foam systems, as described herein, are applicable to large office buildings, skyscrapers, coal mines, large ships (e.g., cruise ships, aircraft carriers, container ships), mountainous terrain with high elevations, long hose lays with high frictional losses, and conduits, hoses, or stand pipes with high frictional and/or pressure losses.

The compressed gas foam system, as described herein, operates at much higher pressures than existing compressed air foam systems. The higher operating pressures provide many advantages including, for example, the ability to extend the compressed gas foam systems to very high structures, very high elevations, very long hose lays that are beyond the range of the current compressed air foam systems, and the ability to reduce the size and cost of the compressed gas foam system plumbing by requiring smaller diameter plumbing.

The compressed gas foam systems, as described herein, are designed to convey compressed gas foam into a tall structure and provide adequate firefighting pressures. Typically, firefighting pressures for a compressed gas foam system should be about 125 pounds per square inch (psi). Typically, the weight of water or head pressure is about 5 psi per story or about 10 feet per floor. The actual number is 4.3 psi per story for fresh water with salt water being slightly heavier. But, for ease of discussion, about 5 psi per story will be used. Thus, water normal pressure required to give 125 psi performance in a fifty story building would be about 375 psi (i.e., (50 stories×5 psi/story)+125 psi=375 psi). With a compressed air foam system, the water is expanded in volume by about ten times. Therefore, the weight or head pressure is reduced by one-tenth (1/10) to about 25 psi for a 50 story building. Thus, the compressed air foam system for a fifty story building would operate at a pressure of 150 psi (i.e., (50 stories×5 psi/story)/10+125=150 psi). In a similar fashion, a compressed air foam system of a one hundred story building would require a minimum pressure of 175 psi (i.e., (100 stories×5 psi/story)/10+125=175 psi).

To achieve the very high pressures required, for example, in very tall skyscrapers and other extreme applications, the present invention utilizes single stage fluid pumps in series, single stage fluid pumps in parallel, multi-stage fluid pumps in series, multi-stage fluid pumps in parallel, single and multi-stage fluid pumps in series, single and multi-stage fluid pumps in parallel, single stage gas compressors in series, single stage gas compressors in parallel, multi-stage gas compressors in series, multi-stage gas compressors in parallel, single and multi-stage gas compressors in series, single and multi-stage gas compressors in parallel, single stage foam systems in series, single stage foam systems in parallel, multi-stage foam systems in series, multi-stage foam systems in parallel, single and multi-stage foam systems in series, single and multi-stage foam systems in parallel, or combinations thereof.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "compressed air foam system" or "CAFS" refer to is a system used in firefighting to deliver fire retardant foam for the purpose of extinguishing a fire or protecting unburned areas from becoming involved in a fire.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "foam chemical" refers to any chemical (e.g., solid, liquid, or gas) that may be used to produce foam.

As used herein, the terms "include," "for example," "such as," and the like are used illustratively and are not intended to limit the present invention.

As used herein, the term "motionless mixer" refers to any device that can create turbulence in one or more fluid streams that result in mixing of the one or more fluid streams.

As used herein, the term "suppressing or preventing a fire" refers to controlling, extinguishing, or preventing a fire. In one embodiment, the compressed gas foam systems, as described herein, are useful for protecting unburned areas from becoming involved in a fire.

FIG. 1 is a block diagram illustrating an exemplary compressed gas foam system 100. The compressed gas foam system 100 includes a gas source 101 coupled to conduit 102, which provides fluid communication between the gas source 101 and the gas compressor 103.

In one embodiment, the gas compressor 103 is a single stage gas compressor. In another embodiment, the gas compressor 103 is a multistage gas compressor. In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 103 is coupled to conduit 104, which provides fluid communication between the gas compressor 103 and the gas control system 105. The gas control system 105 includes the gas flow sensor 106, the gas pressure sensor 107, and the gas valve 108. The gas flow sensor 106 is in fluid communication with the gas pressure sensor 107, which in turn is in fluid communication with the gas valve 108. The gas valve 108 is coupled to conduit 109, which provides fluid communication between the gas valve 108 and the first mixing device 110.

The compressed gas foam system 100 also includes a fluid source 111 coupled to conduit 112, which provides fluid communication between the fluid source 111 and a fluid pump 113.

In one embodiment, the fluid pump 113 is a single stage fluid pump. In another embodiment, the fluid pump 113 is a multistage fluid pump.

Fluid pump 113 is coupled to conduit 114, which provides fluid communication between fluid pump 113 and the second mixing device 115. The second mixing device 115 mixes the fluid from the fluid pump 113 with a chemical foam mixture received from the foam system 116 via the conduit 117.

In one embodiment, the fluid is water. In another embodiment, the foam system 116 is a single stage foam system. In yet another embodiment, the foam system 116 is a multistage foam system.

The second mixing device 115 is coupled to conduit 118, which provides fluid communication between the second mixing device 115 and the fluid control system 119. The fluid control system 119 includes the fluid flow sensor 120, the fluid pressure sensor 121, and the fluid valve 122. The fluid flow sensor 120 is in fluid communication with the fluid pressure sensor 121, which in turn is in fluid communication with the fluid valve 122. The fluid valve 122 is coupled to conduit 124, which provides fluid communication between the fluid valve 122 and the first mixing device 110.

The first mixing device 110 combines the gas received from the gas compressor 103 with the mixture of fluid and chemical foam to produce compressed gas foam. The first mixing device 110 is coupled to conduit 125, which provides fluid communication between the first mixing device 110 and an optional pressure regulator (not shown).

The components of the gas control system 105, for example, the gas flow sensor 106, the gas pressure sensor 107, and the gas valve 108, are each independently coupled to send and receive signals from the system controller 123. In a similar fashion, the components of the fluid control system 119, for example, the fluid flow sensor 120, the fluid pressure sensor 121, and the fluid valve 122 are each independently coupled to send and receive signals from the system controller 123. In this manner, the system controller 123 controls the ratio of gas to fluid by varying the flow of gas through the gas valve 108 and the flow of fluid through fluid valve 122.

The operator control panel and display 126 receives and sends system status information from the system controller 123. The system operator, for example, a fire truck engineer, can set controls manually with hand-operated valves and levers, or enters commands by way of the operator control panel and display 126. In one embodiment, the operator control panel and display 126 includes mechanical switches and digital displays. In another embodiment, the operator control panel and display 126 includes a touch screen display. Touch screen displays are well known in the art and are electronic visual displays that can detect the presence and location of a touch within the display area. In another embodiment, the operator control panel and display 126 includes an electronic visual display that can detect the presence of a light pen. These displays are also well known in the art.

Figure 2:
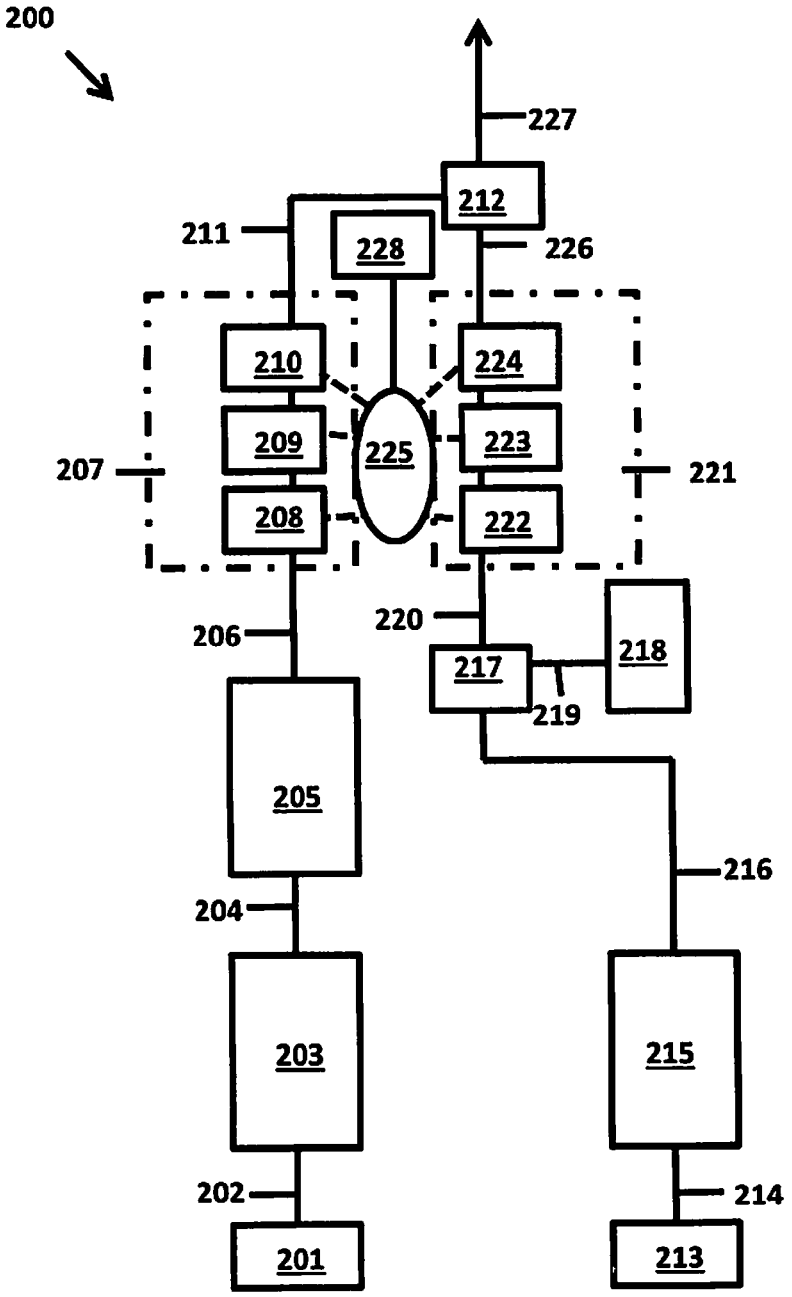
FIG. 2 is a block diagram illustrating an exemplary compressed gas foam system.

FIG. 2 is a block diagram illustrating an exemplary compressed gas foam system 200. The compressed gas foam system 200 includes a gas source 201 coupled to conduit 202, which provides fluid communication between the gas source 201 and the gas compressor 203. The gas compressor 203 is coupled to conduit 204, which provides fluid communication between the gas compressor 203 and the gas compressor 205.

In one embodiment, the gas compressors 203 and 205 are both single stage gas compressors. In another embodiment, the gas compressors 203 and 205 are both multistage gas compressors. In yet another embodiment, one of gas compressors 203 and 205 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 205 is coupled to conduit 206, which provides fluid communication between the gas compressor 205 and the gas control system 207. The gas control system 207 includes the gas flow sensor 208, the gas pressure sensor 209, and the gas valve 210. The gas flow sensor 208 is in fluid communication with the gas pressure sensor 209, which in turn is in fluid communication with the gas valve 210. The gas valve 210 is coupled to conduit 211, which provides fluid communication between the gas valve 210 and the first mixing device 212.

The compressed gas foam system 200 also includes a fluid source 213 coupled to conduit 214, which provides fluid communication between the fluid source 213 and a fluid pump 215.

In one embodiment, the fluid pump 215 is a single stage fluid pump. In another embodiment, the fluid pump 215 is a multistage fluid pump.

Fluid pump 215 is coupled to conduit 216, which provides fluid communication between fluid pump 215 and the second mixing device 217. The second mixing device 217 mixes the fluid from the fluid pump 215 with a chemical foam mixture received from the foam system 218 via the conduit 219.

In one embodiment, the fluid is water. In another embodiment, the foam system 218 is a single stage foam system. In yet another embodiment, the foam system 218 is a multistage foam system.

The second mixing device 217 is coupled to conduit 220, which provides fluid communication between the second mixing device 217 and the fluid control system 221. The fluid control system 221 includes the fluid flow sensor 222, the fluid pressure sensor 223, and the fluid valve 224. The fluid flow sensor 222 is in fluid communication with the fluid pressure sensor 223, which in turn is in fluid communication with the fluid valve 224. The fluid valve 224 is coupled to conduit 226, which provides fluid communication between the fluid valve 224 and the first mixing device 212.

The first mixing device 212 combines the gas received from the gas compressor 205 with the mixture of fluid and chemical foam to produce compressed gas foam. The first mixing device 212 is coupled to conduit 227, which provides fluid communication between the first mixing device 212 and an optional pressure regulator (not shown).

The components of the gas control system 207, for example, the gas flow sensor 208, the gas pressure sensor 209, and the gas valve 210, are each independently coupled to send and receive signals from the system controller 225. In a similar fashion, the components of the fluid control system 221, for example, the fluid flow sensor 222, the fluid pressure sensor 223, and the fluid valve 224 are each independently coupled to send and receive signals from the system controller 225. In this manner, the system controller 225 controls the ratio of gas to fluid by varying the flow of gas through the gas valve 210 and the flow of fluid through fluid valve 224.

The operator control panel and display 228 receives and sends system status information from the system controller 225. The system operator, for example, a fire truck engineer, can set controls manually with hand-operated valves and levers, or enters commands by way of the operator control panel and display 228. In one embodiment, the operator control panel and display 228 includes mechanical switches and digital displays. In another embodiment, the operator control panel and display 228 includes a touch screen display. Touch screen displays are well known in the art and are electronic visual displays that can detect the presence and location of a touch within the display area. In another embodiment, the operator control panel and display 228 includes an electronic visual display that can detect the presence of a light pen. These displays are also well known in the art.

Figure 3:
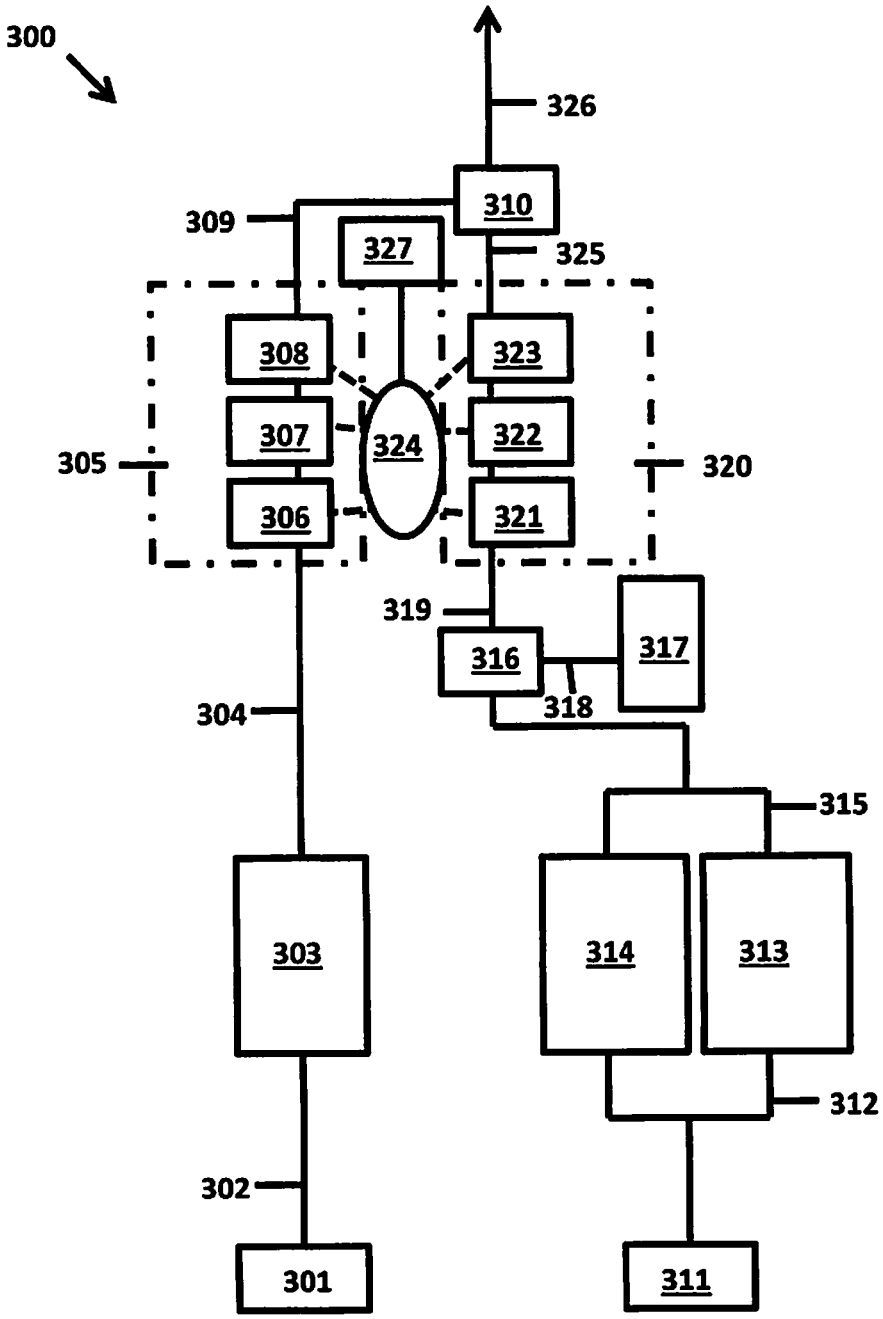
FIG. 3 is a block diagram illustrating an exemplary compressed gas foam system.

FIG. 3 is a block diagram illustrating an exemplary compressed gas foam system 300. The compressed gas foam system 300 includes a gas source 301 coupled to conduit 302, which provides fluid communication between the gas source 301 and the gas compressor 303. The gas compressor 303 is coupled to conduit 304, which provides fluid communication between the gas compressor 303 and the gas control system 305. The gas control system 305 includes the gas flow sensor 306, the gas pressure sensor 307, and the gas valve 308. The gas flow sensor 306 is in fluid communication with the gas pressure sensor 307, which in turn is in fluid communication with the gas valve 308. The gas valve 308 is coupled to conduit 309, which provides fluid communication between the gas valve 308 and the first mixing device 310.

In one embodiment, the gas compressor 303 is a single stage gas compressor. In another embodiment, the gas compressor 303 is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 300 also includes a fluid source 311 coupled to conduit 312, which provides fluid communication between the fluid source 311 and the fluid pumps 313 and 314.

In one embodiment, the fluid pumps 313 and 314 are both single stage fluid pumps. In another embodiment, the fluid pumps 313 and 314 are both multistage fluid pumps. In one embodiment, fluid pump 313 is a single stage fluid pump and fluid pump 314 is a multistage fluid pump. In one embodiment, fluid pump 313 is a multi-stage fluid pump and fluid pump 314 is a single stage fluid pump.

The fluid pumps 313 and 314 are coupled to conduit 315, which provides fluid communication between fluid pumps 313 and 314 and the second mixing device 316. The second mixing device 316 mixes the fluid from the fluid pumps 313 and 314 with a chemical foam mixture received from the foam system 317 via the conduit 318.

In one embodiment, the fluid is water. In another embodiment, the foam system 317 is a single stage foam system. In yet another embodiment, the foam system 317 is a multistage foam system.

The second mixing device 316 is coupled to conduit 319, which provides fluid communication between the second mixing device 316 and the fluid control system 320. The fluid control system 320 includes the fluid flow sensor 321, the fluid pressure sensor 322, and the fluid valve 323. The fluid flow sensor 321 is in fluid communication with the fluid pressure sensor 322, which in turn is in fluid communication with the fluid valve 323. The fluid valve 323 is coupled to conduit 325, which provides fluid communication between the fluid valve 323 and the first mixing device 310.

The first mixing device 310 combines the gas received from the gas compressor 303 with the mixture of fluid and chemical foam to produce compressed gas foam. The first mixing device 310 is coupled to conduit 326, which provides fluid communication between the first mixing device 310 and an optional pressure regulator (not shown).

The components of the gas control system 305, for example, the gas flow sensor 306, the gas pressure sensor 307, and the gas valve 308, are each independently coupled to send and receive signals from the system controller 324. In a similar fashion, the components of the fluid control system 320, for example, the fluid flow sensor 321, the fluid pressure sensor 322, and the fluid valve 323 are each independently coupled to send and receive signals from the system controller 324. In this manner, the system controller 324 controls the ratio of gas to fluid by varying the flow of gas through the gas valve 308 and the flow of fluid through fluid valve 323.

The operator control panel and display 327 receives and sends system status information from the system controller 324. The system operator, for example, a fire truck engineer, can set controls manually with hand-operated valves and levers, or enters commands by way of the operator control panel and display 327. In one embodiment, the operator control panel and display 327 includes mechanical switches and digital displays. In another embodiment, the operator control panel and display 327 includes a touch screen display. Touch screen displays are well known in the art and are electronic visual displays that can detect the presence and location of a touch within the display area. In another embodiment, the operator control panel and display 327 includes an electronic visual display that can detect the presence of a light pen. These displays are also well known in the art.

Figure 4:
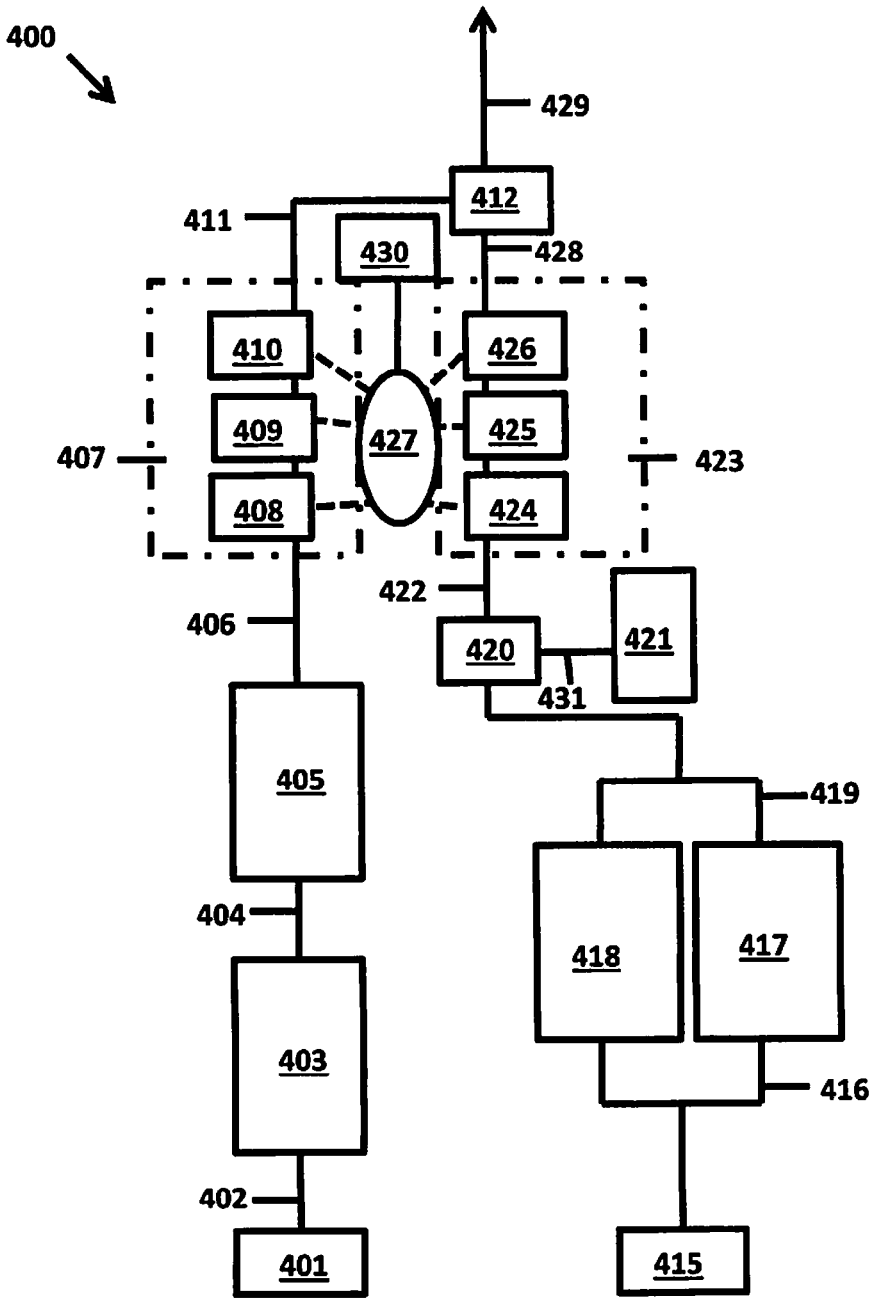
FIG. 4 is a block diagram illustrating an exemplary compressed gas foam system.

FIG. 4 is a block diagram illustrating an exemplary compressed gas foam system 400. The compressed gas foam system 400 includes a gas source 401 coupled to conduit 402, which provides fluid communication between the gas source 401 and the gas compressor 403. The gas compressor 403 is coupled to conduit 404, which provides fluid communication between the gas compressor 403 and the gas compressor 405.

In one embodiment, the gas compressors 403 and 405 are both single stage gas compressors. In another embodiment, the gas compressors 403 and 405 are both multistage gas compressors. In yet another embodiment, one of gas compressors 403 and 405 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 405 is coupled to conduit 406, which provides fluid communication between the gas compressor 405 and gas control system 407. The gas control system 407 includes the gas flow sensor 408, the gas pressure sensor 409, and the gas valve 410. The gas flow sensor 408 is in fluid communication with the gas pressure sensor 409, which in turn is in fluid communication with the gas valve 410. The gas valve 410 is coupled to conduit 411, which provides fluid communication between the gas valve 410 and the first mixing device 412.

The compressed gas foam system 400 also includes a fluid source 415, which is coupled to conduit 416, both of which provide fluid communication between the fluid source 415 and the fluid pumps 417 and 418.

In one embodiment, the fluid pumps 417 and 418 are both single stage fluid pumps. In another embodiment, the fluid pumps 417 and 418 are both multistage fluid pumps. In one embodiment, fluid pump 417 is a single stage fluid pump and fluid pump 418 is a multistage fluid pump. In one embodiment, fluid pump 417 is a multi-stage fluid pump and fluid pump 418 is a single stage fluid pump.

The fluid pumps 417 and 418 are coupled to conduit 419, which provides fluid communication between fluid pumps 417 and 418 and the second mixing device 420. The second mixing device 420 mixes the fluid from the fluid pumps 417 and 418 with a chemical foam mixture received from the foam system 421 via the conduit 431.

In one embodiment, the fluid is water. In another embodiment, the foam system 421 is a single stage foam system. In yet another embodiment, the foam system 421 is a multistage foam system.

The second mixing device 420 is coupled to conduit 422, which provides fluid communication between the second mixing device 420 and the fluid control system 423. The fluid control system 423 includes the fluid flow sensor 424, the fluid pressure sensor 425, and the fluid valve 426. The fluid flow sensor 424 is in fluid communication with the fluid pressure sensor 425, which in turn is in fluid communication with the fluid valve 426. The fluid valve 426 is coupled to conduit 428, which provides fluid communication between the fluid valve 426 and the first mixing device 412.

The first mixing device 412 combines the gas received from the gas compressor 405 with the mixture of fluid and chemical foam to produce compressed gas foam. The first mixing device 412 is coupled to conduit 429, which provides fluid communication between the first mixing device 412 and an optional pressure regulator (not shown).

The components of the gas control system 407, for example, the gas flow sensor 408, the gas pressure sensor 409, and the gas valve 410, are each independently coupled to send and receive signals from the system controller 427. In a similar fashion, the components of the fluid control system 423, for example, the fluid flow sensor 424, the fluid pressure sensor 425, and the fluid valve 426 are each independently coupled to send and receive signals from the system controller 427. In this manner, the system controller 427 controls the ratio of gas to fluid by varying the flow of gas through the gas valve 410 and the flow of fluid through fluid valve 426.

The operator control panel and display 430 receives and sends system status information from the system controller 427. The system operator, for example, a fire truck engineer, can set controls manually with hand-operated valves and levers, or enters commands by way of the operator control panel and display 430. In one embodiment, the operator control panel and display 430 includes mechanical switches and digital displays. In another embodiment, the operator control panel and display 430 includes a touch screen display. Touch screen displays are well known in the art and are electronic visual displays that can detect the presence and location of a touch within the display area. In another embodiment, the operator control panel and display 430 includes an electronic visual display that can detect the presence of a light pen. These displays are also well known in the art.

Figure 5:
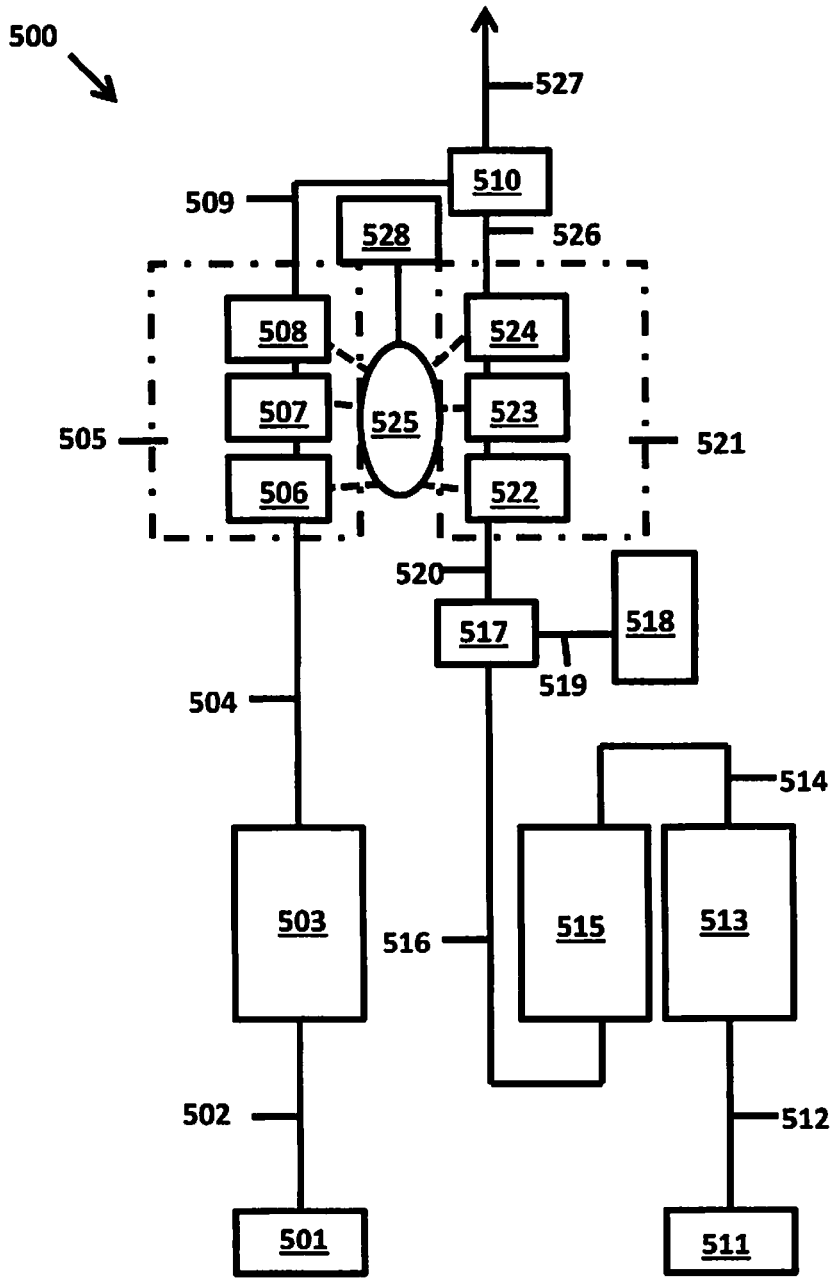
FIG. 5 is a block diagram illustrating an exemplary compressed gas foam system.

FIG. 5 is a block diagram illustrating an exemplary compressed gas foam system 500. The compressed gas foam system 500 includes a gas source 501 coupled to conduit 502, which provides fluid communication between the gas source 501 and the gas compressor 503. The gas compressor 503 is coupled to conduit 504, which provides fluid communication between the gas compressor 503 and the gas control system 505. The gas control system 505 includes the gas flow sensor 506, the gas pressure sensor 507, and the gas valve 508. The gas flow sensor 506 is in fluid communication with the gas pressure sensor 507, which in turn is in fluid communication with the gas valve 508. The gas valve 508 is coupled to conduit 509, which provides fluid communication between the gas valve 508 and the first mixing device 510.

In one embodiment, the gas compressor 503 is a single stage gas compressor. In another embodiment, the gas compressor 503 is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 500 also includes a fluid source 511 coupled to conduit 512, which provides fluid communication between the fluid source 511 and a fluid pump 513.

Fluid pump 513 is coupled to conduit 514, which provided fluid communication between fluid pump 513 and fluid pump 515.

In one embodiment, fluid pump 513 and fluid pump 515 are both single stage fluid pumps. In another embodiment, fluid pump 513 and fluid pump 515 are both multistage fluid pumps.

In one embodiment, fluid pump 513 is a single stage fluid pump and fluid pump 515 is a multistage fluid pump. In another embodiment, fluid pump 513 is a multistage fluid pump and fluid pump 515 is a single stage fluid pump.

Fluid pump 515 is coupled to conduit 516, which provides fluid communication between fluid pump 515 and the second mixing device 517. The second mixing device 517 mixes the fluid from the fluid pump 515 with a chemical foam mixture received from the foam system 518 via the conduit 519.

In one embodiment, the fluid is water. In another embodiment, the foam system 518 is a single stage foam system. In yet another embodiment, the foam system 518 is a multistage foam system.

The second mixing device 517 is coupled to conduit 520, which provides fluid communication between the second mixing device 517 and the fluid control system 521. The fluid control system 521 includes the fluid flow sensor 522, the fluid pressure sensor 523, and the fluid valve 524. The fluid flow sensor 522 is in fluid communication with the fluid pressure sensor 523, which in turn is in fluid communication with the fluid valve 524. The fluid valve 524 is coupled to conduit 526, which provides fluid communication between the fluid valve 524 and the first mixing device 510.

The first mixing device 510 combines the gas received from the gas compressor 503 with the mixture of fluid and chemical foam to produce compressed gas foam. The first mixing device 510 is coupled to conduit 527, which provides fluid communication between the first mixing device 510 and an optional pressure regulator (not shown).

The components of the gas control system 505, for example, the gas flow sensor 506, the gas pressure sensor 507, and the gas valve 508, are each independently coupled to send and receive signals from the system controller 525. In a similar fashion, the components of the fluid control system 521, for example, the fluid flow sensor 522, the fluid pressure sensor 523, and the fluid valve 524 are each independently coupled to send and receive signals from the system controller 525. In this manner, the system controller 525 controls the ratio of gas to fluid by varying the flow of gas through the gas valve 508 and the flow of fluid through fluid valve 524.

The operator control panel and display 528 receives and sends system status information from the system controller 525. The system operator, for example, a fire truck engineer, can set controls manually with hand-operated valves and levers, or enters commands by way of the operator control panel and display 528. In one embodiment, the operator control panel and display 528 includes mechanical switches and digital displays. In another embodiment, the operator control panel and display 528 includes a touch screen display. Touch screen displays are well known in the art and are electronic visual displays that can detect the presence and location of a touch within the display area. In another embodiment, the operator control panel and display 528 includes an electronic visual display that can detect the presence of a light pen. These displays are also well known in the art.

Figure 6:
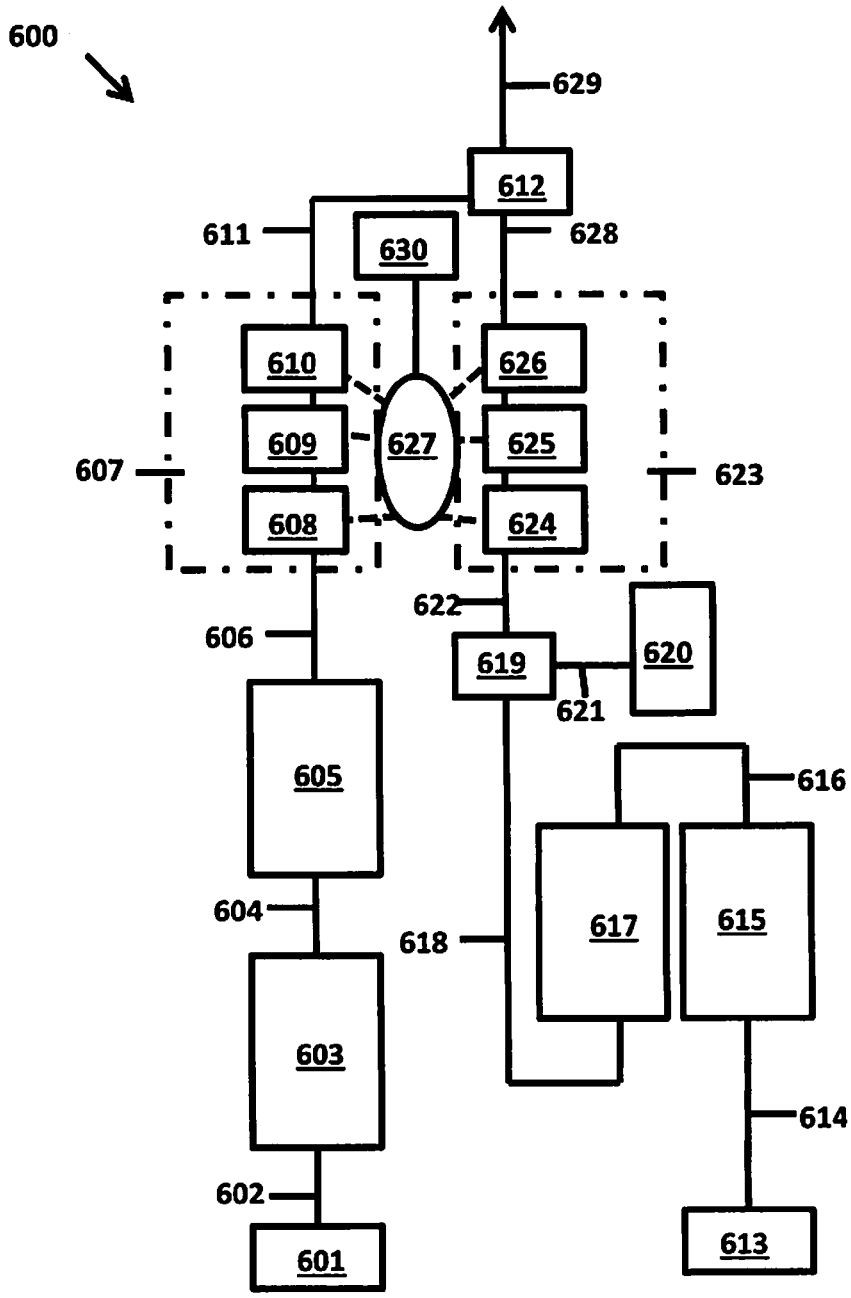
FIG. 6 is a block diagram illustrating an exemplary compressed gas foam system.

FIG. 6 is a block diagram illustrating an exemplary compressed gas foam system 600. The compressed gas foam system 600 includes a gas source 601 coupled to conduit 602, which provides fluid communication between the gas source 601 and the gas compressor 603. The gas compressor 603 is coupled to conduit 604, which provides fluid communication between the gas compressor 603 and the gas compressor 605.

In one embodiment, the gas compressors 603 and 605 are both single stage gas compressors. In another embodiment, the gas compressors 603 and 605 are both multistage gas compressors. In yet another embodiment, one of gas compressors 603 and 605 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 605 is coupled to conduit 606, which provides fluid communication between the gas compressor 605 and the gas control system 607. The gas control system 607 includes the gas flow sensor 608, the gas pressure sensor 609, and the gas valve 610. The gas flow sensor 608 is in fluid communication with the gas pressure sensor 609, which in turn is in fluid communication with the gas valve 610. The gas valve 610 is coupled to conduit 611, which provides fluid communication between the gas valve 610 and the first mixing device 612.

The compressed gas foam system 600 also includes a fluid source 613 coupled to conduit 614, which provides fluid communication between the fluid source 613 and a fluid pump 615.

Fluid pump 615 is coupled to conduit 616, which provided fluid communication between fluid pump 615 and fluid pump 617.

In one embodiment, fluid pump 615 and fluid pump 617 are both single stage fluid pumps. In another embodiment, fluid pump 615 and fluid pump 617 are both multistage fluid pumps.

In one embodiment, fluid pump 615 is a single stage fluid pump and fluid pump 617 is a multistage fluid pump. In another embodiment, fluid pump 615 is a multistage fluid pump and fluid pump 617 is a single stage fluid pump.

Fluid pump 617 is coupled to conduit 618, which provides fluid communication between fluid pump 617 and the second mixing device 619. The second mixing device 619 mixes the fluid from the fluid pump 617 with a chemical foam mixture received from the foam system 620 via the conduit 621.

In one embodiment, the fluid is water. In another embodiment, the foam system 620 is a single stage foam system. In yet another embodiment, the foam system 620 is a multistage foam system.

The second mixing device 619 is coupled to conduit 622, which provides fluid communication between the second mixing device 619 and the fluid control system 623. The fluid control system 623 includes the fluid flow sensor 624, the fluid pressure sensor 625, and the fluid valve 627. The fluid flow sensor 624 is in fluid communication with the fluid pressure sensor 625, which in turn is in fluid communication with the fluid valve 626. The fluid valve 626 is coupled to conduit 628, which provides fluid communication between the fluid valve 626 and the first mixing device 612.

The first mixing device 612 combines the gas received from the gas compressor 605 with the mixture of fluid and chemical foam to produce compressed gas foam. The first mixing device 612 is coupled to conduit 629, which provides fluid communication between the first mixing device 612 and an optional pressure regulator (not shown).

The components of the gas control system 607, for example, the gas flow sensor 608, the gas pressure sensor 609, and the gas valve 610, are each independently coupled to send and receive signals from the system controller 627. In a similar fashion, the components of the fluid control system 623, for example, the fluid flow sensor 624, the fluid pressure sensor 625, and the fluid valve 626 are each independently coupled to send and receive signals from the system controller 627. In this manner, the system controller 627 controls the ratio of gas to fluid by varying the flow of gas through the gas valve 610 and the flow of fluid through fluid valve 626.

The operator control panel and display 630 receives and sends system status information from the system controller 627. The system operator, for example, a fire truck engineer, can set controls manually with hand-operated valves and levers, or enters commands by way of the operator control panel and display 630. In one embodiment, the operator control panel and display 630 includes mechanical switches and digital displays. In another embodiment, the operator control panel and display 630 includes a touch screen display. Touch screen displays are well known in the art and are electronic visual displays that can detect the presence and location of a touch within the display area. In another embodiment, the operator control panel and display 630 includes an electronic visual display that can detect the presence of a light pen. These displays are also well known in the art.

Figure 7:
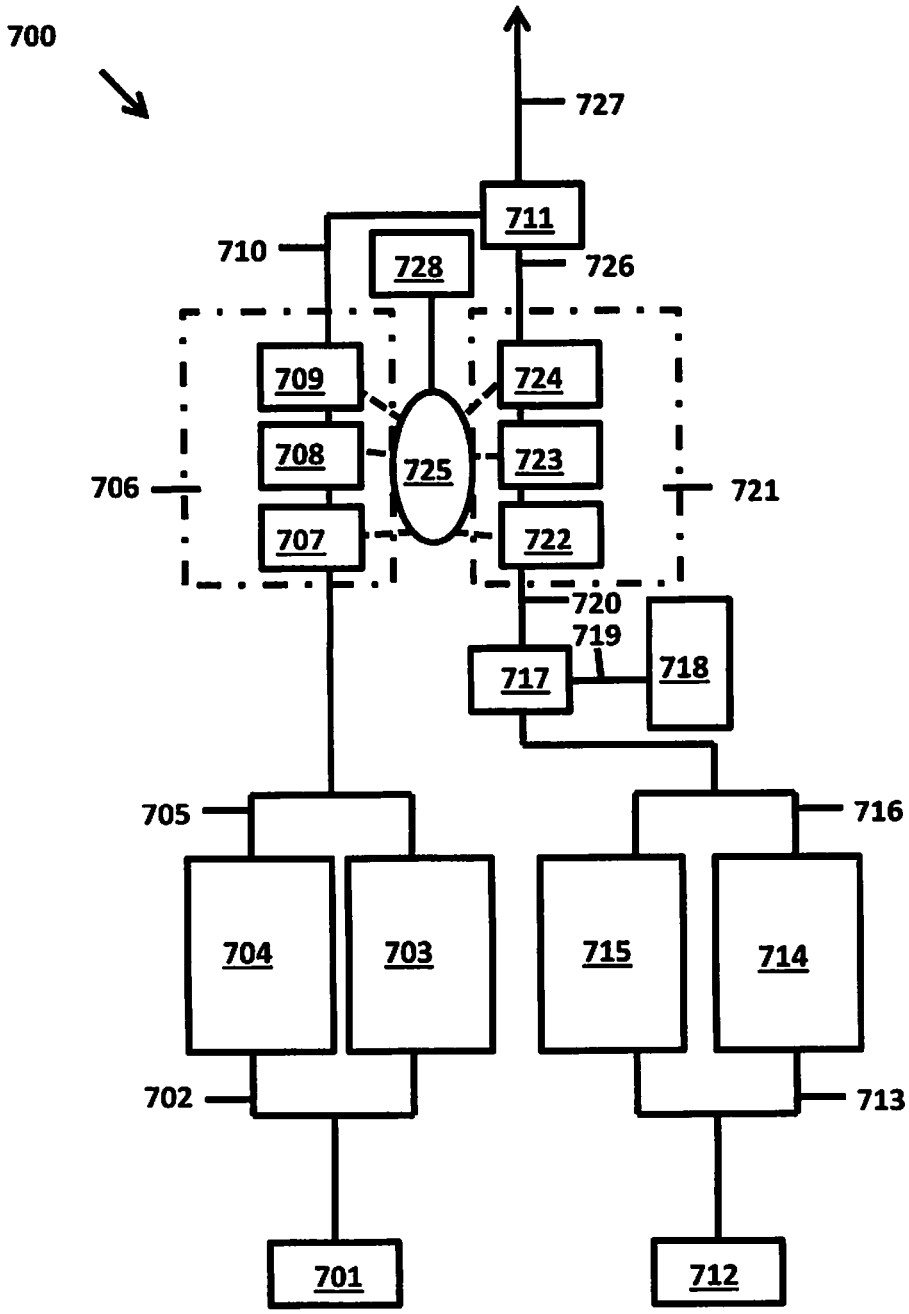
FIG. 7 is a block diagram illustrating an exemplary compressed gas foam system.

FIG. 7 is a block diagram illustrating an exemplary compressed gas foam system 700. The compressed gas foam system 700 includes a gas source 701 coupled to conduit 702, which provides fluid communication between the gas source 701 and gas compressor 703 and gas compressor 704.

In one embodiment, the gas compressors 703 and 704 are both single stage gas compressors. In another embodiment, the gas compressors 703 and 704 are both multistage gas compressors. In yet another embodiment, one of gas compressors 703 and 704 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressors 703 and 704 are coupled to conduit 705, which provides fluid communication between the gas compressor 703 and gas compressor 704 and the gas control system 706. The gas control system 706 includes the gas flow sensor 707, the gas pressure sensor 708, and the gas valve 709. The gas flow sensor 707 is in fluid communication with the gas pressure sensor 708, which in turn is in fluid communication with the gas valve 709. The gas valve 709 is coupled to conduit 710, which provides fluid communication between the gas valve 709 and the first mixing device 711.

The compressed gas foam system 700 also includes a fluid source 712 coupled to conduit 713, which provides fluid communication between the fluid source 712 and the fluid pumps 714 and 715.

In one embodiment, the fluid pumps 714 and 715 are both single stage fluid pumps. In another embodiment, the fluid pumps 714 and 715 are both multistage fluid pumps. In one embodiment, fluid pump 714 is a single stage fluid pump and fluid pump 715 is a multistage fluid pump. In one embodiment, fluid pump 714 is a multi-stage fluid pump and fluid pump 715 is a single stage fluid pump.

The fluid pumps 714 and 715 are coupled to conduit 716, which provides fluid communication between fluid pumps 714 and 715 and the second mixing device 717. The second mixing device 717 mixes the fluid from the fluid pumps 714 and 715 with a chemical foam mixture received from the foam system 718 via the conduit 719. The second mixing device 717 is coupled to conduit 720, which provides fluid communication between the second mixing device 717 and the fluid control system 721. The fluid control system 721 includes the fluid flow sensor 722, the fluid pressure sensor 723, and the fluid valve 724. The fluid flow sensor 722 is in fluid communication with the fluid pressure sensor 723, which in turn is in fluid communication with the fluid valve 724. The fluid valve 724 is coupled to conduit 726, which provides fluid communication between the fluid valve 724 and the first mixing device 711.

The first mixing device 711 combines the gas received from the gas compressors 703 and 704 with the mixture of fluid and chemical foam to produce compressed gas foam. The first mixing device 711 is coupled to conduit 727, which provides fluid communication between the first mixing device 711 and an optional pressure regulator (not shown).

The components of the gas control system 706, for example, the gas flow sensor 707, the gas pressure sensor 708, and the gas valve 709, are each independently coupled to send and receive signals from the system controller 725. In a similar fashion, the components of the fluid control system 721, for example, the fluid flow sensor 722, the fluid pressure sensor 723, and the fluid valve 724 are each independently coupled to send and receive signals from the system controller 725. In this manner, the system controller 725 controls the ratio of gas to fluid by varying the flow of gas through the gas valve 709 and the flow of fluid through fluid valve 724.

The operator control panel and display 728 receives and sends system status information from the system controller 725. The system operator, for example, a fire truck engineer, can set controls manually with hand-operated valves and levers, or enters commands by way of the operator control panel and display 728. In one embodiment, the operator control panel and display 728 includes mechanical switches and digital displays. In another embodiment, the operator control panel and display 728 includes a touch screen display. Touch screen displays are well known in the art and are electronic visual displays that can detect the presence and location of a touch within the display area. In another embodiment, the operator control panel and display 728 includes an electronic visual display that can detect the presence of a light pen. These displays are also well known in the art.

Figure 8:
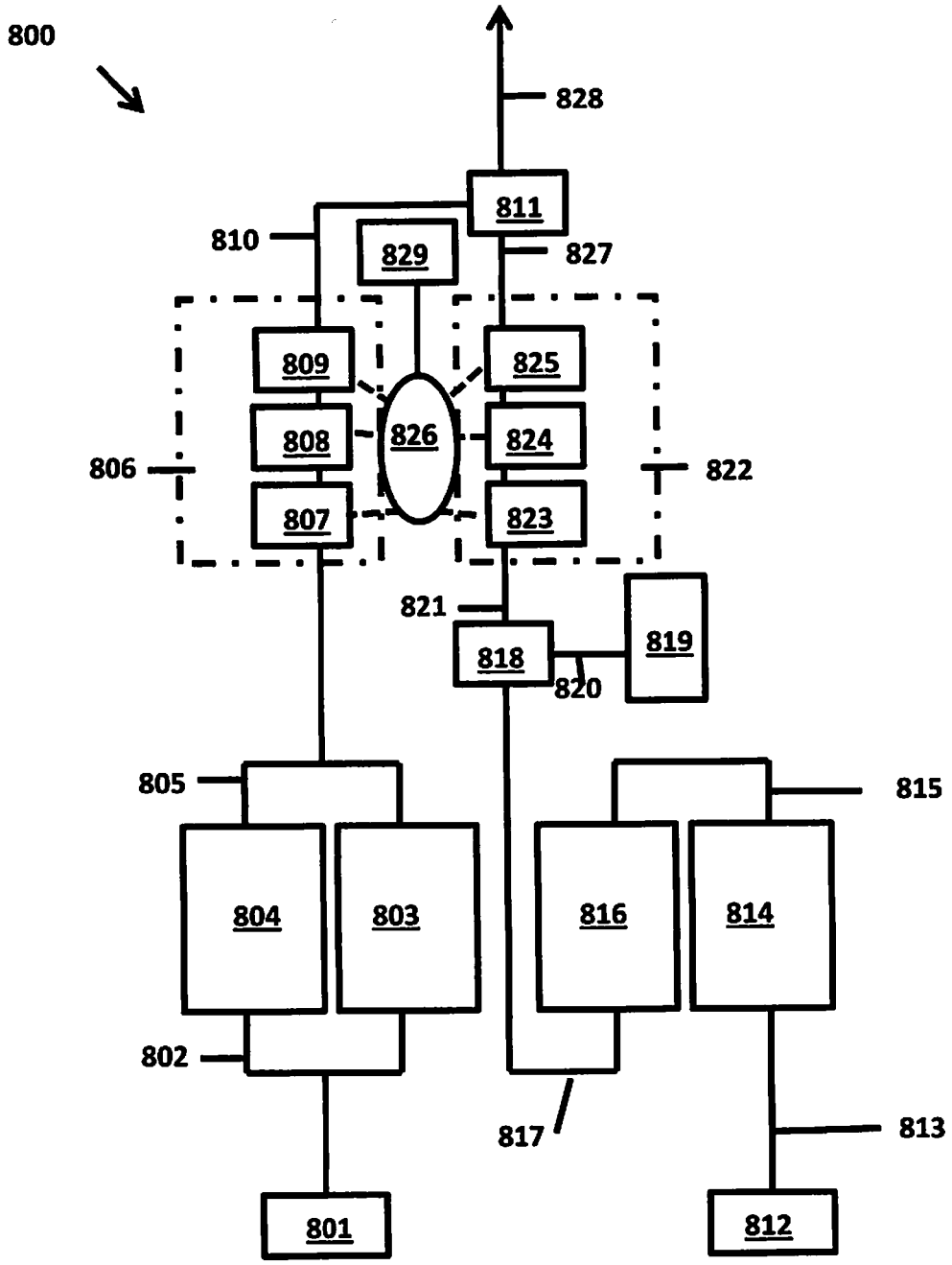
FIG. 8 is a block diagram illustrating an exemplary compressed gas foam system.

FIG. 8 is a block diagram illustrating an exemplary compressed gas foam system 800. The compressed gas foam system 800 includes a gas source 801 coupled to conduit 802. Conduit 802 provides fluid communication between the gas source 801 and gas compressor 803 and gas compressor 804.

In one embodiment, the gas compressors 803 and 804 are both single stage gas compressors. In another embodiment, the gas compressors 803 and 804 are both multistage gas compressors. In yet another embodiment, one of gas compressors 803 and 804 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressors 803 and 804 are coupled to conduit 805, which provides fluid communication between the gas compressor 803 and gas compressor 804 and the gas control system 806. The gas control system 806 includes the gas flow sensor 807, the gas pressure sensor 808, and the gas valve 809. The gas flow sensor 807 is in fluid communication with the gas pressure sensor 808, which in turn is in fluid communication with the gas valve 809. The gas valve 809 is coupled to conduit 810, which provides fluid communication between the gas valve 809 and the first mixing device 811.

The compressed gas foam system 800 also includes a fluid source 812 coupled to conduit 813, which provides fluid communication between the fluid source 812 and a fluid pump 814.

Fluid pump 814 is coupled to conduit 815, which provides fluid communication between fluid pump 814 and fluid pump 816.

In one embodiment, fluid pump 814 and fluid pump 816 are both single stage fluid pumps. In another embodiment, fluid pump 814 and fluid pump 816 are both multistage fluid pumps.

In one embodiment, fluid pump 814 is a single stage fluid pump and fluid pump 816 is a multistage fluid pump. In another embodiment, fluid pump 814 is a multistage fluid pump and fluid pump 816 is a single stage fluid pump.

Fluid pump 816 is coupled to conduit 817, which provides fluid communication between fluid pump 816 and the second mixing device 818. The second mixing device 818 mixes the fluid from the fluid pump 816 with a chemical foam mixture received from the foam system 819 via the conduit 820.

In one embodiment, the fluid is water. In another embodiment, the foam system 819 is a single stage foam system. In yet another embodiment, the foam system 819 is a multistage foam system.

The second mixing device 818 is coupled to conduit 821, which provides fluid communication between the second mixing device 818 and the fluid control system 822. The fluid control system 822 includes the fluid flow sensor 823, the fluid pressure sensor 824, and the fluid valve 825. The fluid flow sensor 823 is in fluid communication with the fluid pressure sensor 824, which in turn is in fluid communication with the fluid valve 825. The fluid valve 825 is coupled to conduit 827, which provides fluid communication between the fluid valve 825 and the first mixing device 811.

The first mixing device 811 combines the gas received from the gas compressors 803 and 804 with the mixture of fluid and chemical foam to produce compressed gas foam. The first mixing device 811 is coupled to conduit 828, which provides fluid communication between the first mixing device 811 and an optional pressure regulator (not shown).

The components of the gas control system 806, for example, the gas flow sensor 807, the gas pressure sensor 808, and the gas valve 809, are each independently coupled to send and receive signals from the system controller 826. In a similar fashion, the components of the fluid control system 822, for example, the fluid flow sensor 823, the fluid pressure sensor 824, and the fluid valve 825 are each independently coupled to send and receive signals from the system controller 826. In this manner, the system controller 826 controls the ratio of gas to fluid by varying the flow of gas through the gas valve 809 and the flow of fluid through fluid valve 825.

The operator control panel and display 829 receives and sends system status information from the system controller 826. The system operator, for example, a fire truck engineer, can set controls manually with hand-operated valves and levers, or enters commands by way of the operator control panel and display 829. In one embodiment, the operator control panel and display 829 includes mechanical switches and digital displays. In another embodiment, the operator control panel and display 829 includes a touch screen display. Touch screen displays are well known in the art and are electronic visual displays that can detect the presence and location of a touch within the display area. In another embodiment, the operator control panel and display 829 includes an electronic visual display that can detect the presence of a light pen. These displays are also well known in the art.

Figure 9:
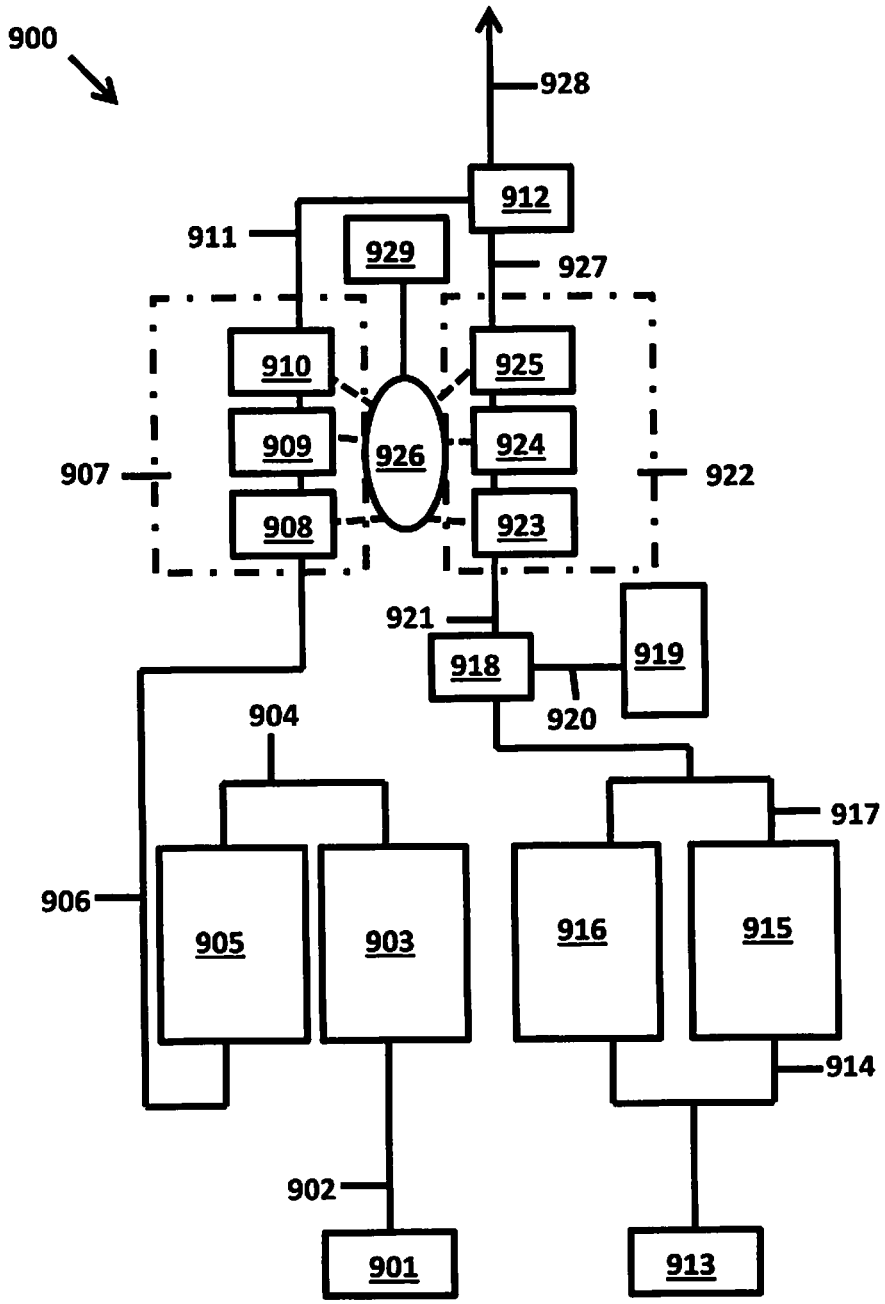
FIG. 9 is a block diagram illustrating an exemplary compressed gas foam system.

FIG. 9 is a block diagram illustrating an exemplary compressed gas foam system 900. The compressed gas foam system 900 includes a gas source 901 coupled to conduit 902, which provides fluid communication between the gas source 901 and the gas compressor 903. The gas compressor 903 is coupled to conduit 904, which provides fluid communication between the gas compressor 903 and the gas compressor 905.

In one embodiment, the gas compressors 903 and 905 are both single stage gas compressors. In another embodiment, the gas compressors 903 and 905 are both multistage gas compressors. In yet another embodiment, one of gas compressors 903 and 905 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 905 is coupled to conduit 906, which provides fluid communication between the gas compressor 905 and the gas control system 907. The gas control system 907 includes the gas flow sensor 908, the gas pressure sensor 909, and the gas valve 910. The gas flow sensor 908 is in fluid communication with the gas pressure sensor 909, which in turn is in fluid communication with the gas valve 910. The gas valve 910 is coupled to conduit 911, which provides fluid communication between the gas valve 910 and the first mixing device 912.

The compressed gas foam system 900 also includes a fluid source 913 coupled to conduit 914, which provides fluid communication between the fluid source 913 and the fluid pumps 915 and 916.

In one embodiment, the fluid pumps 915 and 916 are both single stage fluid pumps. In another embodiment, the fluid pumps 915 and 916 are both multistage fluid pumps. In one embodiment, fluid pump 915 is a single stage fluid pump and fluid pump 916 is a multistage fluid pump. In one embodiment, fluid pump 915 is a multi-stage fluid pump and fluid pump 916 is a single stage fluid pump.

The fluid pumps 915 and 916 are coupled to conduit 917, which provides fluid communication between fluid pumps 915 and 916 and the second mixing device 918. The second mixing device 918 mixes the fluid from the fluid pumps 915 and 916 with a chemical foam mixture received from the foam system 919 via the conduit 920.

In one embodiment, the fluid is water. In another embodiment, the foam system 919 is a single stage foam system. In yet another embodiment, the foam system 919 is a multistage foam system.

The second mixing device 918 is coupled to conduit 921, which provides fluid communication between the second mixing device 918 and the fluid control system 922. The fluid control system 922 includes the fluid flow sensor 923, the fluid pressure sensor 924, and the fluid valve 925. The fluid flow sensor 923 is in fluid communication with the fluid pressure sensor 924, which in turn is in fluid communication with the fluid valve 925. The fluid valve 925 is coupled to conduit 927, which provides fluid communication between the fluid valve 925 and the first mixing device 912.

The first mixing device 912 combines the gas received from the gas compressor 905 with the mixture of fluid and chemical foam to produce compressed gas foam. The first mixing device 912 is coupled to conduit 928, which provides fluid communication between the first mixing device 912 and an optional pressure regulator (not shown).

The components of the gas control system 907, for example, the gas flow sensor 908, the gas pressure sensor 909, and the gas valve 910, are each independently coupled to send and receive signals from the system controller 926. In a similar fashion, the components of the fluid control system 922, for example, the fluid flow sensor 923, the fluid pressure sensor 924, and the fluid valve 925 are each independently coupled to send and receive signals from the system controller 926. In this manner, the system controller 926 controls the ratio of gas to fluid by varying the flow of gas through the gas valve 910 and the flow of fluid through fluid valve 925.

The operator control panel and display 929 receives and sends system status information from the system controller 926. The system operator, for example, a fire truck engineer, can set controls manually with hand-operated valves and levers, or enters commands by way of the operator control panel and display 929. In one embodiment, the operator control panel and display 929 includes mechanical switches and digital displays. In another embodiment, the operator control panel and display 929 includes a touch screen display. Touch screen displays are well known in the art and are electronic visual displays that can detect the presence and location of a touch within the display area. In another embodiment, the operator control panel and display 929 includes an electronic visual display that can detect the presence of a light pen. These displays are also well known in the art.

Figure 10:
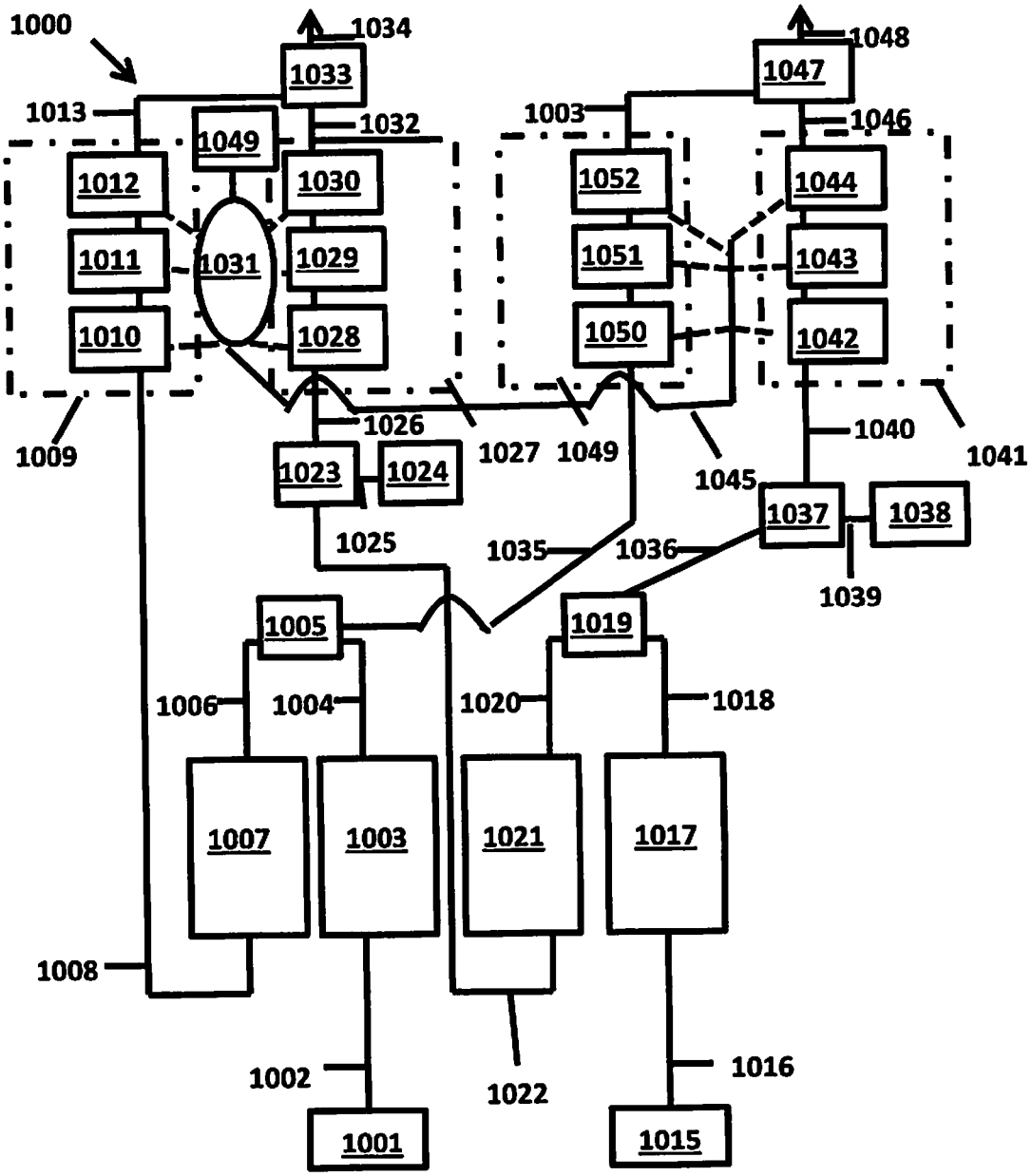
FIG. 10 is a block diagram illustrating an exemplary compressed gas foam system.

FIG. 10 is a block diagram illustrating an exemplary compressed gas foam system 1000. The compressed gas foam system 1000 includes a gas source 1001 coupled to conduit 1002, which provides fluid communication between the gas source 1001 and the gas compressor 1003. The gas compressor 1003 is coupled to conduit 1004, which provides fluid communication between the gas compressor 1003 and the gas regulator 1005. The gas regulator 1005 is coupled to the conduit 1006 and conduit 1035. Conduit 1006 is coupled to gas compressor 1007. Gas compressor 1007 is coupled to conduit 1008, which provides fluid communication between gas compressor 1007 and the gas control system 1009. The gas control system 1009 includes the gas flow sensor 1010, the gas pressure sensor 1011, and the gas valve 1012. The gas flow sensor 1010 is in fluid communication with the gas pressure sensor 1011, which in turn is in fluid communication with the gas valve 1012. The gas valve 1012 is coupled to conduit 1013, which provides fluid communication between the gas valve 1012 and the first mixing device 1033.

In one embodiment, the gas compressors 1003 and 1007 are both single stage gas compressors. In another embodiment, the gas compressors 1003 and 1007 are both multistage gas compressors. In yet another embodiment, one of gas compressors 1003 and 1007 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 1000 also includes a fluid source 1015 coupled to conduit 1016, which provides fluid communication between the fluid source 1015 and a fluid pump 1017.

Fluid pump 1017 is coupled to conduit 1018, which provided fluid communication between fluid pump 1017 and fluid regulator 1019. Fluid regulator 1019 is coupled to conduit 1020 and conduit 1036. Conduit 1020 provides fluid communication between the fluid regulator 1019 and the fluid pump 1021.

In one embodiment, fluid pump 1017 and fluid pump 1021 are both single stage fluid pumps. In another embodiment, fluid pump 1017 and fluid pump 1021 are both multistage fluid pumps.

In one embodiment, fluid pump 1017 is a single stage fluid pump and fluid pump 1021 is a multistage fluid pump. In another embodiment, fluid pump 1017 is a multistage fluid pump and fluid pump 1021 is a single stage fluid pump.

Fluid pump 1021 is coupled to conduit 1022, which provides fluid communication between fluid pump 1021 and the second mixing device 1023. The second mixing device 1023 mixes the fluid from the fluid pump 1021 with a chemical foam mixture received from the foam system 1024 via the conduit 1025.

In one embodiment, the fluid is water. In another embodiment, the foam system 1024 is a single stage foam system. In yet another embodiment, the foam system 1024 is a multistage foam system.

The second mixing device 1023 is coupled to conduit 1026, which provides fluid communication between the second mixing device 1023 and the fluid control system 1027. The fluid control system 1027 includes the fluid flow sensor 1028, the fluid pressure sensor 1029, and the fluid valve 1030. The fluid flow sensor 1028 is in fluid communication with the fluid pressure sensor 1029, which in turn is in fluid communication with the fluid valve 1030. The fluid valve 1030 is coupled to conduit 1032, which provides fluid communication between the fluid valve 1030 and the first mixing device 1033.

If the gas regulator 1005 directs the gas into conduit 1006 and the fluid regulator 1019 directs the fluid into conduit 1020, then the first mixing device 1033 combines the gas received from the fluid compressor 1007 with the mixture of fluid and chemical foam obtained from the second mixing device 1023 to produce compressed gas foam. The first mixing device 1033 is coupled to conduit 1034, which provides fluid communication between the first mixing device 1033 and an optional pressure regulator (not shown).

The components of the gas control system 1009, for example, the gas flow sensor 1010, the gas pressure sensor 1011, and the gas valve 1012, are each independently coupled to send and receive signals from the system controller 1031. In a similar fashion, the components of the fluid control system 1027, for example, the fluid flow sensor 1028, the fluid pressure sensor 1029, and the fluid valve 1030 are each independently coupled to send and receive signals from the system controller 1031. In this manner, the system controller 1031 controls the ratio of gas to fluid by varying the flow of gas through the gas valve 1012 and the flow of fluid through fluid valve 1030.

Fluid regulator 1019 is also coupled with conduit 1036, which provides fluid communication between the fluid regulator 1019 and the fluid mixing device 1037. The fluid mixing device 1037 mixes the fluid from the fluid pump 1017 with a chemical foam mixture received from the foam system 1038 via the conduit 1039.

In one embodiment, the fluid is water.

If the gas regulator 1005 directs the gas into conduit 1035 and the fluid regulator 1019 directs the fluid into conduit 1036, then the fluid mixing device 1047 combines the gas received from the gas compressor 1003 with the mixture of fluid and chemical foam obtained from the fluid mixing device 1037 to produce compressed gas foam. The fluid mixing device 1047 is coupled to conduit 1048, which provides fluid communication between the fluid mixing device 1047 and an optional pressure regulator (not shown).

The components of the gas control system 1049, for example, the gas flow sensor 1050, the gas pressure sensor 1051, and the gas valve 1052, are each independently coupled to send and receive signals from the system controller 1031 by conduit 1045. In a similar fashion, the components of the fluid control system 1041, for example, the fluid flow sensor 1042, the fluid pressure sensor 1043, and the fluid valve 1044 are each independently coupled to send and receive signals from the system controller 1031. In this manner, the system controller 1031 controls the ratio of gas to fluid by varying the flow of gas through the gas valve 1052 and the flow of fluid through fluid valve 1044.

The operator control panel and display 1053 receives and sends system status information from the system controller 1031. The system operator, for example, a fire truck engineer, can set controls manually with hand-operated valves and levers, or enters commands by way of the operator control panel and display 1053. In one embodiment, the operator control panel and display 1053 includes mechanical switches and digital displays. In another embodiment, the operator control panel and display 1053 includes a touch screen display. Touch screen displays are well known in the art and are electronic visual displays that can detect the presence and location of a touch within the display area. In another embodiment, the operator control panel and display 1053 includes an electronic visual display that can detect the presence of a light pen. These displays are also well known in the art.

Figure 11:
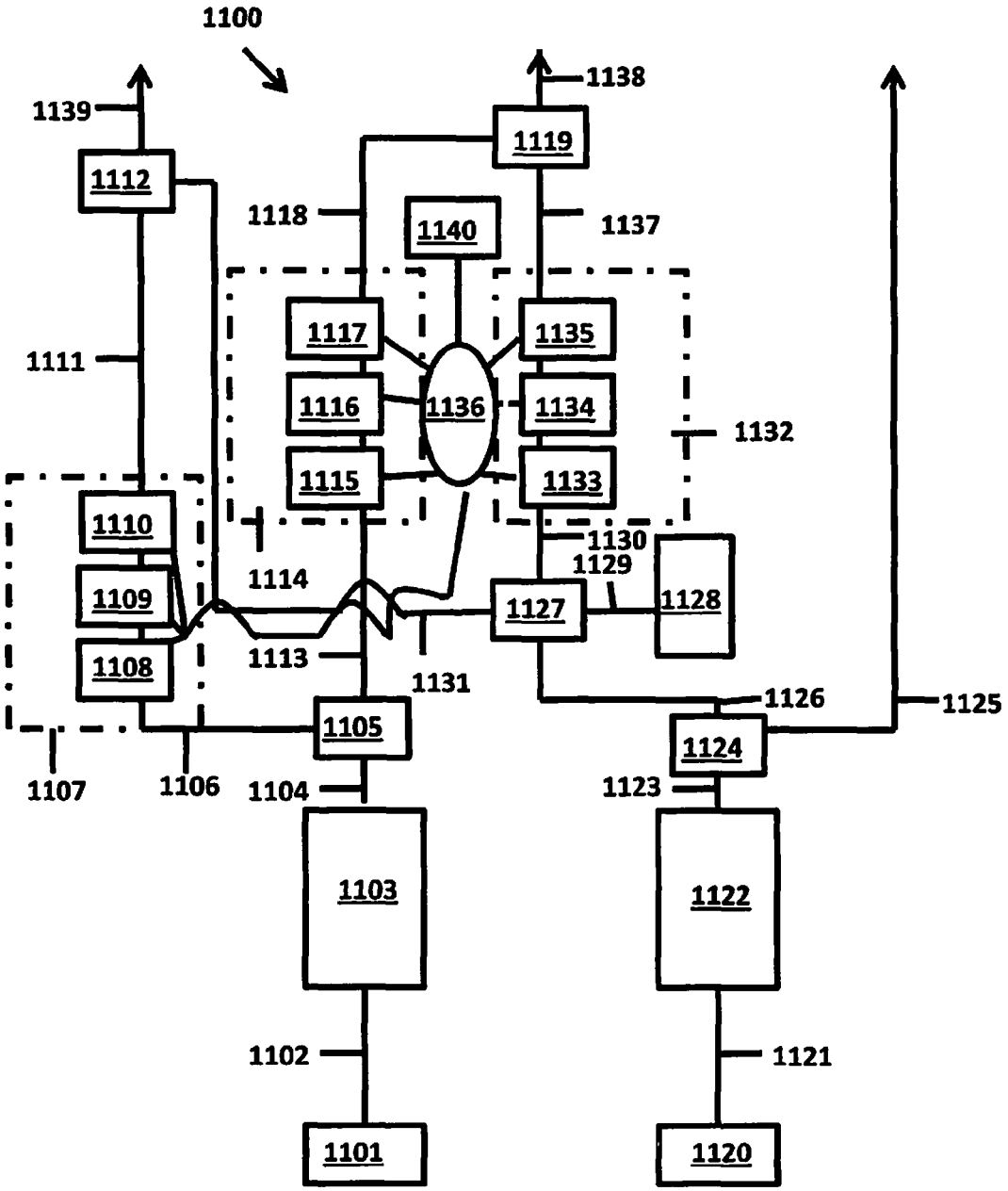
FIG. 11 is a block diagram illustrating an exemplary compressed gas foam system.

FIG. 11 is a block diagram illustrating an exemplary compressed gas foam system 1100. The compressed gas foam system 1100 includes a gas source 1101 coupled to conduit 1102, which provides fluid communication between the gas source 1101 and the gas compressor 1103. The gas compressor 1103 is coupled to conduit 1104, which provides fluid communication between the gas compressor 1103 and the gas regulator 1105. The gas regulator 1105 is coupled to the conduit 1106 and conduit 1113. Conduit 1106 is coupled to the gas control system 1107. The gas control system 1107 includes the gas flow sensor 1108, the gas pressure sensor 1109, and the gas valve 1110. The gas flow sensor 1108 is in fluid communication with the gas pressure sensor 1109, which in turn is in fluid communication with the gas valve 1110. The gas valve 1110 is coupled to conduit 1111, which provides fluid communication between the gas valve 1110 and the mixing device 1112. The mixing device 1112 is coupled to conduit 1139, which provides fluid communication between the mixing device 1112 and an optional pressure regulator (not shown). In one embodiment, conduit 1139 conveys a low pressure compressed gas foam to the optional pressure regulator (not shown).

Conduit 1113 is coupled to the gas control system 1114. The gas control system 1114 includes the gas flow sensor 1115, the gas pressure sensor 1116, and the gas valve 1117. The gas flow sensor 1115 is in fluid communication with the gas pressure sensor 1116, which in turn is in fluid communication with the gas valve 1117. The gas valve 1117 is coupled to conduit 1118, which provides fluid communication between the gas valve 1117 and the mixing device 1119. The mixing device 1119 is coupled to conduit 1138, which provides fluid communication between the mixing device 1119 and an optional pressure regulator (not shown). In one embodiment, conduit 1138 conveys a high pressure compressed gas foam to the optional pressure regulator (not shown).

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 1100 also includes a fluid source 1120 coupled to conduit 1121, which provides fluid communication between the fluid source 1120 and a fluid pump 1122.

Fluid pump 1122 is coupled to conduit 1123, which provided fluid communication between fluid pump 1122 and fluid regulator 1124. Fluid regulator 1124 is coupled to conduit 1125 and conduit 1126. Conduit 1125 provides fluid communication between the fluid regulator 1124 and the optional pressure regulator (not shown). The conduit 1125 provides a source of fluid.

In one embodiment, fluid pump 1122 is a single stage fluid pump. In another embodiment, fluid pump 1122 is a multi-stage fluid pump.

Conduit 1126 provides fluid communication between fluid pump 1122 and the fluid mixing device 1127. The fluid mixing device 1127 mixes the fluid from the fluid pump 1122 with a chemical foam mixture received from the foam system 1128 via the conduit 1129. The fluid mixing device 1127 is coupled to conduit 1130 and conduit 1131. Conduit 1131 is coupled to mixing device 1112 to provide a source of fluid for the production of the low pressure compressed gas foam.

Conduit 1130 is coupled to the fluid control system 1132. The fluid control system 1132 includes the fluid flow sensor 1133, the fluid pressure sensor 1134, and the fluid valve 1135.

The fluid flow sensor 1133 is in fluid communication with the fluid pressure sensor 1134, which in turn is in fluid communication with the fluid valve 1135. The fluid valve 1135 is coupled to conduit 1137, which provides fluid communication between the fluid valve 1135 and the mixing device 1119.

In one embodiment, the fluid is water.

The components of the gas control system 1107, for example, the gas flow sensor 1108, the gas pressure sensor 1109, and the gas valve 1110, and the gas control system 1114, for example, the gas flow sensor 1115, the gas pressure sensor 1116, and the gas valve 1117, are each independently coupled to send and receive signals from the system controller 1136. In a similar fashion, the components of the fluid control system 1132, for example, the fluid flow sensor 1133, the fluid pressure sensor 1134, and the fluid valve 1135 are each independently coupled to send and receive signals from the system controller 1136. In this manner, the system controller 1136 controls the ratio of gas to fluid by varying the flow of gas through the gas valve 1117 and the flow of fluid through fluid valve 1135.

The operator control panel and display 1140 receives and sends system status information from the system controller 1136. The system operator, for example, a fire truck engineer, can set controls manually with hand-operated valves and levers, or enters commands by way of the operator control panel and display 1140. In one embodiment, the operator control panel and display 1140 includes mechanical switches and digital displays. In another embodiment, the operator control panel and display 1140 includes a touch screen display. Touch screen displays are well known in the art and are electronic visual displays that can detect the presence and location of a touch within the display area. In another embodiment, the operator control panel and display 1140 includes an electronic visual display that can detect the presence of a light pen. These displays are also well known in the art.

Figure 12:
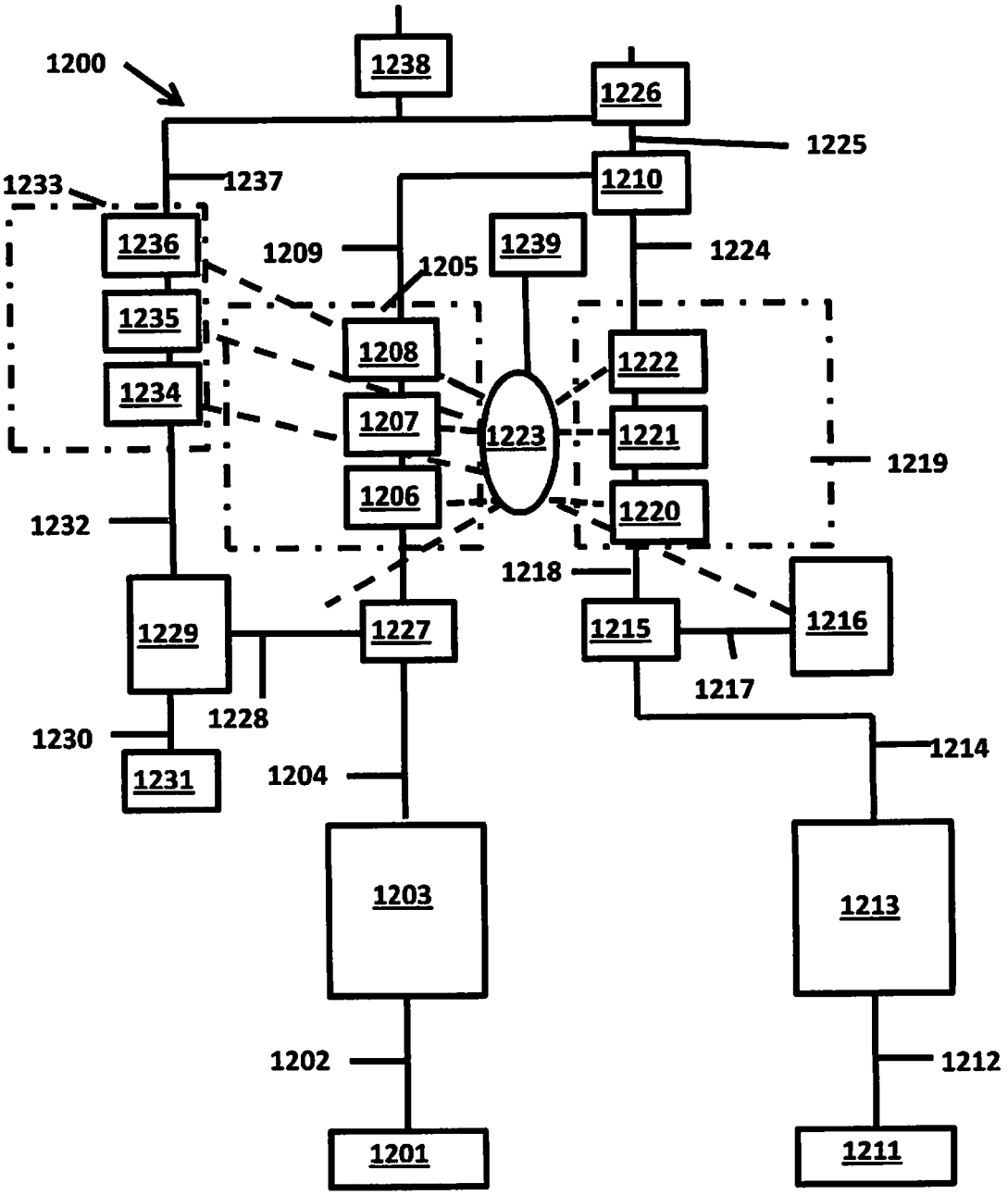
FIG. 12 is a block diagram illustrating an exemplary compressed gas foam system.

FIG. 12 is a block diagram illustrating an exemplary compressed gas foam system 1200. The compressed gas foam system 1200 includes a gas source 1201 coupled to conduit 1202, which provides fluid communication between the gas source 1201 and the gas compressor 1203.

In one embodiment, the gas compressor 1203 is a single stage gas compressor. In another embodiment, the gas compressor 1203 is a multistage gas compressor. In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 1203 is coupled to conduit 1204, which provides fluid communication between the gas compressor 1203 and the gas control system 1205 and the valve 1227. The gas control system 1205 includes the gas flow sensor 1206, the gas pressure sensor 1207, and the gas valve 1208. The gas flow sensor 1206 is in fluid communication with the gas pressure sensor 1207, which in turn is in fluid communication with the gas valve 1208. The gas valve 1208 is coupled to conduit 1209, which provides fluid communication between the gas valve 1208 and the first mixing device 1210.

The compressed gas foam system 1200 also includes a fluid source 1211 coupled to conduit 1212, which provides fluid communication between the fluid source 1211 and a fluid pump 1213.

In one embodiment, the fluid pump 1213 is a single stage fluid pump. In another embodiment, the fluid pump 1213 is a multistage fluid pump.

Fluid pump 1213 is coupled to conduit 1214, which provides fluid communication between fluid pump 1213 and the second mixing device 1215. The second mixing device 1215 mixes the fluid from the fluid pump 1213 with a chemical foam mixture received from the foam system 1216 via the conduit 1217.

In one embodiment, the fluid is water. In another embodiment, the foam system 1216 is a single stage foam system. In yet another embodiment, the foam system 1216 is a multistage foam system. In still yet another embodiment, the foam system 1216 is a bladder-type foam system.

The second mixing device 1215 is coupled to conduit 1218, which provides fluid communication between the second mixing device 1215 and the fluid control system 1219. The fluid control system 1219 includes the fluid flow sensor 1220, the fluid pressure sensor 1221, and the fluid valve 1222. The fluid flow sensor 1220 is in fluid communication with the fluid pressure sensor 1221, which in turn is in fluid communication with the fluid valve 1222. The fluid valve 1222 is coupled to conduit 1224, which provides fluid communication between the fluid valve 1222 and the first mixing device 1210.

The first mixing device 1210 combines the gas received from the gas compressor 1203 with the mixture of fluid and chemical foam to produce compressed gas foam. The first mixing device 1210 is coupled to conduit 1225, which provides fluid communication between the first mixing device 1210 and the nozzle 1226. The nozzle 1226 is a liquid and chemical fire suppression agent nozzle for fire extinction. Suitable nozzles are described in U.S. Pat. Nos. 5,167,285 and 5,312,041.

The nozzle described in the U.S. Pat. No. 5,167,285, is marketed under the Hydrochem trade name, and throws a stream of dry powder or chemical within a stream of liquid or foam by injecting the dry powder or chemical stream into the middle of the liquid or foam solution stream at the nozzle discharge port. The dry chemical stream is projected with and, to a certain extent, by the liquid/foam stream. When simultaneously dispensed by Hydrochem-type nozzles, liquid agent streams are able to carry desired dry chemical streams to a fire apparently by entrapping, encapsulating, or entraining them within the fluid stream. Yet, the chemical performs like a "dry" chemical at the fire. Such transport with or in the liquid stream has enabled application of dry chemical agents from considerably greater distances than was previously possible.

In a similar fashion, the nozzle described in the U.S. Pat. No. 5,312,041 throws a stream of second fluid or an inert gas within a stream of liquid or foam by injecting the inert gas into the middle of the liquid or foam solution stream at the nozzle discharge port. The second fluid or an inert gas is projected with and, to a certain extent, by the liquid/foam stream. When simultaneously dispensed by Hydrochem-type nozzles, liquid agent streams are able to carry desired second fluid or an inert gas to a fire apparently by entrapping, encapsulating, or entraining them within the fluid stream. Such transport with or in the liquid stream has enabled application of a second fluid or an inert gas from considerably greater distances than was previously possible.

The components of the gas control system 1205, for example, the gas flow sensor 1206, the gas pressure sensor 1207, and the gas valve 1208, are each independently coupled to send and receive signals from the system controller 1223. In a similar fashion, the components of the fluid control system 1219, for example, the fluid flow sensor 1220, the fluid pressure sensor 1221, and the fluid valve 1222 are each independently coupled to send and receive signals from the system controller 1223. In this manner, the system controller 1223 controls the ratio of gas to fluid by varying the flow of gas through the gas valve 1208 and the flow of fluid through fluid valve 1222.

The operator control panel and display 1239 receives and sends system status information from the system controller 1223. The system operator, for example, a fire truck engineer, can set controls manually with hand-operated valves and levers, or enters commands by way of the operator control panel and display 1239. In one embodiment, the operator control panel and display 1239 includes mechanical switches and digital displays. In another embodiment, the operator control panel and display 1239 includes a touch screen display. Touch screen displays are well known in the art and are electronic visual displays that can detect the presence and location of a touch within the display area. In another embodiment, the operator control panel and display 1239 includes an electronic visual display that can detect the presence of a light pen. These displays are also well known in the art.

The conduit 1204 is coupled to the valve 1227, which is in fluid communication with conduit 1228 leading to the chemical fire suppression agent reservoir 1229. The chemical fire suppression agent reservoir 1229 may contain a chemical suppression agent, typically a powder or a second inert fluid such as carbon dioxide. The chemical fire suppression agent reservoir 1229 is coupled to an optional pressurized gas container 1231 via the conduit 1230, which may provide a back-up gas supply to propel the chemical fire suppression agent from the chemical fire suppression agent reservoir 1229 out to the nozzle 1226.

The chemical fire suppression agent reservoir 1229 is coupled to conduit 1232, which provides fluid communication between the chemical fire suppression agent reservoir 1229 and the chemical fire suppression agent control system 1233. The chemical fire suppression agent control system 1233 includes the chemical fire suppression agent flow sensor 1234, the chemical fire suppression agent pressure sensor 1235, and the chemical fire suppression agent valve 1236. The chemical fire suppression agent flow sensor 1234 is in fluid communication with the chemical fire suppression agent pressure sensor 1235, which in turn is in fluid communication with the chemical fire suppression agent valve 1236. The chemical fire suppression agent valve 1236 is coupled to conduit 1237, which provides fluid communication between the chemical fire suppression agent valve 1236, the optional outlet regulator 1238, and the nozzle 1226.

The system controller 1223 operatively coupled to the gas control system 1205, the fluid control system 1219, the second gas valve 1227, the foam system 1216, and the chemical fire suppression agent control system 1233. The system controller 1223 includes a programmable input. The system controller 1223 is also configured, for example, to receive a sensed fluid flow rate from the fluid flow sensor 1220, a sensed fluid pressure from the fluid pressure sensor 1221, a sensed gas flow rate from the first gas flow sensor 1206, a sensed gas pressure from the gas pressure sensor 1207; a sensed chemical fire suppression agent flow rate from the chemical fire suppression agent flow sensor 1234; and a sensed chemical fire suppression agent pressure from the chemical fire suppression agent pressure sensor 1235. The system controller 1223 is also configured, for example, to output a first control signal to the fluid valve 1222 for regulating a fluid flow, a fluid pressure, or a combination thereof, and to output a second control signal to the first gas valve 1208 for regulating a gas flow relative to the sensed fluid flow, the sensed fluid pressure, or a combination thereof. The system controller 1223 automatically adjusts the first control signal and the second control signal to maintain a ratio of fluid flow to gas flow based upon the programmable input. The system controller 1223 is also configured, for example, to output a third control signal to the second gas valve 1227 for regulating the flow of gas to from the gas compressor 1203 to pressurize the chemical fire suppression agent reservoir 1229. The system controller 1223 is also configured, for example, to output a fourth control signal to the chemical fire suppression agent valve 1236 for regulating the flow of a chemical fire suppression agent. The system controller 1223 is also configured, for example, to output a fifth control signal to the foam system 1216 to control the output of the foam system 1216.

Figure 13:
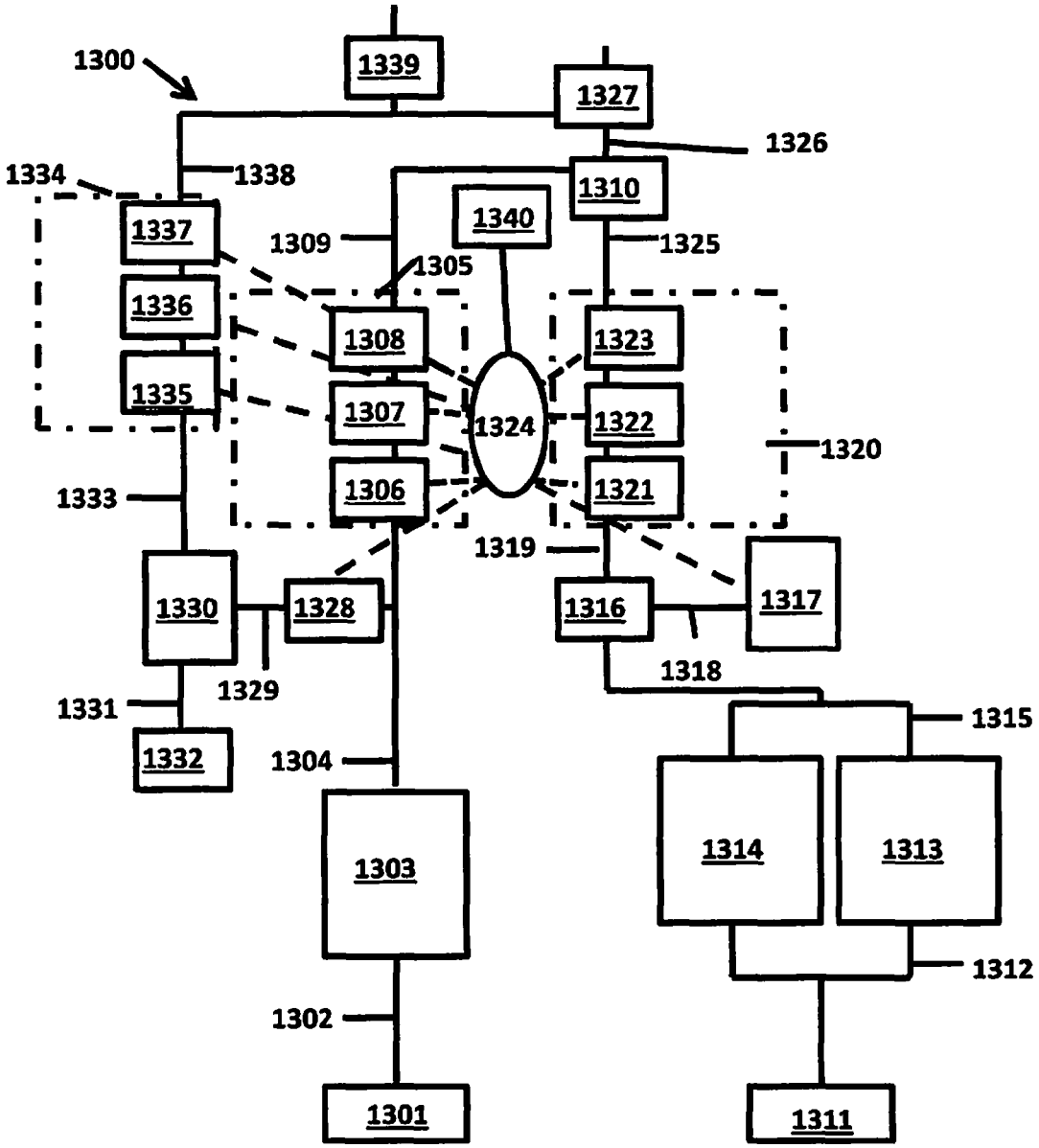
FIG. 13 is a block diagram illustrating an exemplary compressed gas foam system.

FIG. 13 is a block diagram illustrating an exemplary compressed gas foam system 1300. The compressed gas foam system 1300 includes a gas source 1301 coupled to conduit 1302, which provides fluid communication between the gas source 1301 and the gas compressor 1303. The gas compressor 1303 is coupled to conduit 1304, which provides fluid communication between the gas compressor 1303 and the gas control system 1305.

In one embodiment, the gas compressor 1303 is single stage gas compressor. In another embodiment, the gas compressor 1303 is a multistage gas compressor. In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas control system 1305 includes the gas flow sensor 1306, the gas pressure sensor 1307, and the gas valve 1308. The gas flow sensor 1306 is in fluid communication with the gas pressure sensor 1307, which in turn is in fluid communication with the gas valve 1308. The gas valve 1308 is coupled to conduit 1309, which provides fluid communication between the gas valve 1308 and the first mixing device 1310.

The compressed gas foam system 1300 also includes a fluid source 1311 coupled to conduit 1312, which provides fluid communication between the fluid source 1311 and two fluid pumps 1313 and 1314.

In one embodiment, the two fluid pumps 1313 and 1314 are both single stage fluid pumps. In another embodiment, the two fluid pumps 1313 and 1314 are both multistage fluid pumps. In one embodiment, the one of the two fluid pumps 1313 and 1314 is a single stage fluid pump and the other pump is a multistage fluid pump.

Fluid pumps 1313 and 1314 are coupled to conduit 1315, which provides fluid communication between fluid pumps 1313 and 1314 and the second mixing device 1316. The second mixing device 1316 mixes the fluid from the two fluid pumps 1313 and 1314 with a chemical foam mixture received from the foam system 1317 via the conduit 1318.

In one embodiment, the fluid is water. In another embodiment, the foam system 1317 is a single stage foam system. In yet another embodiment, the foam system 1317 is a multistage foam system. In still yet another embodiment, the foam system 1317 is a bladder-type foam system.

The second mixing device 1316 is coupled to conduit 1319, which provides fluid communication between the second mixing device 1316 and the fluid control system 1320. The fluid control system 1320 includes the fluid flow sensor 1321, the fluid pressure sensor 1322, and the fluid valve 1323. The fluid flow sensor 1321 is in fluid communication with the fluid pressure sensor 1322, which in turn is in fluid communication with the fluid valve 1323. The fluid valve 1323 is coupled to conduit 1325, which provides fluid communication between the fluid valve 1323 and the first mixing device 1310.

The first mixing device 1310 combines the gas received from the gas compressor 1303 with the mixture of fluid and chemical foam to produce compressed gas foam. The first mixing device 1310 is coupled to conduit 1326, which provides fluid communication between the first mixing device 1310 and the nozzle 1327. The nozzle 1327 is a liquid and chemical fire suppression agent nozzle for fire extinction. Suitable nozzles are described in U.S. Pat. Nos. 5,167,285 and 5,312,041.

The components of the gas control system 1305, for example, the gas flow sensor 1306, the gas pressure sensor 1307, and the gas valve 1308, are each independently coupled to send and receive signals from the system controller 1324. In a similar fashion, the components of the fluid control system 1320, for example, the fluid flow sensor 1321, the fluid pressure sensor 1322, and the fluid valve 1323 are each independently coupled to send and receive signals from the system controller 1324. In this manner, the system controller 1324 controls the ratio of gas to fluid by varying the flow of gas through the gas valve 1308 and the flow of fluid through fluid valve 1323.

The operator control panel and display 1340 receives and sends system status information from the system controller 1324. The system operator, for example, a fire truck engineer, can set controls manually with hand-operated valves and levers, or enters commands by way of the operator control panel and display 1340. In one embodiment, the operator control panel and display 1340 includes mechanical switches and digital displays. In another embodiment, the operator control panel and display 1340 includes a touch screen display. Touch screen displays are well known in the art and are electronic visual displays that can detect the presence and location of a touch within the display area. In another embodiment, the operator control panel and display 1340 includes an electronic visual display that can detect the presence of a light pen. These displays are also well known in the art.

The conduit 1304 is coupled to the valve 1328, which is in fluid communication with conduit 1329 leading to the chemical fire suppression agent reservoir 1330. The chemical fire suppression agent reservoir 1330 may contain a chemical suppression agent, typically a powder or a second inert fluid such as carbon dioxide. The chemical fire suppression agent reservoir 1330 is coupled to an optional pressurized gas container 1332 via the conduit 1331, which may provide a backup gas supply to propel the chemical fire suppression agent from the chemical fire suppression agent reservoir 1330 out to the nozzle 1327

The chemical fire suppression agent reservoir 1330 is coupled to conduit 1333 which provides fluid communication between the chemical fire suppression agent reservoir 1330 and the chemical fire suppression agent control system 1334. The chemical fire suppression agent control system 1334 includes the chemical fire suppression agent flow sensor 1335, the chemical fire suppression agent pressure sensor 1336, and the chemical fire suppression agent valve 1337. The chemical fire suppression agent flow sensor 1335 is in fluid communication with the chemical fire suppression agent pressure sensor 1336, which in turn is in fluid communication with the chemical fire suppression agent valve 1337. The chemical fire suppression agent valve 1337 is coupled to conduit 1338, which provides fluid communication between the chemical fire suppression agent valve 1337, the optional outlet regulator 1339, and the nozzle 1327

The system controller 1324 operatively coupled to the gas control system 1305, the fluid control system 1320, the second gas valve 1328, the foam system 1317, and the chemical fire suppression agent control system 1334. The system controller 1324 includes a programmable input. The system controller 1324 is also configured, for example, to receive a sensed fluid flow rate from the fluid flow sensor 1321, a sensed fluid pressure from the fluid pressure sensor 1322, a sensed gas flow rate from the first gas flow sensor 1306, a sensed gas pressure from the gas pressure sensor 1307; a sensed chemical fire suppression agent flow rate from the chemical fire suppression agent flow sensor 1335; and a sensed chemical fire suppression agent pressure from the chemical fire suppression agent pressure sensor 1336. The system controller 1324 is also configured, for example, to output a first control signal to the fluid valve 1323 for regulating a fluid flow, a fluid pressure, or a combination thereof, and to output a second control signal to the first gas valve 1308 for regulating a gas flow relative to the sensed fluid flow, the sensed fluid pressure, or a combination thereof. The system controller 1324 automatically adjusts the first control signal and the second control signal to maintain a ratio of fluid flow to gas flow based upon the programmable input. The system controller 1324 is also configured, for example, to output a third control signal to the second gas valve 1328 for regulating the flow of gas to from the gas compressor 1303 to pressurize the chemical fire suppression agent reservoir 1330. The system controller 1324 is also configured, for example, to output a fourth control signal to the chemical fire suppression agent valve 1337 for regulating the flow of a chemical fire suppression agent. The system controller 1324 is also configured, for example, to output a fifth control signal to the foam system 1317 to control the output of the foam system 1317.

Figure 14:
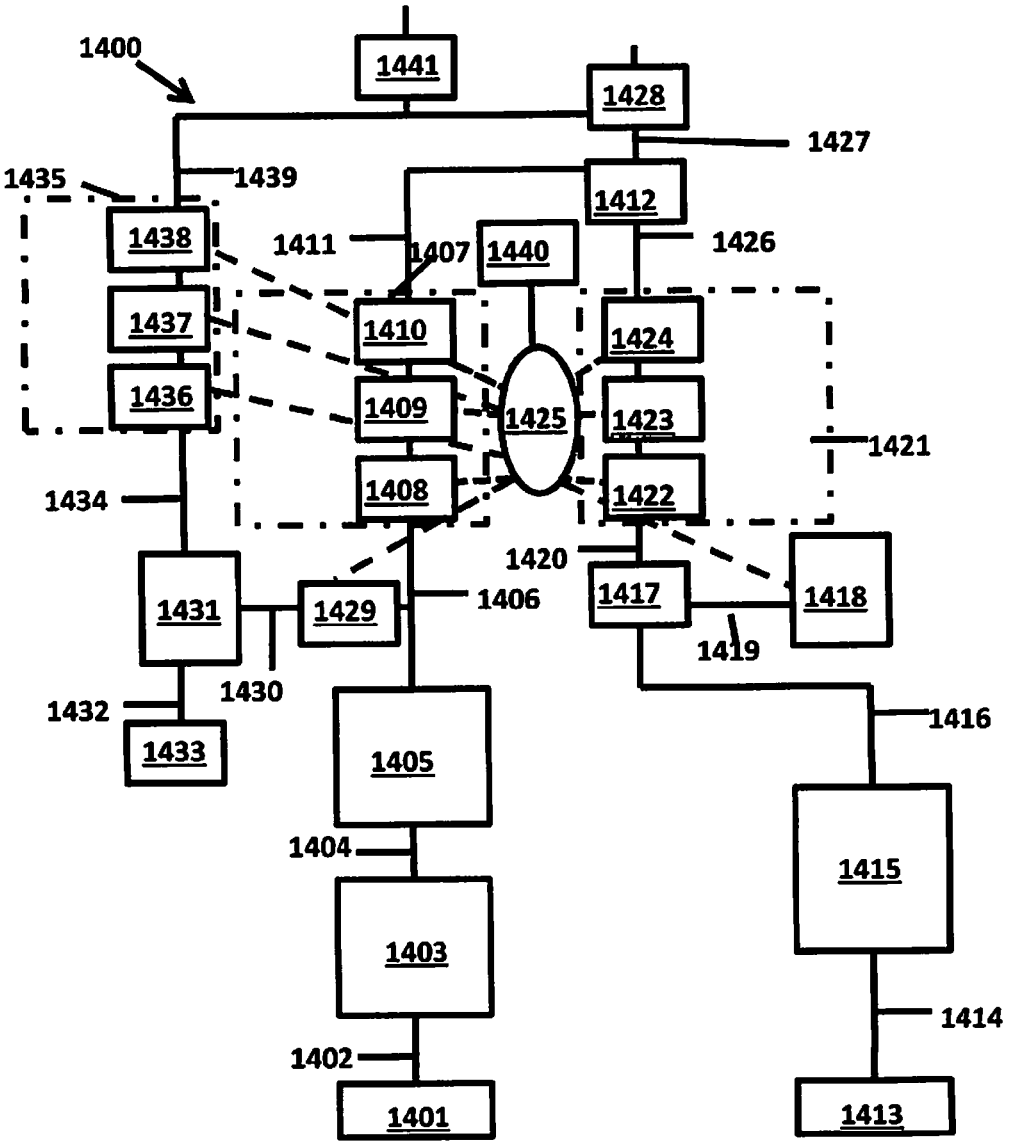
FIG. 14 is a block diagram illustrating an exemplary compressed gas foam system.

FIG. 14 is a block diagram illustrating an exemplary compressed gas foam system 1400. The compressed gas foam system 1400 includes a gas source 1401 coupled to conduit 1402, which provides fluid communication between the gas source 1401 and the gas compressor 1403. The gas compressor 1403 is coupled to conduit 1404, which provides fluid communication between the gas compressor 1403 and the gas control system 1407. The gas compressor 1405 is coupled to conduit 1406 to provide fluid communication to the gas control system 1407 and the valve 1429.

The gas control system 1407 includes the gas flow sensor 1408, the gas pressure sensor 1409, and the gas valve 1410. The gas flow sensor 1408 is in fluid communication with the gas pressure sensor 1409, which in turn is in fluid communication with the gas valve 1410. The gas valve 1410 is coupled to conduit 1411, which provides fluid communication between the gas valve 1410 and the first mixing device 1412.

In one embodiment, the gas compressors 1403 and 1405 are both single stage gas compressors. In another embodiment, the gas compressors 1403 and 1405 are both multistage gas compressors. In yet another embodiment, one of gas compressors 1403 and 1405 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 1400 also includes a fluid source 1413 coupled to conduit 1414, which provides fluid communication between the fluid source 1413 and the fluid pump 1415.

In one embodiment, the fluid pump 1415 is single stage fluid pump. In another embodiment, the fluid pump 1415 is a multistage fluid pump.

The fluid pump 1415 is coupled to conduit 1416, which provides fluid communication between the fluid pump 1415 and the second mixing device 1417. The second mixing device 1417 mixes the fluid from the fluid pump 1415 with a chemical foam mixture received from the foam system 1418 via the conduit 1419.

In one embodiment, the fluid is water. In another embodiment, the foam system 1418 is a single stage foam system. In yet another embodiment, the foam system 1418 is a multistage foam system. In still yet another embodiment, the foam system 1418 is a bladder-type foam system.

The second mixing device 1417 is coupled to conduit 1420, which provides fluid communication between the second mixing device 1417 and the fluid control system 1421. The fluid control system 1421 includes the fluid flow sensor 1422, the fluid pressure sensor 1423, and the fluid valve 1424. The fluid flow sensor 1422 is in fluid communication with the fluid pressure sensor 1423, which in turn is in fluid communication with the fluid valve 1424. The fluid valve 1424 is coupled to conduit 1426, which provides fluid communication between the fluid valve 1424 and the first mixing device 1412.

The first mixing device 1412 combines the gas received from the gas compressor 1405 with the mixture of fluid and chemical foam to produce compressed gas foam. The first mixing device 1412 is coupled to conduit 1427, which provides fluid communication between the first mixing device 1412 and the nozzle 1428. The nozzle 1428 is a liquid and chemical fire suppression agent nozzle for fire extinction. Suitable nozzles are described in U.S. Pat. Nos. 5,167,285 and 5,312,041.

The components of the gas control system 1407, for example, the gas flow sensor 1408, the gas pressure sensor 1409, and the gas valve 1410, are each independently coupled to send and receive signals from the system controller 1425. In a similar fashion, the components of the fluid control system 1421, for example, the fluid flow sensor 1422, the fluid pressure sensor 1423, and the fluid valve 1424 are each independently coupled to send and receive signals from the system controller 1425. In this manner, the system controller 1425 controls the ratio of gas to fluid by varying the flow of gas through the gas valve 1410 and the flow of fluid through fluid valve 1424.

The operator control panel and display 1440 receives and sends system status information from the system controller 1425. The system operator, for example, a fire truck engineer, can set controls manually with hand-operated valves and levers, or enters commands by way of the operator control panel and display 1440. In one embodiment, the operator control panel and display 1440 includes mechanical switches and digital displays. In another embodiment, the operator control panel and display 1440 includes a touch screen display. Touch screen displays are well known in the art and are electronic visual displays that can detect the presence and location of a touch within the display area. In another embodiment, the operator control panel and display 1440 includes an electronic visual display that can detect the presence of a light pen. These displays are also well known in the art.

The conduit 1406 is coupled to the valve 1429, which is in fluid communication with conduit 1430 leading to the chemical fire suppression agent reservoir 1431. The chemical fire suppression agent reservoir 1431 may contain a chemical suppression agent, typically a powder or a second inert fluid such as carbon dioxide. The chemical fire suppression agent reservoir 1431 is coupled to an optional pressurized gas container 1433, via the conduit 1432 which may provide a backup gas supply to propel the chemical fire suppression agent from the chemical fire suppression agent reservoir 1431 out to the nozzle 1428.

The chemical fire suppression agent reservoir 1431 is coupled to conduit 1434, which provides fluid communication between the chemical fire suppression agent reservoir 1431 and the chemical fire suppression agent control system 1435. The chemical fire suppression agent control system 1435 includes the chemical fire suppression agent flow sensor 1436, the chemical fire suppression agent pressure sensor 1437, and the chemical fire suppression agent valve 1438. The chemical fire suppression agent flow sensor 1436 is in fluid communication with the chemical fire suppression agent pressure sensor 1437, which in turn is in fluid communication with the chemical fire suppression agent valve 1438. The chemical fire suppression agent valve 1438 is coupled to conduit 1439, which provides fluid communication between the chemical fire suppression agent valve 1438, the optional outlet regulator 1441, and the nozzle 1428.

The system controller 1425 operatively coupled to the gas control system 1407, the fluid control system 1421, the second gas valve 1429, the foam system 1418, and the chemical fire suppression agent control system 1435. The system controller 1425 includes a programmable input. The system controller 1425 is also configured, for example, to receive a sensed fluid flow rate from the fluid flow sensor 1422, a sensed fluid pressure from the fluid pressure sensor 1423, a sensed gas flow rate from the first gas flow sensor 1408, a sensed gas pressure from the gas pressure sensor 1409; a sensed chemical fire suppression agent flow rate from the chemical fire suppression agent flow sensor 1436; and a sensed chemical fire suppression agent pressure from the chemical fire suppression agent pressure sensor 1437. The system controller 1425 is also configured, for example, to output a first control signal to the fluid valve 1424 for regulating a fluid flow, a fluid pressure, or a combination thereof, and to output a second control signal to the first gas valve 1410 for regulating a gas flow relative to the sensed fluid flow, the sensed fluid pressure, or a combination thereof. The system controller 1425 automatically adjusts the first control signal and the second control signal to maintain a ratio of fluid flow to gas flow based upon the programmable input. The system controller 1425 is also configured, for example, to output a third control signal to the second gas valve 1429 for regulating the flow of gas to from the gas compressor 1405 to pressurize the chemical fire suppression agent reservoir 1431. The system controller 1425 is also configured, for example, to output a fourth control signal to the chemical fire suppression agent valve 1438 for regulating the flow of a chemical fire suppression agent. The system controller 1425 is also configured, for example, to output a fifth control signal to the foam system 1418 to control the output of the foam system 1418.

Figure 15:
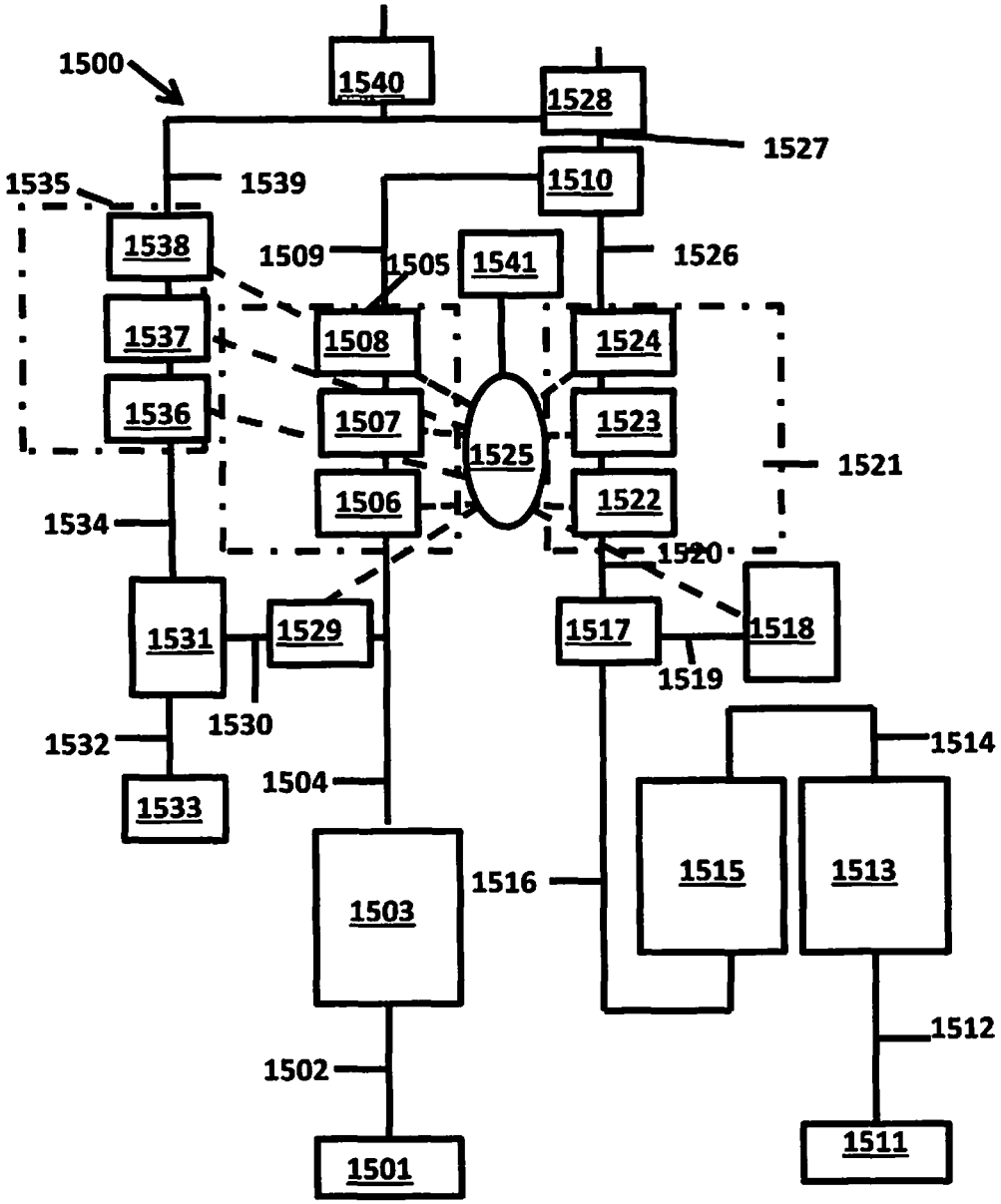
FIG. 15 is a block diagram illustrating an exemplary compressed gas foam system.

FIG. 15 is a block diagram illustrating an exemplary compressed gas foam system 1500. The compressed gas foam system 1500 includes a gas source 1501 coupled to conduit 1502, which provides fluid communication between the gas source 1501 and the gas compressor 1503. The gas compressor 1503 is coupled to conduit 1504, which provides fluid communication between the gas compressor 1503, the gas control system 1505, and the valve 1529.

In one embodiment, the gas compressor 1503 is a single stage gas compressor. In another embodiment, the gas compressor 1503 is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas control system 1505 includes the gas flow sensor 1506, the gas pressure sensor 1507, and the gas valve 1508. The gas flow sensor 1506 is in fluid communication with the gas pressure sensor 1507, which in turn is in fluid communication with the gas valve 1508. The gas valve 1508 is coupled to conduit 1509, which provides fluid communication between the gas valve 1508 and the first mixing device 1510.

The compressed gas foam system 1500 also includes a fluid source 1511, which is coupled to conduit 1512, which provides fluid communication between the fluid source 1511, the fluid pump 1513, the conduit 1514, and the fluid pump 1515.

In one embodiment, the fluid pumps 1513 and 1515 are both single stage fluid pumps. In another embodiment, the fluid pumps 1513 and 1515 are both multistage fluid pumps. In one embodiment, fluid pump 1513 is a single stage fluid pump and fluid pump 1515 is a multistage fluid pump. In one embodiment, fluid pump 1513 is a multi-stage fluid pump and fluid pump 1515 is a single stage fluid pump.

The fluid pump 1515 is coupled to conduit 1516, which provides fluid communication between fluid pump 1515 and the second mixing device 1517. The second mixing device 1517 mixes the fluid from the fluid pump 1515 with a chemical foam mixture received from the foam system 1518 via the conduit 1519.

In one embodiment, the fluid is water. In another embodiment, the foam system 1518 is a single stage foam system. In yet another embodiment, the foam system 1518 is a multistage foam system. In still yet another embodiment, the foam system 1518 is a bladder-type foam system.

The second mixing device 1517 is coupled to conduit 1520, which provides fluid communication between the second mixing device 1517 and the fluid control system 1521. The fluid control system 1521 includes the fluid flow sensor 1522, the fluid pressure sensor 1523, and the fluid valve 1524. The fluid flow sensor 1522 is in fluid communication with the fluid pressure sensor 1523, which in turn is in fluid communication with the fluid valve 1524. The fluid valve 1524 is coupled to conduit 1526, which provides fluid communication between the fluid valve 1524 and the first mixing device 1510.

The first mixing device 1510 combines the gas received from the gas compressor 1503 with the mixture of fluid and chemical foam to produce compressed gas foam. The first mixing device 1510 is coupled to conduit 1527, which provides fluid communication between the first mixing device 1510 and the nozzle 1528. The nozzle 1528 is a liquid and chemical fire suppression agent nozzle for fire extinction. Suitable nozzles are described in U.S. Pat. Nos. 5,167,285 and 5,312,041.

The components of the gas control system 1505, for example, the gas flow sensor 1506, the gas pressure sensor 1507, and the gas valve 1508, are each independently coupled to send and receive signals from the system controller 1525. In a similar fashion, the components of the fluid control system 1521, for example, the fluid flow sensor 1522, the fluid pressure sensor 1523, and the fluid valve 1524 are each independently coupled to send and receive signals from the system controller 1525. In this manner, the system controller 1525 controls the ratio of gas to fluid by varying the flow of gas through the gas valve 1508 and the flow of fluid through fluid valve 1524.

The operator control panel and display 1541 receives and sends system status information from the system controller 1525. The system operator, for example, a fire truck engineer, can set controls manually with hand-operated valves and levers, or enters commands by way of the operator control panel and display 1541. In one embodiment, the operator control panel and display 1541 includes mechanical switches and digital displays. In another embodiment, the operator control panel and display 1541 includes a touch screen display. Touch screen displays are well known in the art and are electronic visual displays that can detect the presence and location of a touch within the display area. In another embodiment, the operator control panel and display 1541 includes an electronic visual display that can detect the presence of a light pen. These displays are also well known in the art.

The conduit 1504 is coupled to the valve 1529, which is in fluid communication with conduit 1530 leading to the chemical fire suppression agent reservoir 1531. The chemical fire suppression agent reservoir 1531 may contain a chemical suppression agent, typically a powder or a second inert fluid such as carbon dioxide. The chemical fire suppression agent reservoir 1531 is coupled to an optional pressurized gas container 1533 via the conduit 1532, which may provide a back-up gas supply to propel the chemical fire suppression agent from the chemical fire suppression agent reservoir 1531 out to the nozzle 1528.

The chemical tire suppression agent reservoir 1531 is coupled to conduit 1534, which provides fluid communication between the chemical fire suppression agent reservoir 1531 and the chemical fire suppression agent control system 1535. The chemical fire suppression agent control system 1535 includes the chemical fire suppression agent flow sensor 1536, the chemical fire suppression agent pressure sensor 1537, and the chemical fire suppression agent valve 1538. The chemical fire suppression agent flow sensor 1536 is in fluid communication with the chemical fire suppression agent pressure sensor 1537, which in turn is in fluid communication with the chemical fire suppression agent valve 1538. The chemical fire suppression agent valve 1538 is coupled to conduit 1539, which provides fluid communication between the chemical fire suppression agent valve 1538, the optional outlet regulator 1540, and the nozzle 1528.

The system controller 1525 operatively coupled to the gas control system 1505, the fluid control system 1521, the second gas valve 1529, the foam system 1518, and the chemical fire suppression agent control system 1535. The system controller 1525 includes a programmable input. The system controller 1525 is also configured, for example, to receive a sensed fluid flow rate from the fluid flow sensor 1522, a sensed fluid pressure from the fluid pressure sensor 1523, a sensed gas flow rate from the first gas flow sensor 1506, a sensed gas pressure from the gas pressure sensor 1507; a sensed chemical fire suppression agent flow rate from the chemical fire suppression agent flow sensor 1536; and a sensed chemical fire suppression agent pressure from the chemical fire suppression agent pressure sensor 1537. The system controller 1525 is also configured, for example, to output a first control signal to the fluid valve 1524 for regulating a fluid flow, a fluid pressure, or a combination thereof, and to output a second control signal to the first gas valve 1508 for regulating a gas flow relative to the sensed fluid flow, the sensed fluid pressure, or a combination thereof. The system controller 1525 automatically adjusts the first control signal and the second control signal to maintain a ratio of fluid flow to gas flow based upon the programmable input. The system controller 1525 is also configured, for example, to output a third control signal to the second gas valve 1529 for regulating the flow of gas to from the gas compressor 1503 to pressurize the chemical fire suppression agent reservoir 1531. The system controller 1525 is also configured, for example, to output a fourth control signal to the chemical fire suppression agent valve 1538 for regulating the flow of a chemical fire suppression agent. The system controller 1525 is also configured, for example, to output a fifth control signal to the foam system 1518 to control the output of the foam system 1518.

Figure 16:
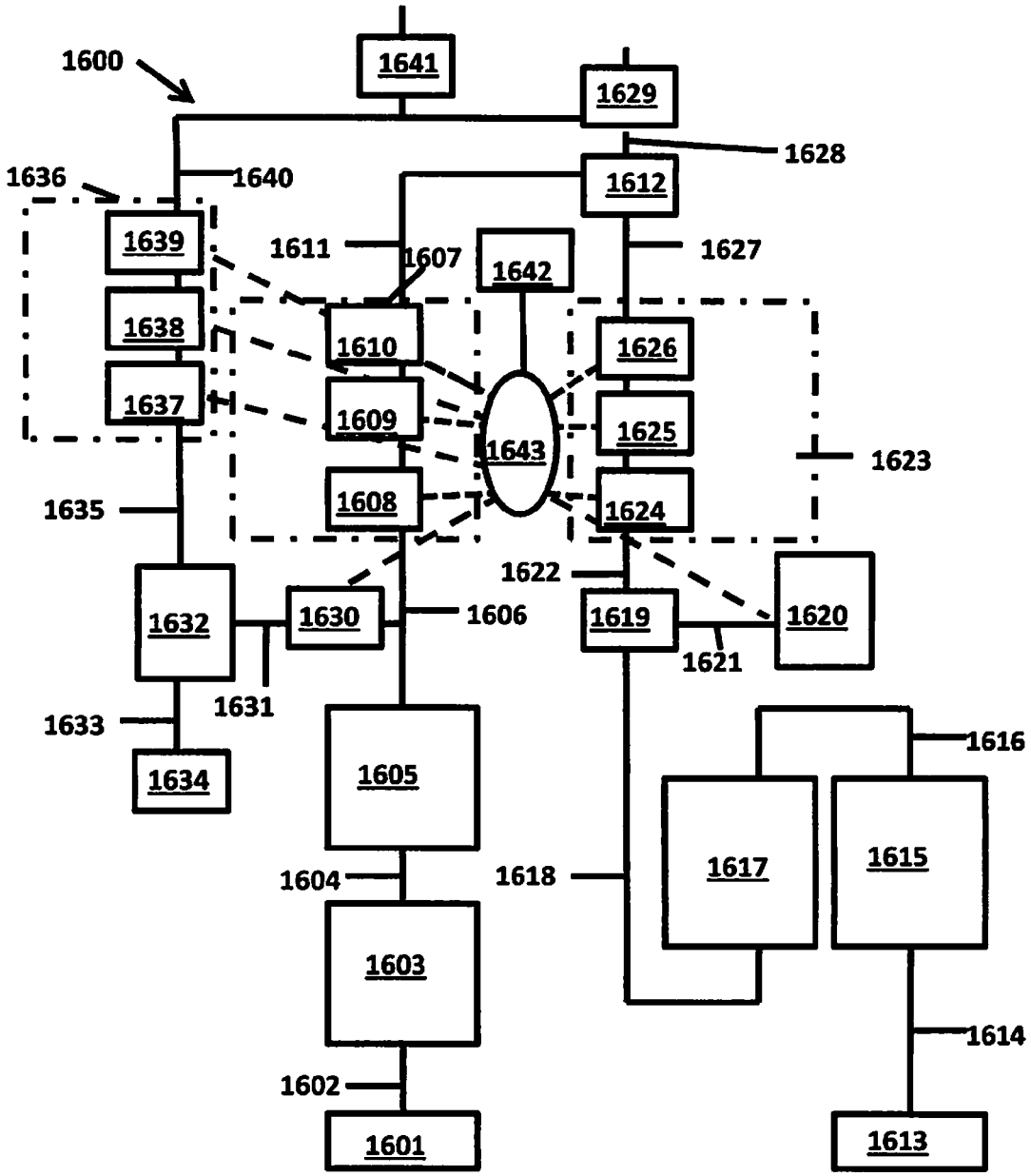
FIG. 16 is a block diagram illustrating an exemplary compressed gas foam system.

FIG. 16 is a block diagram illustrating an exemplary compressed gas foam system 1600. The compressed gas foam system 1600 includes a gas source 1601 coupled to conduit 1602, which provides fluid communication between the gas source 1601 and the gas compressor 1603. The gas compressor 1603 is coupled to conduit 1604, which provides fluid communication between the gas compressor 1603 and the gas compressor 1605.

In one embodiment, the gas compressors 1603 and 1605 are both single stage gas compressors. In another embodiment, the gas compressors 1603 and 1605 are both multistage gas compressors. In yet another embodiment, one of gas compressors 1603 and 1605 is a single stage gas compressor and the other gas compressor is a multistage gas compressor.

Gas compressor 1605 is coupled to conduit 1606, which provides fluid communication between the gas compressor 1605 and the gas control system 1607. The gas control system 1607 includes the gas flow sensor 1608, the gas pressure sensor 1609, and the gas valve 1610. The gas flow sensor 1608 is in fluid communication with the gas pressure sensor 1609, which in turn is in fluid communication with the gas valve 1610. The gas valve 1610 is coupled to conduit 1611, which provides fluid communication between the gas valve 1610 and the first mixing device 1612.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The compressed gas foam system 1600 also includes a fluid source 1613 coupled to conduit 1614, which provides fluid communication between the fluid source 1613 and a fluid pump 1615.

Fluid pump 1615 is coupled to conduit 1616, which provided fluid communication between fluid pump 1615 and fluid pump 1617.

In one embodiment, fluid pump 1615 and fluid pump 1617 are both single stage fluid pumps. In another embodiment, fluid pump 1615 and fluid pump 1617 are both multistage fluid pumps.

In one embodiment, fluid pump 1615 is a single stage fluid pump and fluid pump 1617 is a multistage fluid pump. In another embodiment, fluid pump 1615 is a multistage fluid pump and fluid pump 1617 is a single stage fluid pump.

Fluid pump 1617 is coupled to conduit 1618, which provides fluid communication between fluid pump 1617 and the second mixing device 1619. The second mixing device 1619 mixes the fluid from the fluid pump 1617 with a chemical foam mixture received from the foam system 1620 via the conduit 1621.

In one embodiment, the fluid is water. In another embodiment, the foam system 1620 is a single stage foam system. In yet another embodiment, the foam system 1620 is a multistage foam system. In still yet another embodiment, the foam system 1620 is a bladder-type foam system.

The second mixing device 1619 is coupled to conduit 1622, which provides fluid communication between the second mixing device 1619 and the fluid control system 1623. The fluid control system 1623 includes the fluid flow sensor 1624, the fluid pressure sensor 1625, and the fluid valve 1626. The fluid flow sensor 1624 is in fluid communication with the fluid pressure sensor 1625, which in turn is in fluid communication with the fluid valve 1626. The fluid valve 1626 is coupled to conduit 1627, which provides fluid communication between the fluid valve 1626 and the first mixing device 1612.

The first mixing device 1612 combines the gas received from the gas compressor 1605 with the mixture of fluid and chemical foam to produce compressed gas foam. The first mixing device 1612 is coupled to conduit 1628, which provides fluid communication between the first mixing device 1612 and the nozzle 1629. The nozzle 1629 is a liquid and chemical fire suppression agent nozzle for fire extinction. Suitable nozzles are described in U.S. Pat. Nos. 5,167,285 and 5,312,041.

The components of the gas control system 1607, for example, the gas flow sensor 1608, the gas pressure sensor 1609, and the gas valve 1610, are each independently coupled to send and receive signals from the system controller 1643. In a similar fashion, the components of the fluid control system 1623, for example, the fluid flow sensor 1624, the fluid pressure sensor 1625, and the fluid valve 1626 are each independently coupled to send and receive signals from the system controller 1643. In this manner, the system controller 1643 controls the ratio of gas to fluid by varying the flow of gas through the gas valve 1610 and the flow of fluid through fluid valve 1626.

The operator control panel and display 1642 receives and sends system status information from the system controller 1643. The system operator, for example, a fire truck engineer, can set controls manually with hand-operated valves and levers, or enters commands by way of the operator control panel and display 1642. In one embodiment, the operator control panel and display 1642 includes mechanical switches and digital displays. In another embodiment, the operator control panel and display 1642 includes a touch screen display. Touch screen displays are well known in the art and are electronic visual displays that can detect the presence and location of a touch within the display area. In another embodiment, the operator control panel and display 1642 includes an electronic visual display that can detect the presence of a light pen. These displays are also well known in the art.

The conduit 1606 is coupled to the valve 1630, which is in fluid communication with conduit 1631 leading to the chemical fire suppression agent reservoir 1632. The chemical fire suppression agent reservoir 1632 may contain a chemical suppression agent, typically a powder or a second inert fluid such as carbon dioxide. The chemical fire suppression agent reservoir 1632 is coupled to an optional pressurized gas container 1634 via the conduit 1633, which may provide a backup gas supply to propel the chemical fire suppression agent from the chemical fire suppression agent reservoir 1632 out to the nozzle 1629.

The chemical fire suppression agent reservoir 1632 is coupled to conduit 1635, which provides fluid communication between the chemical fire suppression agent reservoir 1632 and the chemical fire suppression agent control system 1636. The chemical fire suppression agent control system 1636 includes the chemical fire suppression agent flow sensor 1637, the chemical fire suppression agent pressure sensor 1638, and the chemical fire suppression agent valve 1639. The chemical fire suppression agent flow sensor 1637 is in fluid communication with the chemical fire suppression agent pressure sensor 1638, which in turn is in fluid communication with the chemical fire suppression agent valve 1639. The chemical fire suppression agent valve 1639 is coupled to conduit 1640, which provides fluid communication between the chemical fire suppression agent valve 1639, the optional outlet regulator 1641, and the nozzle 1629.

The system controller 1643 operatively coupled to the gas control system 1607, the fluid control system 1623, the second gas valve 1630, the foam system 1620, and the chemical fire suppression agent control system 1636. The system controller 1643 includes a programmable input. The system controller 1643 is also configured, for example, to receive a sensed fluid flow rate from the fluid flow sensor 1624, a sensed fluid pressure from the fluid pressure sensor 1625, a sensed gas flow rate from the first gas flow sensor 1608, a sensed gas pressure from the gas pressure sensor 1609; a sensed chemical fire suppression agent flow rate from the chemical fire suppression agent flow sensor 1637; and a sensed chemical fire suppression agent pressure from the chemical fire suppression agent pressure sensor 1638. The system controller 1643 is also configured, for example, to output a first control signal to the fluid valve 1626 for regulating a fluid flow, a fluid pressure, or a combination thereof, and to output a second control signal to the first gas valve 1610 for regulating a gas flow relative to the sensed fluid flow, the sensed fluid pressure, or a combination thereof. The system controller 1643 automatically adjusts the first control signal and the second control signal to maintain a ratio of fluid flow to gas flow based upon the programmable input. The system controller 1643 is also configured, for example, to output a third control signal to the second gas valve 1630 for regulating the flow of gas to from the gas compressor 1605 to pressurize the chemical fire suppression agent reservoir 1632. The system controller 1643 is also configured, for example, to output a fourth control signal to the chemical fire suppression agent valve 1639 for regulating the flow of a chemical fire suppression agent. The system controller 1643 is also configured, for example, to output a fifth control signal to the foam system 1620 to control the output of the foam system 1620.

Figure 17:
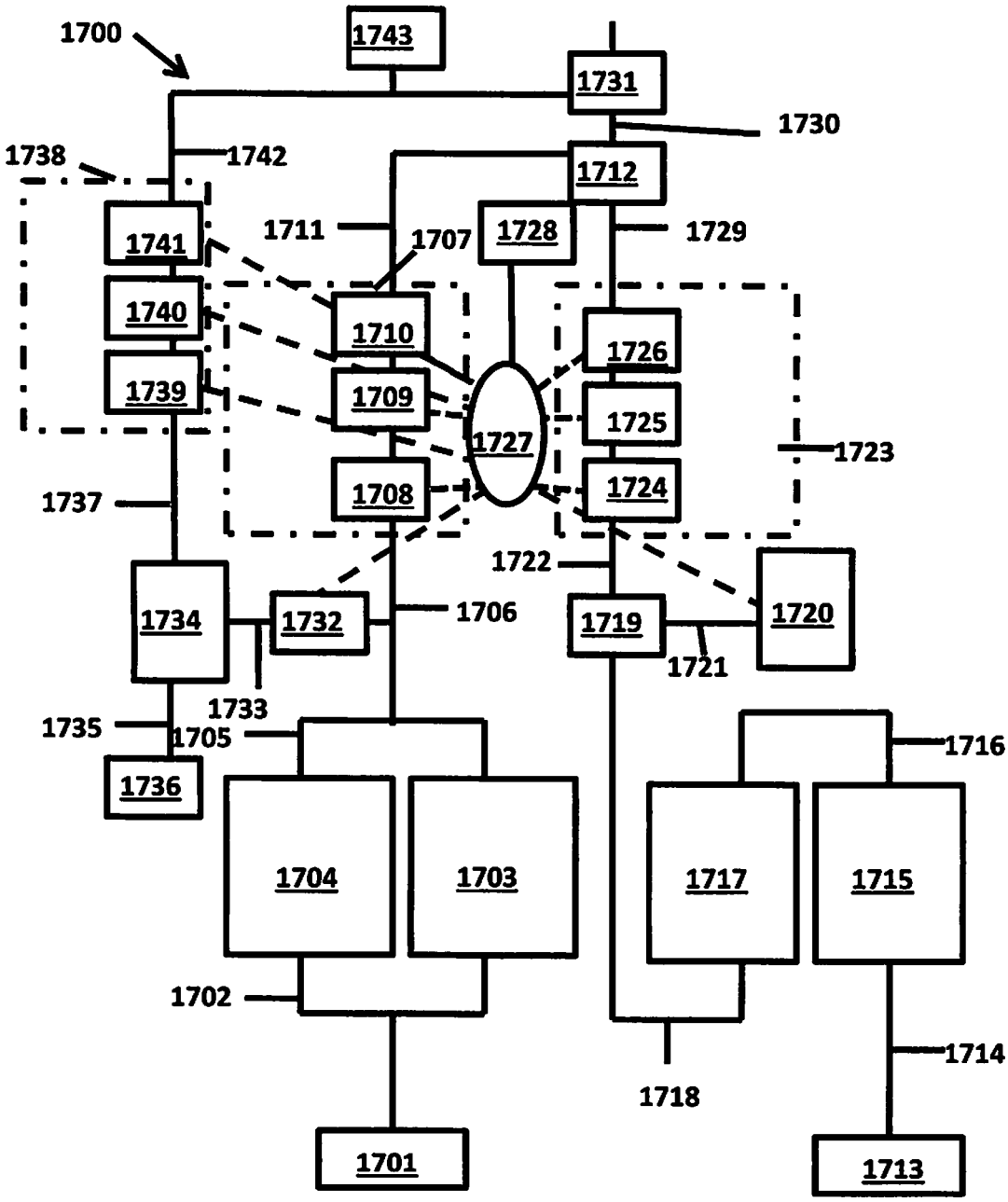
FIG. 17 is a block diagram illustrating an exemplary compressed gas foam system.

FIG. 17 is a block diagram illustrating an exemplary compressed gas foam system 1700. The compressed gas foam system 1700 includes a gas source 1701 coupled to conduit 1702, which provides fluid communication between the gas source 1701 and the gas compressors 1703 and 1704.

In one embodiment, the gas compressors 1703 and 1704 are both single stage gas compressors. In another embodiment, the gas compressors 1703 and 1704 are both multistage gas compressors. In yet another embodiment, one of gas compressors 1703 and 1704 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The conduit 1705 is coupled to conduit 1706, which provides fluid communication between the conduit 1705 and the gas control system 1707. The gas control system 1707 includes the gas flow sensor 1708, the gas pressure sensor 1709, and the gas valve 1710. The gas flow sensor 1708 is in fluid communication with the gas pressure sensor 1709, which in turn is in fluid communication with the gas valve 1710. The gas valve 1710 is coupled to conduit 1711, which provides fluid communication between the gas valve 1710 and the first mixing device 1712.

The compressed gas foam system 1700 also includes a fluid source 1713 coupled to conduit 1714, which provides fluid communication between the fluid source 1713 and a fluid pump 1715.

Fluid pump 1715 is coupled to conduit 1716, which provided fluid communication between fluid pump 1715 and fluid pump 1717.

In one embodiment, fluid pump 1715 and fluid pump 1717 are both single stage fluid pumps. In another embodiment, fluid pump 1715 and fluid pump 1717 are both multistage fluid pumps.

In one embodiment, fluid pump 1715 is a single stage fluid pump and fluid pump 1717 is a multistage fluid pump. In another embodiment, fluid pump 1715 is a multistage fluid pump and fluid pump 1717 is a single stage fluid pump.

Fluid pump 1717 is coupled to conduit 1718, which provides fluid communication between fluid pump 1717 and the second mixing device 1719. The second mixing device 1719 mixes the fluid from the fluid pump 1717 with a chemical foam mixture received from the foam system 1720 via the conduit 1721.

In one embodiment, the fluid is water. In another embodiment, the foam system 1720 is a single stage foam system. In yet another embodiment, the foam system 1720 is a multistage foam system. In still yet another embodiment, the foam system 1720 is a bladder-type foam system.

The second mixing device 1719 is coupled to conduit 1722, which provides fluid communication between the second mixing device 1719 and the fluid control system 1723. The fluid control system 1723 includes the fluid flow sensor 1724, the fluid pressure sensor 1725, and the fluid valve 1726. The fluid flow sensor 1724 is in fluid communication with the fluid pressure sensor 1725, which in turn is in fluid communication with the fluid valve 1726. The fluid valve 1726 is coupled to conduit 1729, which provides fluid communication between the fluid valve 1726 and the first mixing device 1712.

The first mixing device 1712 combines the gas received from the gas compressors 1703 and 1704 with the mixture of fluid and chemical foam to produce compressed gas foam. The first mixing device 1712 is coupled to conduit 1730, which provides fluid communication between the first mixing device 1712 and the nozzle 1731. The nozzle 1731 is a liquid and chemical fire suppression agent nozzle for fire extinction. Suitable nozzles are described in U.S. Pat. Nos. 5,167,285 and 5,312,041.

The components of the gas control system 1707, for example, the gas flow sensor 1708, the gas pressure sensor 1709, and the gas valve 1710, are each independently coupled to send and receive signals from the system controller 1727. In a similar fashion, the components of the fluid control system 1723, for example, the fluid flow sensor 1724, the fluid pressure sensor 1725, and the fluid valve 1726 are each independently coupled to send and receive signals from the system controller 1727. In this manner, the system controller 1727 controls the ratio of gas to fluid by varying the flow of gas through the gas valve 1710 and the flow of fluid through fluid valve 1726.

The operator control panel and display 1728 receives and sends system status information from the system controller 1727. The system operator, for example, a fire truck engineer, can set controls manually with hand-operated valves and levers, or enters commands by way of the operator control panel and display 1728. In one embodiment, the operator control panel and display 1728 includes mechanical switches and digital displays. In another embodiment, the operator control panel and display 1728 includes a touch screen display. Touch screen displays are well known in the art and are electronic visual displays that can detect the presence and location of a touch within the display area. In another embodiment, the operator control panel and display 1728 includes an electronic visual display that can detect the presence of a light pen. These displays are also well known in the art.

The conduit 1706 is coupled to the valve 1732, which is in fluid communication with conduit 1733 leading to the chemical fire suppression agent reservoir 1734. The chemical fire suppression agent reservoir 1734 may contain a chemical suppression agent, typically a powder or a second inert fluid such as carbon dioxide. The chemical fire suppression agent reservoir 1734 is coupled to an optional pressurized gas container 1736 via the conduit 1735, which may provide a back-up gas supply to propel the chemical fire suppression agent from the chemical fire suppression agent reservoir 1734 out to the nozzle 1731.

The chemical fire suppression agent reservoir 1734 is coupled to conduit 1737, which provides fluid communication between the chemical fire suppression agent reservoir 1734 and the chemical fire suppression agent control system 1738. The chemical fire suppression agent control system 1738 includes the chemical fire suppression agent flow sensor 1739, the chemical fire suppression agent pressure sensor 1740, and the chemical fire suppression agent valve 1741. The chemical fire suppression agent flow sensor 1739 is in fluid communication with the chemical fire suppression agent pressure sensor 1740, which in turn is in fluid communication with the chemical fire suppression agent valve 1741. The chemical fire suppression agent valve 1741 is coupled to conduit 1742, which provides fluid communication between the chemical fire suppression agent valve 1741, the optional outlet regulator 1743, and the nozzle 1731.

The system controller 1727 operatively coupled to the gas control system 1707, the fluid control system 1723, the second gas valve 1732, the foam system 1720, and the chemical fire suppression agent control system 1738. The system controller 1727 includes a programmable input. The system controller 1727 is also configured, for example, to receive a sensed fluid flow rate from the fluid flow sensor 1724, a sensed fluid pressure from the fluid pressure sensor 1725, a sensed gas flow rate from the first gas flow sensor 1708, a sensed gas pressure from the gas pressure sensor 1709; a sensed chemical fire suppression agent flow rate from the chemical fire suppression agent flow sensor 1739; and a sensed chemical fire suppression agent pressure from the chemical fire suppression agent pressure sensor 1740. The system controller 1727 is also configured, for example, to output a first control signal to the fluid valve 1726 for regulating a fluid flow, a fluid pressure, or a combination thereof, and to output a second control signal to the first gas valve 1710 for regulating a gas flow relative to the sensed fluid flow, the sensed fluid pressure, or a combination thereof. The system controller 1727 automatically adjusts the first control signal and the second control signal to maintain a ratio of fluid flow to gas flow based upon the programmable input. The system controller 1727 is also configured, for example, to output a third control signal to the second gas valve 1732 for regulating the flow of gas to from the gas compressors 1703 and 1704 to pressurize the chemical fire suppression agent reservoir 1734. The system controller 1727 is also configured, for example, to output a fourth control signal to the chemical fire suppression agent valve 1741 for regulating the flow of a chemical fire suppression agent. The system controller 1727 is also configured, for example, to output a fifth control signal to the foam system 1720 to control the output of the foam system 1720.

Figure 18:
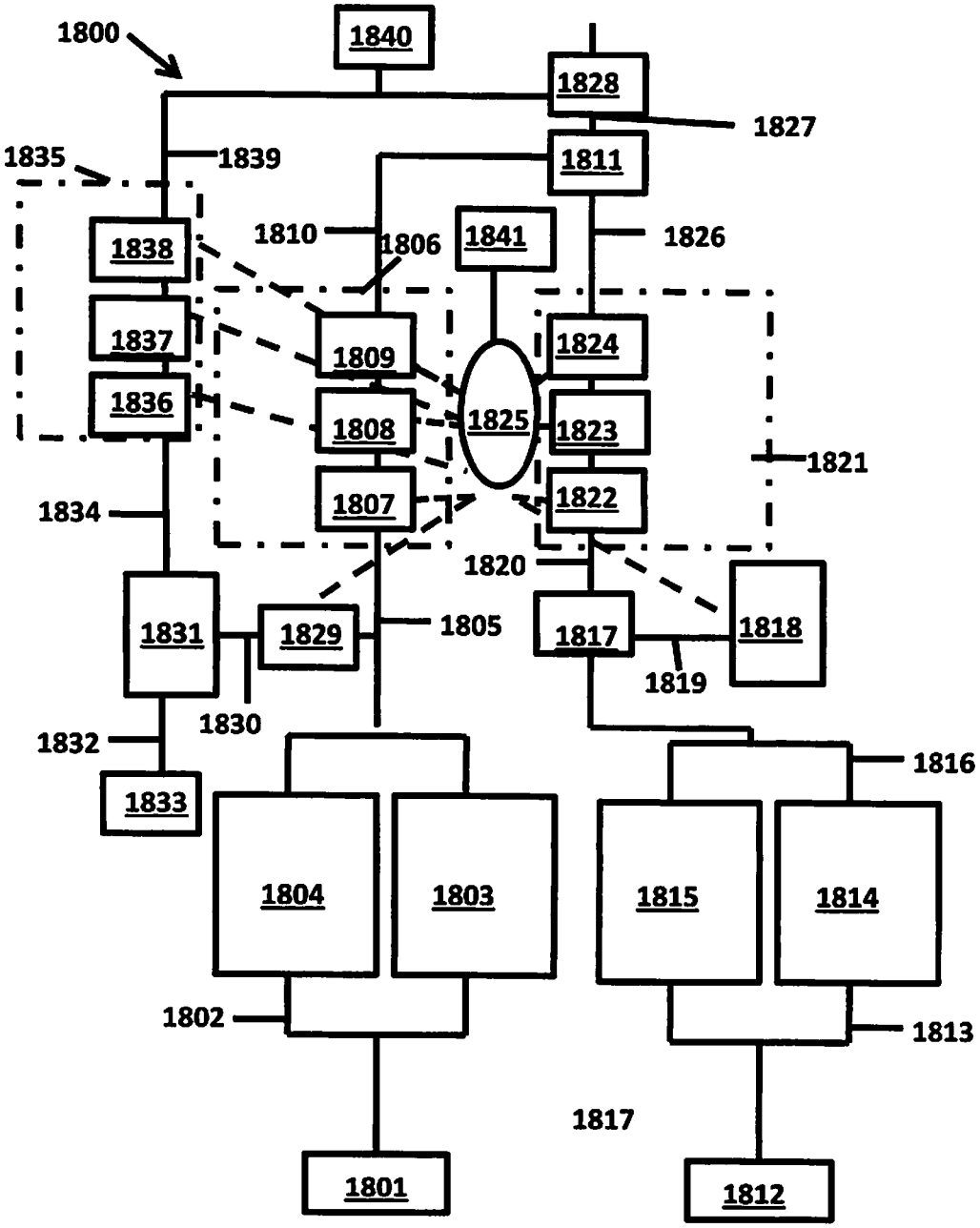
FIG. 18 is a block diagram illustrating an exemplary compressed gas foam system.

FIG. 18 is a block diagram illustrating an exemplary compressed gas foam system 1800. The compressed gas foam system 1800 includes a gas source 1801 coupled to conduit 1802, which provides fluid communication between the gas source 1801 and gas compressor 1803 and gas compressor 1804.

In one embodiment, the gas compressors 1803 and 1804 are both single stage gas compressors. In another embodiment, the gas compressors 1803 and 1804 are both multistage gas compressors. In yet another embodiment, one of gas compressors 1803 and 1804 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressors 1803 and 1804 are coupled to conduit 1805, which provides fluid communication between the gas compressor 1803 and gas compressor 1804 and the gas control system 1806. The gas control system 1806 includes the gas flow sensor 1807, the gas pressure sensor 1808, and the gas valve 1809. The gas flow sensor 1807 is in fluid communication with the gas pressure sensor 1808, which in turn is in fluid communication with the gas valve 1809. The gas valve 1809 is coupled to conduit 1810, which provides fluid communication between the gas valve 1809 and the first mixing device 1811.

The compressed gas foam system 1800 also includes a fluid source 1812 coupled to conduit 1813, which provides fluid communication between the fluid source 1812 and the fluid pumps 1814 and 1815.

In one embodiment, the fluid pumps 1814 and 1815 are both single stage fluid pumps. In another embodiment, the fluid pumps 1814 and 1815 are both multistage fluid pumps. In one embodiment, fluid pump 1814 is a single stage fluid pump and fluid pump 1815 is a multistage fluid pump. In one embodiment, fluid pump 1814 is a multi-stage fluid pump and fluid pump 1815 is a single stage fluid pump.

The fluid pumps 1814 and 1815 are coupled to conduit 1816, which provides fluid communication between fluid pumps 1814 and 1815 and the second mixing device 1817. The second mixing device 1817 mixes the fluid from the fluid pumps 1814 and 1815 with a chemical foam mixture received from the foam system 1818 via the conduit 1819. The second mixing device 1817 is coupled to conduit 1820, which provides fluid communication between the second mixing device 1817 and the fluid control system 1821. The fluid control system 1821 includes the fluid flow sensor 1822, the fluid pressure sensor 1823, and the fluid valve 1824. The fluid flow sensor 1822 is in fluid communication with the fluid pressure sensor 1823, which in turn is in fluid communication with the fluid valve 1824. The fluid valve 1824 is coupled to conduit 1826, which provides fluid communication between the fluid valve 1824 and the first mixing device 1811.

The first mixing device 1811 combines the gas received from the gas compressors 1803 and 1804 with the mixture of fluid and chemical foam to produce compressed gas foam. The first mixing device 1811 is coupled to conduit 1827, which provides fluid communication between the first mixing device 1811 and the nozzle 1828. The nozzle 1828 is a liquid and chemical fire suppression agent nozzle for fire extinction. Suitable nozzles are described in U.S. Pat. Nos. 5,167,285 and 5,312,041.

The components of the gas control system 1806, for example, the gas flow sensor 1807, the gas pressure sensor 1808, and the gas valve 1809, are each independently coupled to send and receive signals from the system controller 1825. In a similar fashion, the components of the fluid control system 1821, for example, the fluid flow sensor 1822, the fluid pressure sensor 1823, and the fluid valve 1824 are each independently coupled to send and receive signals from the system controller 1825. In this manner, the system controller

1825 controls the ratio of gas to fluid by varying the flow of gas through the gas valve 1809 and the flow of fluid through fluid valve 1824.

The operator control panel and display 1841 receives and sends system status information from the system controller 1825. The system operator, for example, a fire truck engineer, can set controls manually with hand-operated valves and levers, or enters commands by way of the operator control panel and display 1841. In one embodiment, the operator control panel and display 1841 includes mechanical switches and digital displays. In another embodiment, the operator control panel and display 1841 includes a touch screen display. Touch screen displays are well known in the art and are electronic visual displays that can detect the presence and location of a touch within the display area. In another embodiment, the operator control panel and display 1841 includes an electronic visual display that can detect the presence of a light pen. These displays are also well known in the art.

The conduit 1805 is coupled to the valve 1829, which is in fluid communication with conduit 1830 leading to the chemical fire suppression agent reservoir 1831. The chemical fire suppression agent reservoir 1831 may contain a chemical suppression agent, typically a powder or a second inert fluid such as carbon dioxide. The chemical fire suppression agent reservoir 1831 is coupled to an optional pressurized gas container 1833 via the conduit 1832, which may provide a back-up gas supply to propel the chemical fire suppression agent from the chemical fire suppression agent reservoir 1831 out to the nozzle 1828.

The chemical fire suppression agent reservoir 1831 is coupled to conduit 1834, which provides fluid communication between the chemical fire suppression agent reservoir 1831 and the chemical fire suppression agent control system 1835. The chemical fire suppression agent control system 1835 includes the chemical fire suppression agent flow sensor 1836, the chemical fire suppression agent pressure sensor 1837, and the chemical fire suppression agent valve 1838. The chemical fire suppression agent flow sensor 1836 is in fluid communication with the chemical fire suppression agent pressure sensor 1837, which in turn is in fluid communication with the chemical fire suppression agent valve 1838. The chemical fire suppression agent valve 1838 is coupled to conduit 1839, which provides fluid communication between the chemical fire suppression agent valve 1838, the optional outlet regulator 1840, and the nozzle 1828.

The system controller 1825 operatively coupled to the gas control system 1806, the fluid control system 1821, the second gas valve 1829, the foam system 1818, and the chemical fire suppression agent control system 1835. The system controller 1825 includes a programmable input. The system controller 1825 is also configured, for example, to receive a sensed fluid flow rate from the fluid flow sensor 1822, a sensed fluid pressure from the fluid pressure sensor 1823, a sensed gas flow rate from the first gas flow sensor 1807, a sensed gas pressure from the gas pressure sensor 1808; a sensed chemical fire suppression agent flow rate from the chemical fire suppression agent flow sensor 1836; and a sensed chemical fire suppression agent pressure from the chemical fire suppression agent pressure sensor 1837. The system controller 1825 is also configured, for example, to output a first control signal to the fluid valve 1824 for regulating a fluid flow, a fluid pressure, or a combination thereof, and to output a second control signal to the first gas valve 1809 for regulating a gas flow relative to the sensed fluid flow, the sensed fluid pressure, or a combination thereof. The system controller 1825 automatically adjusts the first control signal and the second control signal to maintain a ratio of fluid flow to gas flow based upon the programmable input. The system controller 1825 is also configured, for example, to output a third control signal to the second gas valve 1829 for regulating the flow of gas to from the gas compressors 1803 and 1804 to pressurize the chemical fire suppression agent reservoir 1831. The system controller 1825 is also configured, for example, to output a fourth control signal to the chemical fire suppression agent valve 1838 for regulating the flow of a chemical fire suppression agent. The system controller 1825 is also configured, for example, to output a fifth control signal to the foam system 1818 to control the output of the foam system 1818.

Figure 19:
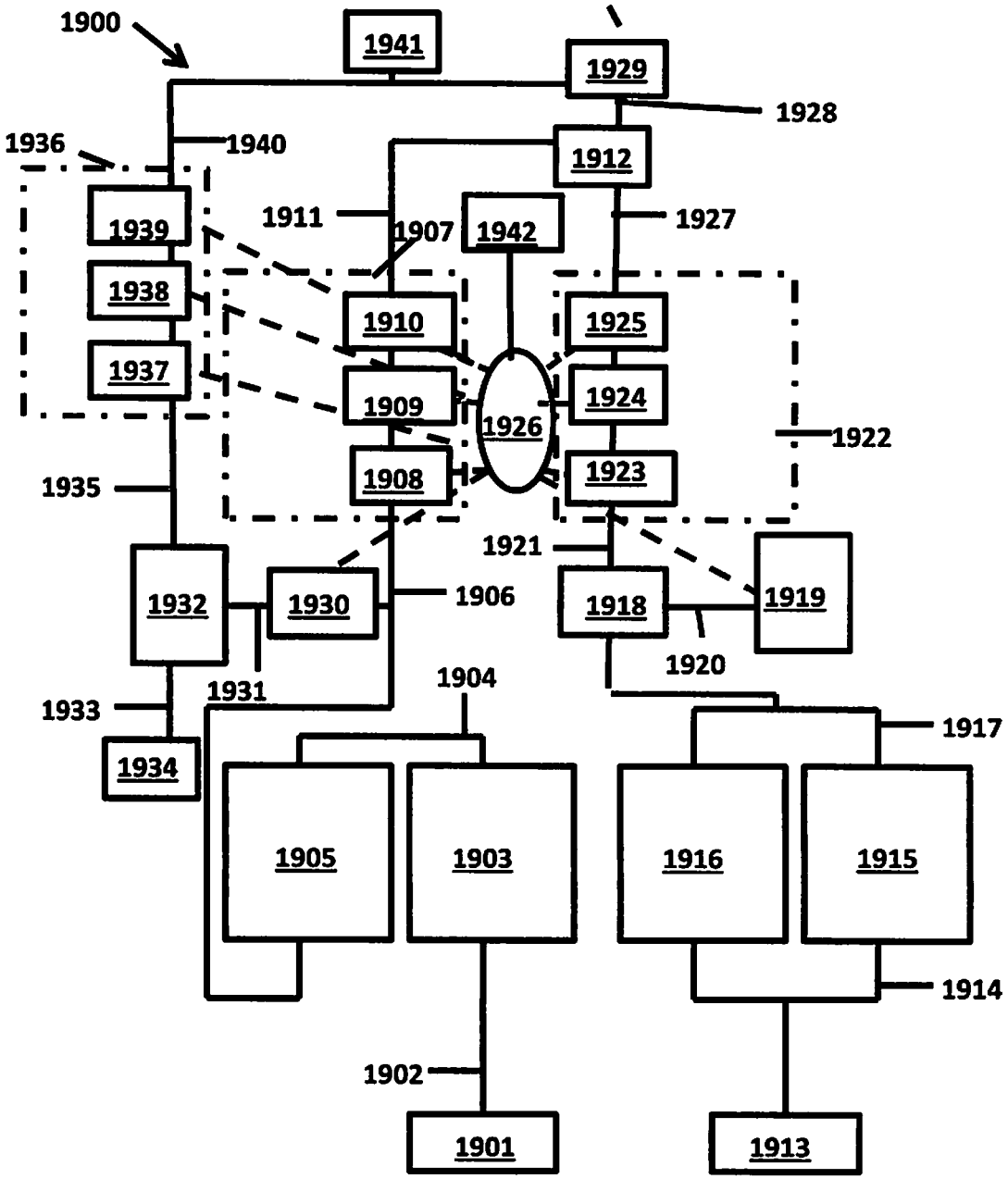
FIG. 19 is a block diagram illustrating an exemplary compressed gas foam system.

FIG. 19 is a block diagram illustrating an exemplary compressed gas foam system 1900. The compressed gas foam system 1900 includes a gas source 1901 coupled to conduit 1902. Conduit 1902 provides fluid communication between the gas source 1901 and gas compressor 1903. Gas compressor 1903 is coupled with conduit 1904, which provides fluid communication between gas compressor 1903 and gas compressor 1905.

In one embodiment, the gas compressors 1903 and 1905 are both single stage gas compressors. In another embodiment, the gas compressors 1903 and 1905 are both multistage gas compressors. In yet another embodiment, one of gas compressors 1903 and 1905 is a single stage gas compressor and the other gas compressor is a multistage gas compressor.

In one embodiment, the gas may be, for example, air to provide a compressed air foam system. In another embodiment, the gas may be an inert gas, for example, nitrogen, carbon dioxide, a noble gas (e.g., helium, neon, argon, krypton, xenon, and radon), or a combination thereof, to provide a compressed gas foam system.

The gas compressor 1905 is coupled to conduit 1906, which provides fluid communication between the gas compressor 1905 and the gas control system 1907. The gas control system 1907 includes the gas flow sensor 1908, the gas pressure sensor 1909, and the gas valve 1910. The gas flow sensor 1908 is in fluid communication with the gas pressure sensor 1909, which in turn is in fluid communication with the gas valve 1910. The gas valve 1910 is coupled to conduit 1911, which provides fluid communication between the gas valve 1910 and the first mixing device 1912.

The compressed gas foam system 1900 also includes a fluid source 1913 coupled to conduit 1914, which provides fluid communication between the fluid source 1913 and fluid pumps 1915 and 1916.

In one embodiment, fluid pump 1915 and fluid pump 1916 are both single stage fluid pumps. In another embodiment, fluid pump 1915 and fluid pump 1916 are both multistage fluid pumps.

In one embodiment, fluid pump 1915 is a single stage fluid pump and fluid pump 1916 is a multistage fluid pump. In another embodiment, fluid pump 1915 is a multistage fluid pump and fluid pump 1916 is a single stage fluid pump.

Fluid pumps 1915 and 1916 are coupled to conduit 1917, which provides fluid communication between fluid pumps 1915 and 1916 and the second mixing device 1918. The second mixing device 1918 mixes the fluid from the pumps 1915 and 1916 with a chemical foam mixture received from the foam system 1919 via the conduit 1920.

In one embodiment, the fluid is water. In another embodiment, the foam system 1919 is a single stage foam system. In yet another embodiment, the foam system 1919 is a multistage foam system. In still yet another embodiment, the foam system 1919 is a bladder-type foam system.

The second mixing device 1918 is coupled to conduit 1921, which provides fluid communication between the second mixing device 1918 and the fluid control system 1922. The fluid control system 1922 includes the fluid flow sensor 1923, the fluid pressure sensor 1924, and the fluid valve 1925. The fluid flow sensor 1923 is in fluid communication with the fluid pressure sensor 1924, which in turn is in fluid communication with the fluid valve 1925. The fluid valve 1925 is coupled to conduit 1927, which provides fluid communication between the fluid valve 1925 and the first mixing device 1912.

The first mixing device 1912 combines the gas received from the gas compressors 1903 and 1905 with the mixture of fluid and chemical foam to produce compressed gas foam. The first mixing device 1912 is coupled to conduit 1928, which provides fluid communication between the first mixing device 1912 and the nozzle 1929. The nozzle 1929 is a liquid and chemical fire suppression agent nozzle for fire extinction. Suitable nozzles are described in U.S. Pat. Nos. 5,167,285 and 5,312,041.

The components of the gas control system 1907, for example, the gas flow sensor 1908, the gas pressure sensor 1909, and the gas valve 1910, are each independently coupled to send and receive signals from the system controller 1926. In a similar fashion, the components of the fluid control system 1922, for example, the fluid flow sensor 1923, the fluid pressure sensor 1924, and the fluid valve 1925 are each independently coupled to send and receive signals from the system controller 1926. In this manner, the system controller 1926 controls the ratio of gas to fluid by varying the flow of gas through the gas valve 1910 and the flow of fluid through fluid valve 1925.

The operator control panel and display 1942 receives and sends system status information from the system controller 1926. The system operator, for example, a fire truck engineer, can set controls manually with hand-operated valves and levers, or enters commands by way of the operator control panel and display 1942. In one embodiment, the operator control panel and display 1942 includes mechanical switches and digital displays. In another embodiment, the operator control panel and display 1942 includes a touch screen display. Touch screen displays are well known in the art and are electronic visual displays that can detect the presence and location of a touch within the display area. In another embodiment, the operator control panel and display 1942 includes an electronic visual display that can detect the presence of a light pen. These displays are also well known in the art.

The conduit 1906 is coupled to the valve 1930, which is in fluid communication with conduit 1931 leading to the chemical fire suppression agent reservoir 1932. The chemical fire suppression agent reservoir 1932 may contain a chemical suppression agent, typically a powder or a second inert fluid such as carbon dioxide. The chemical fire suppression agent reservoir 1932 is coupled to an optional pressurized gas container 1934 via the conduit 1933, which may provide a back-up gas supply to propel the chemical fire suppression agent from the chemical fire suppression agent reservoir 1932 out to the nozzle 1929.

The chemical fire suppression agent reservoir 1932 is coupled to conduit 1935, which provides fluid communication between the chemical fire suppression agent reservoir 1932 and the chemical fire suppression agent control system 1936. The chemical fire suppression agent control system 1936 includes the chemical fire suppression agent flow sensor 1937, the chemical fire suppression agent pressure sensor 1938, and the chemical fire suppression agent valve 1939. The chemical fire suppression agent flow sensor 1937 is in fluid communication with the chemical fire suppression agent pressure sensor 1938, which in turn is in fluid communication with the chemical fire suppression agent valve 1939. The chemical fire suppression agent valve 1939 is coupled to conduit 1940, which provides fluid communication between the chemical fire suppression agent valve 1939, the optional outlet regulator 1941, and the nozzle 1929.

The system controller 1926 operatively coupled to the gas control system 1907, the fluid control system 1922, the second gas valve 1930, the foam system 1919, and the chemical fire suppression agent control system 1936. The system controller 1926 includes a programmable input. The system controller 1926 is also configured, for example, to receive a sensed fluid flow rate from the fluid flow sensor 1923, a sensed fluid pressure from the fluid pressure sensor 1924, a sensed gas flow rate from the first gas flow sensor 1908, a sensed gas pressure from the gas pressure sensor 1909; a sensed chemical fire suppression agent flow rate from the chemical fire suppression agent flow sensor 1937; and a sensed chemical fire suppression agent pressure from the chemical fire suppression agent pressure sensor 1938. The system controller 1926 is also configured, for example, to output a first control signal to the fluid valve 1925 for regulating a fluid flow, a fluid pressure, or a combination thereof, and to output a second control signal to the first gas valve 1910 for regulating a gas flow relative to the sensed fluid flow, the sensed fluid pressure, or a combination thereof. The system controller 1926 automatically adjusts the first control signal and the second control signal to maintain a ratio of fluid flow to gas flow based upon the programmable input. The system controller 1926 is also configured, for example, to output a third control signal to the second gas valve 1930 for regulating the flow of gas to from the gas compressor 1905 to pressurize the chemical fire suppression agent reservoir 1932. The system controller 1926 is also configured, for example, to output a fourth control signal to the chemical fire suppression agent valve 1939 for regulating the flow of a chemical fire suppression agent. The system controller 1926 is also configured, for example, to output a fifth control signal to the foam system 1919 to control the output of the foam system 1919.

Figure 20:
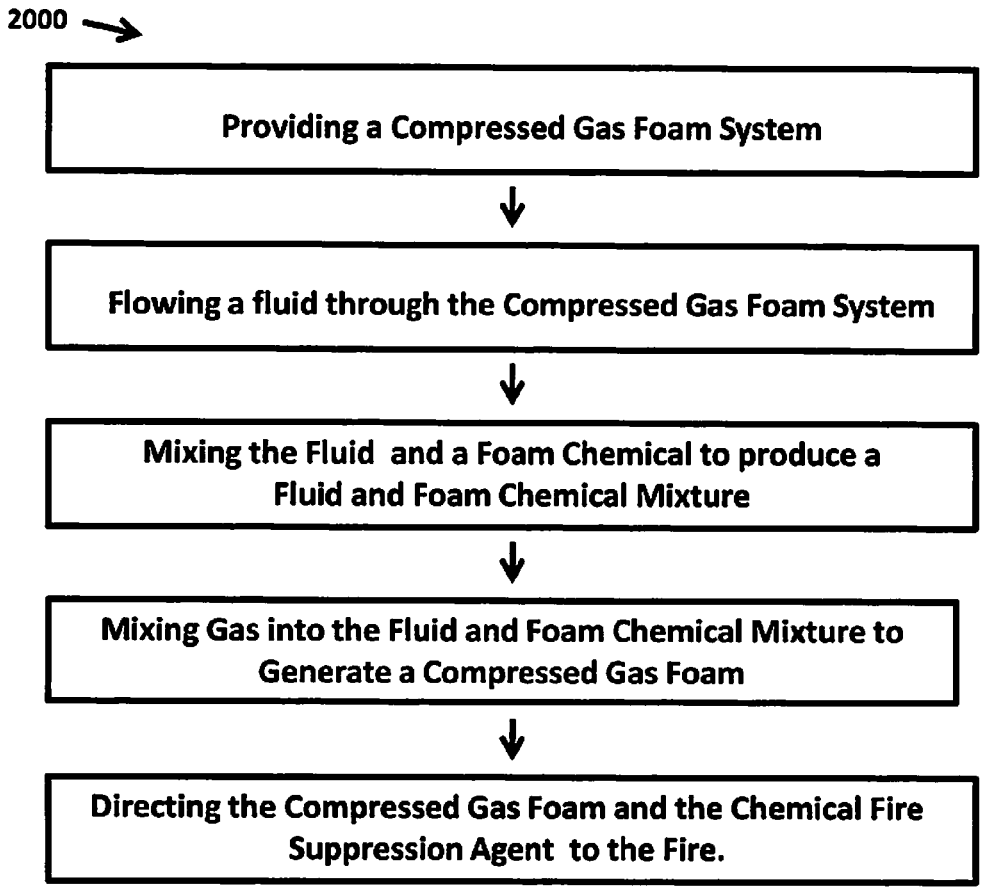
FIG. 20 is a block diagram illustrating an exemplary method of suppressing or preventing a fire.

FIG. 20 is a block diagram illustrating an exemplary method of suppressing or preventing a fire 2000. The method 2000 includes; providing a compressed gas foam system; flowing a fluid through a flow path through the compressed gas foam system; mixing the fluid and a foam chemical to produce a fluid and foam chemical mixture; mixing gas into the fluid and foam chemical mixture to generate a compressed gas foam; and directing the compressed gas foam and the chemical fire suppression agent to the fire.

In FIGS. 1-19, as described herein, an optional pressure regulator not shown may be coupled to a high pressure conduit and a low pressure conduit. In one embodiment, the compressed gas foam is discharged from the high pressure conduit. In another embodiment, the compressed gas foam is discharged from the low pressure conduit. In yet another embodiment, the compressed gas foam is discharged simultaneously from the high pressure conduit (not shown) and the low pressure conduit.

In FIGS. 1-19, as described herein, all of the other components of the compressed gas systems, for example, the fluid source, the gas source, the one or more fluid pumps, the one or more gas compressors, the one or more foam systems, and the two or more mixing devices are each independently coupled to send and receive signals from the system controller so that the system controller may control all operations within the compressed gas systems.

In FIGS. 1-19, as described herein, all of the fluid mixing devices may include, for example, a t-joint, a motionless mixer, or a combination thereof.

In FIGS. 1-19, as described herein, any number of check valves may be included in the conduits to prevent back flow of the fluid or gas.

In FIGS. 1-19, as described herein, any number of fluid regulators may be included in the conduits to regulate the fluid flow as needed.

In FIGS. 1-19, as described herein, any number of gas regulators may be included in the conduits to regulate the gas flow as needed. Suitable single stage gas compressors for the compressed gas foam systems described herein include, for example, the Sullair compressors (Vanair Manufacturing Inc., Michigan City, Ind.) and Atlas Copco Single Stage Air Compressors (Air Technologies, Columbus, Ohio). Suitable multistage gas compressors for the compressed gas foam systems described herein include, for example, the Sullair compressors (Vanair Manufacturing Inc., Michigan City, Ind.) and the Atlas Copco GR 110-200 or XRS-type Air Compressors (Air Technologies, Columbus, Ohio).

In FIGS. 1-19, as described herein, any number of control devices may be used to regulate the ratios of gas to fluid, gas to foam chemical, fluid to foam chemical, or combinations thereof.

In FIGS. 1-19, as described herein, one or more compressed gas containers, for example, cylinders, may be substituted for the one or more gas compressors. In one embodiment, one or more gas compressors may be used in combination with one or more compressed gas containers. In another embodiment, if more than one compressed gas container is used, the gas containers may contain the same gas or different gasses.

In FIGS. 1-19, as described herein, one or more liquidized gas containers, for example, may be substituted for the one or more gas compressors. In one embodiment, one or more gas compressors may be used in combination with one or more liquidized gas containers. In another embodiment, if more than one liquidized gas container is used, the liquidized gas containers may contain the same liquidized gas or different liquidized gasses.

In FIGS. 1-19, as described herein, the compressed gas foam systems may include one or more check valves. Typically, one or more check valves are include in each of the conduits down flow of each of the compressors, each of the fluid pumps, each of the gas valves, each of the fluid valves, or a combination thereof.

In FIGS. 1-19, as described herein, one or more foam systems, for example, may each independently contain foam fire retardant that is a class A foam available under various trade names. Class A foam is useful for fires involving solid combustibles, building materials, structures, rubbish, vehicles, industrial, marine, wild lands, and the like. Other classes of foam can be stored in the one or more foam systems. For example, class B foam is used for flammable liquid fires, class C foam is more effective against electrical fires, and class D foam is best suited for combustible metals. The one or more foam systems may contain other fire retardants and chemical agents.

Fires require heat, oxygen, and fuel, known as the fire triangle, to continue burning. Water alone reduces the heat portion of the fire interaction. A water-foam mixture offers the advantage of attacking all three legs of the fire triangle. The foam coats the fuel and isolates the heat and oxygen. The foam also reduces water droplet size to more effectively reduce heat. For many types of fires, the use of water-foam mixture extinguishes fires more quickly, requires less water, reduces property damage, and preserves arson-related evidence.

In FIGS. 1-19, as described herein, each of the system controllers may independently communicate with each component of the each gas control system and each fluid control system with by a hardwired network cable, for example, a RS485-type cable, using a standard communication protocol. Other communications methods may be utilized including, for example, radio frequency (RF), infrared (IR), fiber optic, Ethernet and the like. Each of the system controllers may also include one or more memories and one or more processors. Each processor may be, for example, a programmable microprocessor, a microcontroller, an application specific integrated circuit (ASIC), a programmable logic array (PAL) and the like, or a combination thereof. Each of the system controllers may further include driver circuits to control devices in each compressed gas foam system.

In FIGS. 1-19, as described herein, each of the one or more gas compressors, the one or more fluid pump, the one or more foam system, any of the one or more mixing devices, the one or more check valves, the one or more regulators (both gas and fluid), one or more sensors, the one or more system controllers, or the combination thereof may be independently powered by electricity, hydraulic pressure, compressed gas, one or more internal combustion engines, one or more transmissions, one or more power take offs, or any combination thereof.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A compressed gas foam system comprising:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a fluid control system comprising a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system comprising a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller comprises a programmable input, wherein the system controller is configured:

to receive a sensed fluid flow rate from the fluid flow sensor, to receive a sensed fluid pressure from the fluid pressure sensor;

to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input.

2. The compressed gas foam system of claim 1, wherein the system controller comprises a programmable microprocessor, a microcontroller, an application specific integrated circuit, a programmable logic array, or a combination thereof.

3. The compressed gas foam system of claim 1, wherein the compressed gas foam is discharged from the outlet of the second mixing device at a pressure from about 25 pounds per square inch to about 500 pounds per square inch.

4. The compressed gas foam system of claim 1, further comprising an outlet regulator having an inlet, a low pressure outlet, and a high pressure outlet, wherein the inlet is placed in fluid communication with the outlet of the second mixing device.

5. The compressed gas foam system of claim 4, further comprising one or more delivery conduits each having an inlet and an outlet, wherein the inlet of each of the one or more delivery conduits is placed in fluid communication with the low pressure outlet of the outlet regulator, the high pressure outlet of the outlet regulator, or a combination thereof, wherein a compressed gas foam is communicated through each of the one or more delivery conduits and allowed to discharge from the outlet of each of the one or more delivery conduits.

6. The compressed gas foam system of claim 5, wherein the compressed gas foam is discharged from the outlet of each of the one or more delivery conduits is placed in fluid communication with the low pressure outlet of the outlet regulator at a pressure from about 25 pounds per square inch to about 125 pounds per square inch.

7. The compressed gas foam system of claim 5, wherein the compressed gas foam is discharged from the outlet of each of the one or more delivery conduits is placed in fluid communication with the high pressure outlet of the outlet regulator at a pressure from about 125 pounds per square inch to about 225 pounds per square inch.

8. The compressed gas foam system of claim 1, wherein each of the one or more fluid pumps is a single stage fluid pump, a multistage fluid pump, or a combination thereof.

9. The compressed gas foam system of claim 8, wherein if two or more fluid pumps are present, at least one of the fluid pumps is a single stage fluid pump and at least one of the fluid pumps is a multistage fluid pump.

10. The compressed gas foam system of claim 8, wherein if two or more fluid pumps are present, the outlet of the first fluid pump is configured to pump fluid at a first fluid pressure and is coupled to the inlet of the second fluid pump and the outlet of the second fluid pump is configured to pump fluid at a second fluid pressure, wherein the second fluid pressure is greater than the first fluid pressure.

11. The compressed gas foam system of claim 1, wherein each of the one or more gas compressors is a single stage gas compressor, a multistage gas compressor, or a combination thereof.

12. The compressed gas foam system of claim 11, wherein if two or more gas compressors are present, at least one of the gas compressors is a single stage gas compressor and at least one of the gas compressors is a multistage gas compressor.

13. The compressed gas foam system of claim 11, wherein if two or more gas compressors are present, the outlet of the first gas compressor is configured to pump gas at a first gas pressure and is coupled to the inlet of the second gas compressor and the outlet of the second gas compressor is configured to pump gas at a second gas pressure, wherein the second gas pressure is greater than the first gas pressure.

14. The compressed gas foam system of claim 11, wherein if two or more gas compressors are present, the two or more gas compressors are coupled in parallel.

15. The compressed gas foam system of claim 1, wherein if two or more foam systems are present, the outlet of the first foam system is configured to pump a foam solution at a first foam solution pressure and is coupled to the inlet of the second foam system and the outlet of the second foam system is configured to pump a foam solution at a second foam solution pressure, wherein the second foam solution pressure is greater than the first foam solution pressure.

16. The compressed gas foam system of claim 1, wherein if two or more foam systems are present, the two or more foam systems are coupled in parallel.

17. The compressed gas foam system of claim 1, wherein each of the one or more fluid pumps, the one or more gas compressors, and the one or more foam systems is independently coupled with one or more power sources.

18. A compressed air foam system comprising:

one or more water pumps each having an inlet and an outlet, wherein each inlet is placed in fluid communication with a water source;

a first mixing device having a first inlet, a second inlet, and an outlet, wherein the first inlet of the first mixing device is placed in fluid communication with the outlet of each of the one or more water pumps, wherein the second inlet of the first mixing device is placed in fluid communication with one or more foam systems, wherein the outlet of the first mixing system is placed in fluid communication with a water control system comprising a water flow sensor having an inlet and an outlet, a water pressure sensor having an inlet and an outlet, and a water valve having an inlet and an outlet, wherein the inlet of the water flow sensor is placed in fluid communication with the outlet of the first mixing device, wherein the outlet of the water flow sensor is placed in fluid communication with the inlet of the water pressure sensor, wherein the outlet of the water pressure sensor is placed in water communication with the inlet of the water valve;

a second mixing device having a first inlet, a second inlet, and an outlet, wherein the first inlet of the second mixing device is placed in fluid communication with the outlet of the water valve;

one or more air compressors each having an inlet and an outlet, wherein each inlet of the one or more air compressors is placed in fluid communication with the air source, and wherein each outlet of the one or more air compressors is placed in fluid communication with an air control system comprising an air flow sensor having an inlet and an outlet, an air pressure sensor having an inlet and an outlet, and an air valve having an inlet and an outlet, wherein the inlet of the air flow sensor is placed in fluid communication with each outlet of the one or more air compressors, wherein the outlet of the air flow sensor is placed in fluid communication with the inlet of the air pressure sensor, wherein the outlet of the air pressure sensor is placed in fluid communication with the inlet of the air valve, wherein the outlet of the air valve is placed in fluid communication with the second inlet of the second mixing device; and a system controller operatively coupled to the air control system and to the water control system, wherein the system controller comprises a programmable input, wherein the system controller is configured:

to receive a sensed water flow rate from the water flow sensor, to receive a sensed water pressure from the water pressure sensor;

to receive a sensed air flow rate from the air flow sensor, to receive a sensed air pressure from the air pressure sensor, to output a first control signal to the water valve for regulating a water flow, to output a second control signal to the air valve for regulating an air flow relative to the sensed water flow, wherein the system controller automatically adjusts the first control signal and the second control signal to maintain a ratio of water flow to air flow based upon the programmable input, wherein each of the one or more water pumps, the one or more air compressors, and the one or more foam systems is independently coupled with one or more power sources.

19. A compressed air foam system comprising:

one or more water pumps each having an inlet and an outlet, wherein each inlet is placed in fluid communication with a water source;

a first mixing device having a first inlet, a second inlet, and an outlet, wherein the first inlet of the first mixing device is placed in fluid communication with the outlet of each of the one or more water pumps, wherein the second inlet of the first mixing device is placed in fluid communication with one or more foam systems, wherein the outlet of the first mixing system is placed in fluid communication with a water control system comprising a water flow sensor having an inlet and an outlet, a water pressure sensor having an inlet and an outlet, and a water valve having an inlet and an outlet, wherein the inlet of the water flow sensor is placed in fluid communication with the outlet of the first mixing device, wherein the outlet of the water flow sensor is placed in fluid communication with the inlet of the water pressure sensor, wherein the outlet of the water pressure sensor is placed in fluid communication with the inlet of the water valve;

a second mixing device having a first inlet, a second inlet, and an outlet, wherein the first inlet of the second mixing device is placed in fluid communication with the outlet of the water valve;

one or more air compressors each having an inlet and an outlet, wherein each inlet of the one or more air compressors is placed in fluid communication with the air source, and wherein each outlet of the one or more air compressors is placed in fluid communication with an air control system comprising an air flow sensor having an inlet and an outlet, an air pressure sensor having an inlet and an outlet, and an air valve having an inlet and an outlet, wherein the inlet of the air flow sensor is placed in fluid communication with each outlet of the one or more air compressors, wherein the outlet of the air flow sensor is placed in fluid communication with the inlet of the air pressure sensor, wherein the outlet of the air pressure sensor is placed in fluid communication with the inlet of the air valve, wherein the outlet of the air valve is placed in fluid communication with the second inlet of the second mixing device; and a system controller operatively coupled to the air control system and to the water control system, wherein the system controller comprises a programmable input, wherein the system controller is configured:

to receive a sensed water flow rate from the water flow sensor, to receive a sensed water pressure from the water pressure sensor;

to receive a sensed air flow rate from the air flow sensor, to receive a sensed air pressure from the air pressure sensor, to output a first control signal to the water valve for regulating a water flow, to output a second control signal to the air valve for regulating an air flow relative to the sensed water flow, wherein the system controller automatically adjusts the first control signal and the second control signal to maintain a ratio of water flow to air flow based upon the programmable input, an outlet regulator having an inlet, a low pressure outlet, and a high pressure outlet, wherein the inlet is placed in fluid communication with the outlet of the second mixing device; and one or more delivery conduits each having an inlet and an outlet, wherein the inlet of each of the one or more delivery conduits is placed in fluid communication with the low pressure outlet of the outlet regulator, the high pressure outlet of the outlet regulator, or a combination thereof, wherein a compressed air foam is communicated through each of the one or more delivery conduits and allowed to discharge from the outlet of each of the one or more delivery conduits, wherein each of the one or more multistage water pumps, the one or more multistage air compressors, and the one or more foam systems is independently coupled with one or more power sources.

20. A method of suppressing or preventing a fire comprising:

providing a compressed gas foam system comprising:

one or more fluid pumps each having an inlet and an outlet, wherein each inlet is placed in fluid communication with a fluid source;

a first mixing device having a first inlet, a second inlet, and an outlet, wherein the first inlet of the first mixing device is placed in fluid communication with the outlet of each of the one or more fluid pumps, wherein the second inlet of the first mixing device is placed in fluid communication with one or more foam systems, wherein the outlet of the first mixing system is placed in fluid communication with a fluid control system comprising a fluid flow sensor having an inlet and an outlet, a fluid pressure sensor having an inlet and an outlet, and a fluid valve having an inlet and an outlet, wherein the inlet of the fluid flow sensor is placed in fluid communication with the outlet of the first mixing device, wherein the outlet of the fluid flow sensor is placed in fluid communication with the inlet of the fluid pressure sensor, wherein the outlet of the fluid pressure sensor is placed in fluid communication with the inlet of the fluid valve;

a second mixing device having a first inlet, a second inlet, and an outlet, wherein the first inlet of the second mixing device is placed in fluid communication with the outlet of the fluid valve;

one or more gas compressors each having an inlet and an outlet, wherein each inlet of the one or more gas compressors is placed in fluid communication with the gas source, and wherein each outlet of the one or more gas compressors is placed in fluid communication with a gas control system comprising a gas flow sensor having an inlet and an outlet, a gas pressure sensor having an inlet and an outlet, and a gas valve having an inlet and an outlet, wherein the inlet of the gas flow sensor is placed in fluid communication with each outlet of the one or more gas compressors, wherein the outlet of the gas flow sensor is placed in fluid communication with the inlet of the gas pressure sensor, wherein the outlet of the gas pressure sensor is placed in fluid communication with the inlet of the gas valve, wherein the outlet of the gas valve is placed in fluid communication with the second inlet of the second mixing device; and a system controller operatively coupled to the gas control system and to the fluid control system, wherein the system controller comprises a programmable input, wherein the system controller is configured:

to receive a sensed fluid flow rate from the fluid flow sensor, to receive a sensed fluid pressure from the fluid pressure sensor;

to receive a sensed gas flow rate from the gas flow sensor, to receive a sensed gas pressure from the gas pressure sensor, to output a first control signal to the fluid valve for regulating a fluid flow, a fluid pressure, or a combination thereof, to output a second control signal to the gas valve for regulating a gas flow relative to the sensed fluid flow, the sensed fluid pressure, or a combination thereof, wherein the system controller automatically adjusts the first control signal and the second control signal to maintain a ratio of fluid flow to gas flow based upon the programmable input, flowing a fluid through a flow path through the compressed gas foam system;

mixing the fluid from one of the one or more fluid pumps and a foam chemical in the first mixing device to produce a fluid and foam chemical mixture;

mixing gas from one or more gas compressors into the fluid and foam chemical mixture in the second mixing device to generate a compressed gas foam; and directing the compressed gas foam from the outlet of one or more delivery conduits to the fire.

* * * * *